US010677205B2

(12) United States Patent
Pitcel et al.

(10) Patent No.: US 10,677,205 B2
(45) Date of Patent: Jun. 9, 2020

(54) FUEL DELIVERY INJECTOR

(71) Applicant: Briggs & Stratton Corporation, Wauwatosa, WI (US)

(72) Inventors: Michael D. Pitcel, Waukesha, WI (US); David W. Procknow, Elm Grove, WI (US); Jacob Zuehl, Hartland, WI (US); David A. Kratz, Brookfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 16/230,055

(22) Filed: Dec. 21, 2018

(65) Prior Publication Data

US 2019/0136808 A1 May 9, 2019

Related U.S. Application Data

(63) Continuation of application No. 15/755,451, filed as application No. PCT/US2017/032440 on May 12, 2017, now Pat. No. 10,197,025.

(Continued)

(51) Int. Cl.
*F02M 27/08* (2006.01)
*F02M 37/08* (2006.01)

(Continued)

(52) U.S. Cl.
CPC ..... *F02M 37/08* (2013.01); *F02M 37/007* (2013.01); *F02M 37/0047* (2013.01);

(Continued)

(58) Field of Classification Search
CPC ..... F02M 37/08; F02M 37/20; F02M 37/22; F02M 37/0047; F02M 37/007;

(Continued)

(56) References Cited

U.S. PATENT DOCUMENTS 3,293,516 A 12/1966 Maier et al.
4,552,311 A 11/1985 Casey (Continued)

FOREIGN PATENT DOCUMENTS

DE 10 2008 005 647 A1 7/2009
EP 1 249 598 A2 10/2002

(Continued)

OTHER PUBLICATIONS

International Search Report and Written Opinion, PCT/US2017/032440, Briggs & Stratton Corporation, 9 pages (dated Aug. 28, 2017).

*Primary Examiner* — Thomas N Moulis
(74) *Attorney, Agent, or Firm* — Foley & Lardner LLP

(57) ABSTRACT

A fuel delivery injector includes a housing, an end cap including an inlet port fluidly coupled to a cavity to direct fuel vapor and liquid fuel into the cavity and an outlet port fluidly coupled to the cavity to direct fuel vapor and liquid fuel out of the cavity, a magnetic assembly fixedly positioned within the cavity, and a pumping assembly including a bobbin and a piston. A return spring is coupled to the pumping assembly to bias the pumping assembly to a home position and a valve assembly including a biasing spring is positioned between an inlet chamber and an outlet chamber. The liquid fuel entering the housing through the inlet port flows from the inlet port to the cavity and fuel vapor entering the housing through the inlet port is directed through a conduit to the outlet port.

20 Claims, 55 Drawing Sheets

Related U.S. Application Data

(60) Provisional application No. 62/355,459, filed on May 12, 2016, provisional application No. 62/335,462, filed on May 12, 2016, provisional application No. 62/355,464, filed on May 12, 2016.

(51) Int. Cl.

| | |
|---|---|
| ***F04B 17/03*** | (2006.01) |
| ***F04B 49/06*** | (2006.01) |
| ***F02M 37/00*** | (2006.01) |
| ***F02M 51/00*** | (2006.01) |
| ***F02M 51/04*** | (2006.01) |
| ***F02M 57/02*** | (2006.01) |
| ***F04B 17/04*** | (2006.01) |
| *F04B 53/12* | (2006.01) |

(52) U.S. Cl.
CPC ..... *F02M 51/005* (2013.01); *F02M 51/04* (2013.01); *F02M 57/027* (2013.01); *F04B 17/03* (2013.01); *F04B 17/046* (2013.01); *F04B 49/06* (2013.01); *F02M 2037/085* (2013.01); *F04B 49/065* (2013.01); *F04B 53/129* (2013.01)

(58) Field of Classification Search
CPC .... F02M 51/005; F02M 51/04; F02M 57/027; F04B 17/03; F04B 17/046; F04B 49/06
See application file for complete search history.

(56) References Cited

U.S. PATENT DOCUMENTS

| | | | | |
|---|---|---|---|---|
| 4,756,291 | A | 7/1988 | Cummins et al. | |
| 5,019,119 | A * | 5/1991 | Hare, Sr. | F01L 1/08 123/500 |
| 6,203,288 | B1 | 3/2001 | Kottke | |
| 6,776,143 | B2 * | 8/2004 | Goodenough | F02M 57/023 123/446 |
| 7,150,606 | B2 | 12/2006 | Bonfardeci et al. | |
| 8,225,770 | B2 | 7/2012 | Ohta et al. | |
| 8,657,586 | B2 | 2/2014 | Achor | |
| 2005/0045155 | A1 | 3/2005 | Harvey et al. | |
| 2006/0070941 | A1 | 4/2006 | Cline et al. | |
| 2009/0071448 | A1 * | 3/2009 | Smith | F02M 37/20 123/516 |
| 2009/0217911 | A1 * | 9/2009 | Yokura | F02M 37/103 123/457 |
| 2010/0024775 | A1 * | 2/2010 | Takahashi | F02M 37/007 123/470 |
| 2010/0047090 | A1 * | 2/2010 | Marx | F02M 37/08 417/410.1 |
| 2013/0298871 | A1 | 11/2013 | Bennett et al. | |
| 2019/0178212 | A1 * | 6/2019 | Hanby | F02M 37/46 |
| 2019/0195377 | A1 * | 6/2019 | Fisch | F16K 24/048 |

FOREIGN PATENT DOCUMENTS

| | | | |
|---|---|---|---|
| EP | 1 832 739 | A1 | 9/2007 |
| WO | WO-2014/066696 | A1 | 5/2014 |

* cited by examiner

FUEL DELIVERY INJECTOR

CROSS-REFERENCE TO RELATED PATENT APPLICATIONS

This application is a continuation of U.S. application Ser. No. 15/755,451, filed Feb. 26, 2018, which is a U.S. National Stage Application of PCT/US2017/032440, filed May 12, 2017, which claims the benefit of U.S. Application No. 62/335,459, filed May 12, 2016, U.S. Application No. 62/335,462, filed May 12, 2016, and U.S. Application No. 62/335,464, filed May 12, 2016, all of which are incorporated herein by reference in their entireties.

BACKGROUND

The present application relates generally to internal combustion engines. More particularly, the present application relates to a fuel delivery injector unit for internal combustion engines.

Fuel injection systems are configured to provide fuel to an internal combustion engine. Fuel injection systems may provide various advantageous over traditional carbureted engine systems including increased fuel economy and cleaner exhaust emissions.

SUMMARY

One embodiment of the invention relates to a fuel delivery injector. The fuel delivery injector includes a housing defining a cavity and extending along a central longitudinal axis, where the housing includes an upper portion and a lower portion including a sleeve having an outlet, an end cap coupled to the upper portion of the housing, the end cap including an inlet port fluidly coupled to the cavity to direct liquid fuel and fuel vapor into the cavity and an outlet port fluidly coupled to the cavity to direct liquid fuel and fuel vapor out of the cavity, a magnetic assembly including a plurality of plates, where the plates are arranged to alternate between a non-magnetized plate and a magnetized plate, and where the magnetic assembly is fixedly positioned within the cavity. The fuel delivery injector further includes a pumping assembly including a bobbin and a piston, where the bobbin includes a coil configured to be coupled to an electrical power supply and is configured to move the pumping assembly within the cavity in response to interaction between a magnetic field created by the coil and the magnetic assembly. The piston is coupled to the bobbin and is configured to move within the sleeve. The fuel delivery injector further includes a return spring coupled to the pumping assembly to bias the pumping assembly to a home position and a valve assembly positioned within a piston portion between an inlet chamber and an outlet chamber, wherein the valve assembly includes a valve configured to move between an open position in which liquid fuel may flow between the inlet chamber and the outlet chamber and a closed position in which liquid fuel is restricted from flowing between the inlet chamber and the outlet chamber, where the valve assembly includes a biasing spring configured to bias the valve toward the open position, the end cap includes a protrusion extending therefrom and terminating at an end face, where the end face is proximate the magnetic assembly and where the protrusion is configured to redirect fuel vapor toward the outlet port.

Another embodiment of the invention relates to an internal combustion engine. The engine includes a cylinder, a piston positioned within the cylinder and configured to reciprocate within the cylinder, and a fuel delivery injector. The fuel delivery injector includes a housing defining a cavity and extending along a central longitudinal axis, where the housing includes an upper portion and a lower portion including a sleeve having an outlet, an end cap coupled to the upper portion of the housing, the end cap including an inlet port fluidly coupled to the cavity to direct liquid fuel and fuel vapor into the cavity and an outlet port fluidly coupled to the cavity to direct fuel vapor and liquid fuel out of the cavity, a magnetic assembly including a plurality of plates, where the plates are arranged to alternate between a non-magnetized plate and a magnetized plate, and wherein the magnetic assembly is fixedly positioned within the cavity and a pumping assembly including a bobbin and a piston. The bobbin includes a coil configured to be coupled to an electrical power supply, where the bobbin is configured to move the pumping assembly within the cavity in response to interaction between a magnetic field created by the coil and the magnetic assembly. The piston is coupled to the bobbin and is configured to move within the sleeve. The fuel delivery injector further includes a return spring coupled to the pumping assembly to bias the pumping assembly to a home position and a valve assembly positioned within a piston portion between an inlet chamber and an outlet chamber, where the valve assembly includes a valve configured to move between an open position in which liquid fuel may flow between the inlet chamber and the outlet chamber and a closed position in which liquid fuel is restricted from flowing between the inlet chamber and the outlet chamber, where the valve assembly includes a biasing spring configured to bias the valve toward the open position. The end cap includes a protrusion extending therefrom and terminating at an end face, where the end face is proximate the magnetic assembly. The protrusion is configured to redirect fuel vapor toward the outlet port and the inlet port and the outlet port extend perpendicularly outward from the central longitudinal axis.

Another embodiment of the invention relates to a fuel delivery injector. The fuel delivery injector includes a housing defining a cavity and extending along a central longitudinal axis, where the housing includes an upper portion and a lower portion including a sleeve having an outlet, an end cap coupled to the upper portion of the housing, the end cap including an inlet port fluidly coupled to the cavity to direct vapor and liquid fuel into the cavity and an outlet port fluidly coupled to the cavity to direct vapor and liquid fuel out of the cavity, where the inlet port extends along an inlet port axis. The fuel delivery injector further includes a magnetic assembly including a plurality of plates, where the plates are arranged to alternate between a non-magnetized plate and a magnetized plate, and wherein the magnetic assembly is fixedly positioned within the cavity, and a pumping assembly including a bobbin and a piston. The bobbin includes a coil configured to be coupled to an electrical power supply, where the bobbin is configured to move the pumping assembly within the cavity in response to interaction between a magnetic field created by the coil and the magnetic assembly. The piston is coupled to the bobbin and is configured to move within the sleeve. The fuel delivery injector further includes a return spring coupled to the pumping assembly to bias the pumping assembly to a home position and a valve assembly positioned within a piston portion between an inlet chamber and an outlet chamber, where the valve assembly includes a valve configured to move between an open position in which liquid fuel may flow between the inlet chamber and the outlet chamber and a closed position in which liquid fuel is restricted from flowing between the inlet chamber and the outlet chamber. The valve assembly includes a biasing spring configured to bias the valve toward the open position. The magnetic assembly is positioned offset from the central longitudinal axis and offset from the piston.

Another embodiment of the invention relates to a fuel delivery injector. The fuel delivery injector includes a housing defining a cavity and extending along a central longitudinal axis, where the housing includes an upper portion and a lower portion including a sleeve having an outlet, an end cap coupled to the upper portion of the housing, the end cap including an inlet port fluidly coupled to the cavity to direct liquid fuel and fuel vapor into the cavity and an outlet port fluidly coupled to the cavity to direct liquid fuel and fuel vapor out of the cavity, where the inlet port extends along an inlet port axis. The fuel delivery injector further includes a magnetic assembly including a plurality of plates, where the plates are arranged to alternate between a non-magnetized plate and a magnetized plate, and wherein the magnetic assembly is fixedly positioned within the cavity, and a pumping assembly including a bobbin and a piston. The bobbin includes a coil configured to be coupled to an electrical power supply, where the bobbin is configured to move the pumping assembly within the cavity in response to interaction between a magnetic field created by the coil and the magnetic assembly. The piston is coupled to the bobbin and is configured to move within the sleeve. The fuel delivery injector further includes a return spring coupled to the pumping assembly to bias the pumping assembly to a home position and a valve assembly positioned remotely from the housing and between an inlet chamber and an outlet chamber, where the valve assembly includes a valve configured to move between an open position in which liquid fuel may flow between the inlet chamber and the outlet chamber through an intermediate conduit and a closed position in which liquid fuel is restricted from flowing between the inlet chamber and the outlet chamber through the intermediate conduit. The valve assembly includes a biasing spring configured to bias the valve toward the open position.

Another embodiment of the invention relates to a smart fuel delivery injector. The smart fuel delivery injector includes a housing defining a cavity and extending along a central longitudinal axis, where the housing includes an upper portion and a lower portion including a sleeve having an outlet, a circuitry compartment defining a circuitry cavity and extending from the housing, an end cap coupled to the upper portion of the housing, the end cap including an inlet port fluidly coupled to the cavity to direct liquid fuel and fuel vapor into the cavity and an outlet port fluidly coupled to the cavity to direct liquid fuel and fuel vapor out of the cavity, where the inlet port extends along an inlet port axis. The smart fuel delivery injector further includes a magnetic assembly including a plurality of plates, where the plates are arranged to alternate between a non-magnetized plate and a magnetized plate, and wherein the magnetic assembly is fixedly positioned within the cavity, and a pumping assembly including a bobbin and a piston. The bobbin includes a coil configured to be coupled to an electrical power supply, where the bobbin is configured to move the pumping assembly within the cavity in response to interaction between a magnetic field created by the coil and the magnetic assembly. The piston is coupled to the bobbin and is configured to move within the sleeve. The smart fuel delivery injector further includes a return spring coupled to the pumping assembly to bias the pumping assembly to a home position and a valve assembly positioned within a piston portion between an inlet chamber and an outlet chamber, where the valve assembly includes a valve configured to move between an open position in which liquid fuel may flow between the inlet chamber and the outlet chamber and a closed position in which liquid fuel is restricted from flowing between the inlet chamber and the outlet chamber. The valve assembly includes a biasing spring configured to bias the valve toward the open position. The circuitry cavity is configured to receive at least a portion of control circuitry configured to control the smart fuel delivery injector. In some embodiments, the coil is directly coupled to the control circuitry disposed within the circuitry compartment. In some embodiments, the circuitry cavity is filled with a resin to seal the control circuitry within the circuitry compartment.

Another embodiment of the invention relates to a fuel delivery injector control system for use with an engine. The fuel delivery injector control system includes a fuel delivery injector, a controller including a processing circuit and a memory, a throttle body, a fuel pump, an ignition coil, an engine throttle control actuator, a pressure sensor, a temperature sensor, an engine speed sensor, a crankshaft position sensor, and a power source. The controller is configured to send and receive signals with at least one of the fuel delivery injector, the throttle body, the fuel pump, the ignition coil, the engine throttle control actuator, the pressure sensor, the temperature sensor, the engine speed sensor, the crankshaft position sensor, and the power source. In some embodiments, the ignition coil is configured to up-convert a low voltage input provided by the power source to a high voltage output to facilitate creating an electric spark in a spark plug to ignite an air-fuel mixture provided by the fuel delivery injector and the throttle body in a combustion chamber of the engine. In some embodiments, the controller is configured to control the voltage input from the ignition coil to the spark plug. In some embodiments, the controller is configured to control the timing of the spark. In some embodiments, the controller is configured to receive at least one of pressure data from the pressure sensor, temperature data from the temperature sensor, and engine speed data from the engine speed sensor and control operation of the fuel delivery injector based on at least one of the pressure data, temperature data, and the engine speed data to inject a predetermined amount of fuel for optimum combustion. In some embodiments, the crankshaft position sensor senses a position of a crankshaft. In some embodiments, the controller is configured to receive crankshaft position data from the crankshaft position sensor and provide cycle synchronization to the fuel delivery injector based on the engine speed data. In some embodiments, the crankshaft position sensor senses a speed of the engine. In some embodiments, the controller is configured to receive engine speed data from the crankshaft position sensor and provide cycle synchronization to the fuel delivery injector based on the engine speed data. In some embodiments, the crankshaft position sensor is configured to identify that a cylinder of the engine is operating in an exhaust-intake cycle. In some embodiments, the crankshaft position sensor is configured to identify that a cylinder of the engine is operating in a compression-power cycle. In some embodiments, the control system further includes an oxygen sensor.

Another embodiment of the invention relates to a fuel delivery injector control system. The fuel delivery injector control system includes a high-side current sensing circuit including a driver module, including a field effect transistor, a flyback diode, and a shunt resistor. The fuel delivery injector control system is configured to continuously measure a current through a coil of a fuel delivery injector. The fuel delivery injector control system controls the average current by switching between an upper and a lower current limit.

Another embodiment of the invention relates to a fuel delivery injector control system. The fuel delivery injector control system includes a low-side current sensing circuit including a driver module, including a field effect transistor, a flyback diode, and a shunt resistor. The low-side current sensing circuit is configured to measure current through a coil of a fuel delivery injector when the field effect transistor is in an on state and control an upper current limit. The low-side current sensing circuit is configured to switch the field effect transistor to an off state for a predetermined time period. In some embodiments, the predetermined time period includes a fixed off time. In some embodiments, the predetermined time period includes a fixed off time at a beginning of an injection process and a subsequent modified off time. In some embodiments, the subsequent modified off time is based on measuring the current through the coil immediately subsequent to switching the field effect transistor to the on state. In some embodiments, the subsequent modified off time is based on monitoring a time period the field effect transistor is in the on state and adjusting an off time relative to the time period.

Another embodiment of the invention relates to a method for detecting a dry fire condition for a fuel delivery injector. The method includes monitoring a field effect transistor switching frequency during an injection phase of the fuel delivery injector. The method further includes detecting the dry fire condition by determining that a frequency drops below a predetermined frequency threshold.

Another embodiment of the invention relates to a method for monitoring a fuel delivery injector for seat impacts. The method includes monitoring a current in a coil of the fuel delivery injector for a rise above a predetermined threshold.

Another embodiment of the invention relates to a method for monitoring a fuel delivery injector for return spring operation. The method includes monitoring a coil return current. The method includes monitoring a back electromotive force from a coil returning after an injection phase to ensure proper return spring operation and a proper off-time for a fuel delivery injector.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which:

FIG. 71 is a diagnostic graph of current versus time for a fuel delivery injector, according to an exemplary embodiment.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Fuel Delivery Injector Unit

Figure 1:
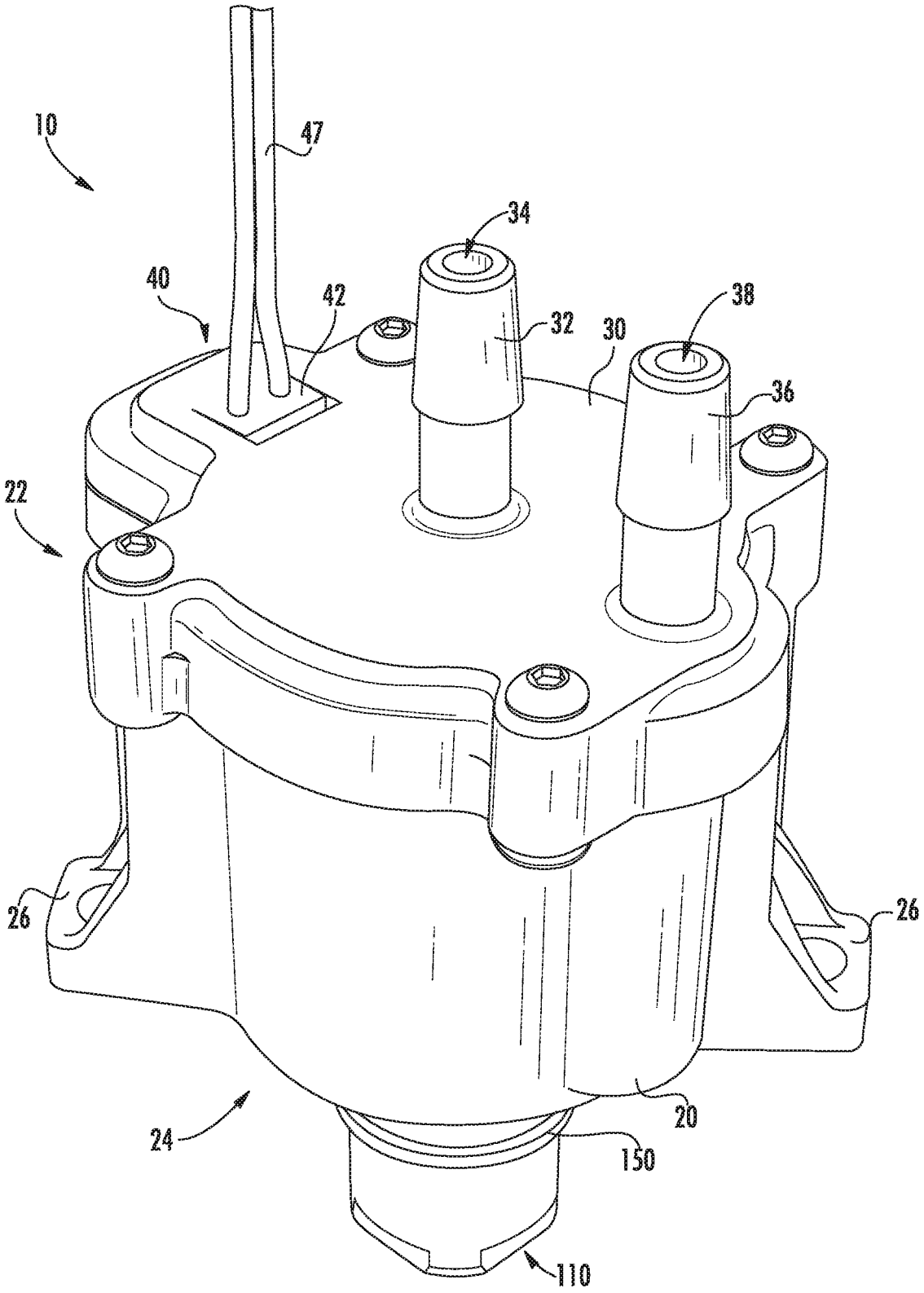
FIGS. 1-8C are various views of a fuel delivery injector unit, according to an exemplary embodiment.
Figure 2:
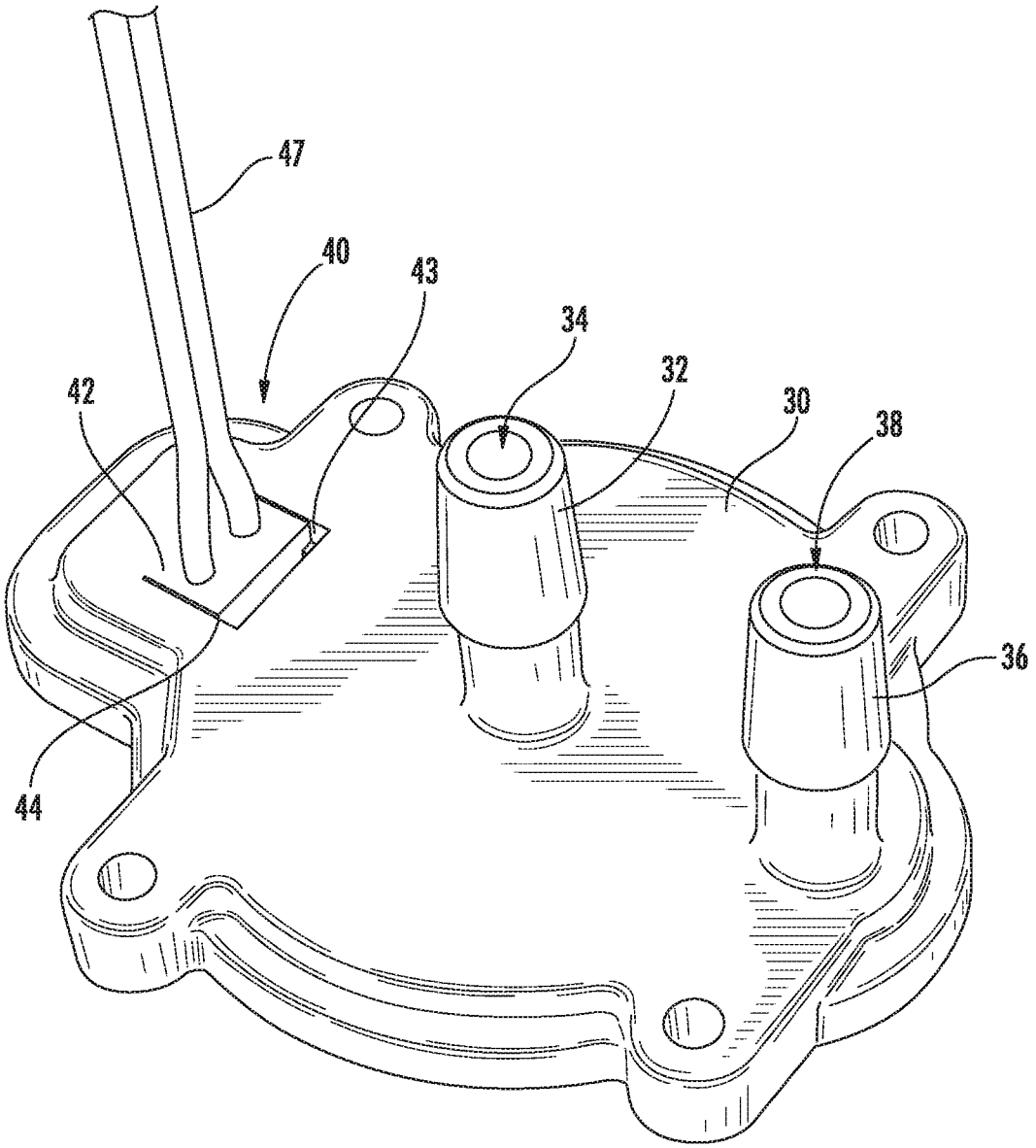

According to the exemplary embodiment shown in FIGS. 1-18, a fuel delivery injector unit, shown as FDI unit 10, includes a body, shown as housing 20; a cap, shown as end cap 30; a magnetic actuation assembly, shown as magnetic assembly 50; a pumping assembly, shown as pumping assembly 80; a first valve assembly, shown as invalve assembly 100; and a second valve assembly, shown as outvalve assembly 110. As shown in FIGS. 5-6, the housing 20 defines a central, longitudinal axis, shown as central axis 12. As shown in FIGS. 1 and 5-6, the housing 20 has a first end, shown as upper portion 22, and an opposing second end (e.g., neck, etc.), shown as lower portion 24. As shown in FIGS. 1 and 5-6, the end cap 30 is coupled to the upper portion 22 of the housing 20. According to an exemplary embodiment, the end cap 30 is ultrasonically welded to the housing 20. In other embodiments, the end cap 30 is otherwise coupled to the housing 20 (e.g., with fasteners, with a threaded engagement, adhesively secured, laser welded, heat staked, etc.). A compliance ring member (e.g., an O-ring, a gasket, etc.), shown as ring 37, is included between the end cap 30 and the top plate 52 of the magnetic assembly 50 (FIG. 5). The ring 37 acts as a compliance member between the end cap 30 and the top plate 52 of the magnetic assembly 50 and provides a downward force against the magnetic assembly 50 to maintain the magnetic assembly 50 within the housing 20. As shown in FIGS. 1 and 5-6, the outvalve assembly 110 is coupled to the lower portion 24 of the housing 20. According to an exemplary embodiment, the outvalve assembly 110 is spin welded to the lower portion 24 of the housing 20. In other embodiments, the outvalve assembly 110 is otherwise coupled to the housing 20 (e.g., with fasteners, with a threaded engagement, adhesively secured, laser welded, ultrasonically welded, heat staked, etc.). In still other embodiments, the outvalve assembly 110 is remotely positioned from the housing 20 of the FDI unit 10 (e.g., fluidly coupled by a fuel conduit, etc.) (shown in FIGS. 8A-8C). As shown in FIGS. 1, and 4-5, the housing 20 includes a coupling interface, shown as bosses or mounting locations 26. According to an exemplary embodiment, the mounting locations 26 are configured to facilitate coupling (e.g., attaching, securing, etc.) the FDI unit 10 to a component of a fuel delivery system (e.g., within and/or to a fuel tank, to a throttle body, to a cylinder head, to a cylinder head intake runner/port, etc.) by providing a location for a fastener or other attachments to couple the FDI unit 10 to another component. As shown in FIGS. 5-6, the housing 20 defines an internal cavity, shown as cavity 28. The cavity 28 is configured (e.g., sized, structured, etc.) to receive and/or support the magnetic assembly 50 (e.g., with the upper portion 22 thereof, etc.), the pumping assembly 80 (e.g., with the lower portion 24 thereof, etc.), and a volume of fuel.

As shown in FIGS. 1-6, the end cap 30 include a first port, shown as inlet port 32, defining a first conduit, shown as inlet conduit 34. According to an exemplary embodiment, the inlet conduit 34 is configured to receive and direct a liquid fuel (e.g., liquid gasoline, from a fuel tank, from a fuel pump, etc.) into the cavity 28 of the housing 20. As shown in FIGS. 1-4 and 6, the end cap 30 includes a second port, shown as outlet port 36, defining a second conduit, shown as outlet conduit 38. According to an exemplary embodiment, the outlet conduit 38 is configured to receive and direct a fuel vapor and/or liquid fuel (e.g., fuel vapor, air, a fuel-air mixture, etc.) out of the cavity 28 of the housing 20 (e.g., to a fuel tank, to additional injectors, etc.). In some embodiments, the FDI unit 10 includes one or more filter elements positioned within the inlet conduit 34 and/or the outlet conduit 38.

As shown in FIG. 5, the magnetic assembly 50 includes a first plate, shown as top plate 52, a second plate, shown as bottom plate 54, and a plurality of intermediate plates, shown as intermediate plates 56. According to an exemplary embodiment, the top plate 52, the bottom plate 54, and/or the intermediate plates 56 include alternating magnetized plates (e.g., magnets, etc.) and non-magnetized plates (e.g., steel, etc.). By way of example, the top plate 52 may include a non-magnetized plate, the bottom plate 54 may include a non-magnetized plate, a first intermediate plate 56 may include a magnetized plate, a second intermediate plate 56 may include a non-magnetized plate, and a third intermediate plate 56 may include a magnetized plate. In other embodiments, the magnetic assembly 50 includes a different number of intermediate plates 56 (e.g., one, two, four, five, etc.). According to an exemplary embodiment, the top plate 52, the bottom plate 54, and the intermediate plates 56 are fixed (e.g., stationary, do not move, etc.) within the cavity 28.

As shown in FIG. 5, the magnetic assembly 50 includes a pin, shown as pin 60. According to an exemplary embodiment, the pin 60 extends through a central aperture in the top plate 52, the bottom plate 54, and the intermediate plates 56. The top plate 52, the bottom plate 54, and the intermediate plates 56 are aligned (e.g., slip fit, press fit, etc.) and held together by the pin 60, according to an exemplary embodiment. As shown in FIG. 6, the pin 60 defines a third conduit, shown as fluid conduit 62, positioned to align with the inlet conduit 34 of the end cap 30 such that the fluid received by the inlet port 32 may flow through the top plate 52, the bottom plate 54, and the intermediate plates 56 via the fluid conduit 62. According to an exemplary embodiment, the pin 60 is formed from a non-magnetic material such as stainless steel, aluminum, plastic, and/or another non-magnetic, fuel compatible material.

As shown in FIG. 5, the FDI unit 10 further includes a reciprocating member, shown as bobbin 64, configured to interface with the magnetic assembly 50. According to an exemplary embodiment, the bobbin 64 is configured to translate (i.e., oscillate) linearly along the central axis 12, relative to the top plate 52, the bottom plate 54, and the intermediate plates 56. As shown in FIG. 5, the top plate 52 includes an overhang, shown as cup 53, that extends down and around a periphery of the intermediate plates 56, forming an annular gap therebetween, shown as recess 58. The recess 58 forms an annular gap for receiving the bobbin 64.

The bobbin 64 has a peripheral wall, shown as wall 68, that extends around the periphery of the bobbin 64. The wall 68 defines a cup shape having a cavity, shown as cavity 69. As shown in FIG. 6, the wall 68 of the bobbin 64 extends within the recess 58, and the cavity 69 receives the bottom plate 54 and the intermediate plates 56 such that the top plate 52 interfaces with the bobbin 64 allowing axial movement of the bobbin 64 along the central axis 12. As shown in FIG. 7, the top plate 52 includes a number of vent apertures or holes 51. The holes 51 are located adjacent to the recess 58 to allow vapor or air to pass through the top plate 52 to and from the recess.

As shown in FIG. 5, the bobbin 64 includes a coil, shown as coil 66, disposed along a periphery of the wall 68 of the bobbin 64 such that the coil 66 is positioned radially between the cup 53 of the top plate 52 and the intermediate plates 56 within the cavity 69 of the bobbin 64. According to an exemplary embodiment, the coil 66 is a voice coil in which the coil 66 moves relative to the magnet rather than the magnet moving relative to the coil 66 as in a solenoid coil. According to an exemplary embodiment, a voice coil provides various advantageous over a solenoid injection unit including reduced weight, requiring less current for operation, less windings. In one embodiment, the electrical wiring that forms the coil 66 is over-molded to the bobbin 64 to secure the coil 66 to the bobbin 64. In another embodiment, the electrical wiring that forms the coil 66 is coated with a urethane coating to secure the coil 66 to the bobbin 64. In still another embodiment, the electrical wiring that forms the coil 66 is a bondable wire that may be melted to form a bond layer between the electrical wiring and the bobbin 54 to secure the coil 66 to the bobbin 64.

Figure 3:
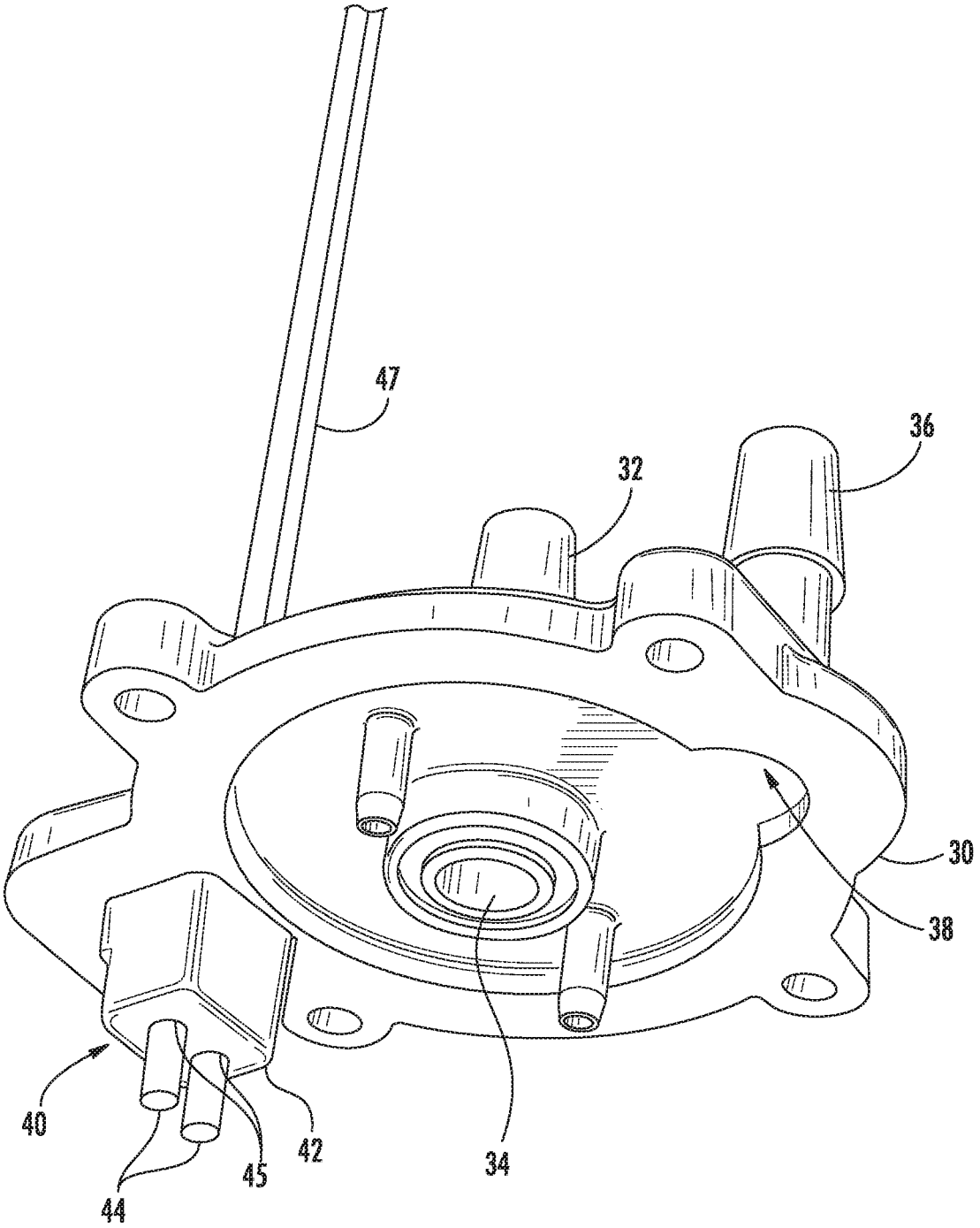
Figure 4:
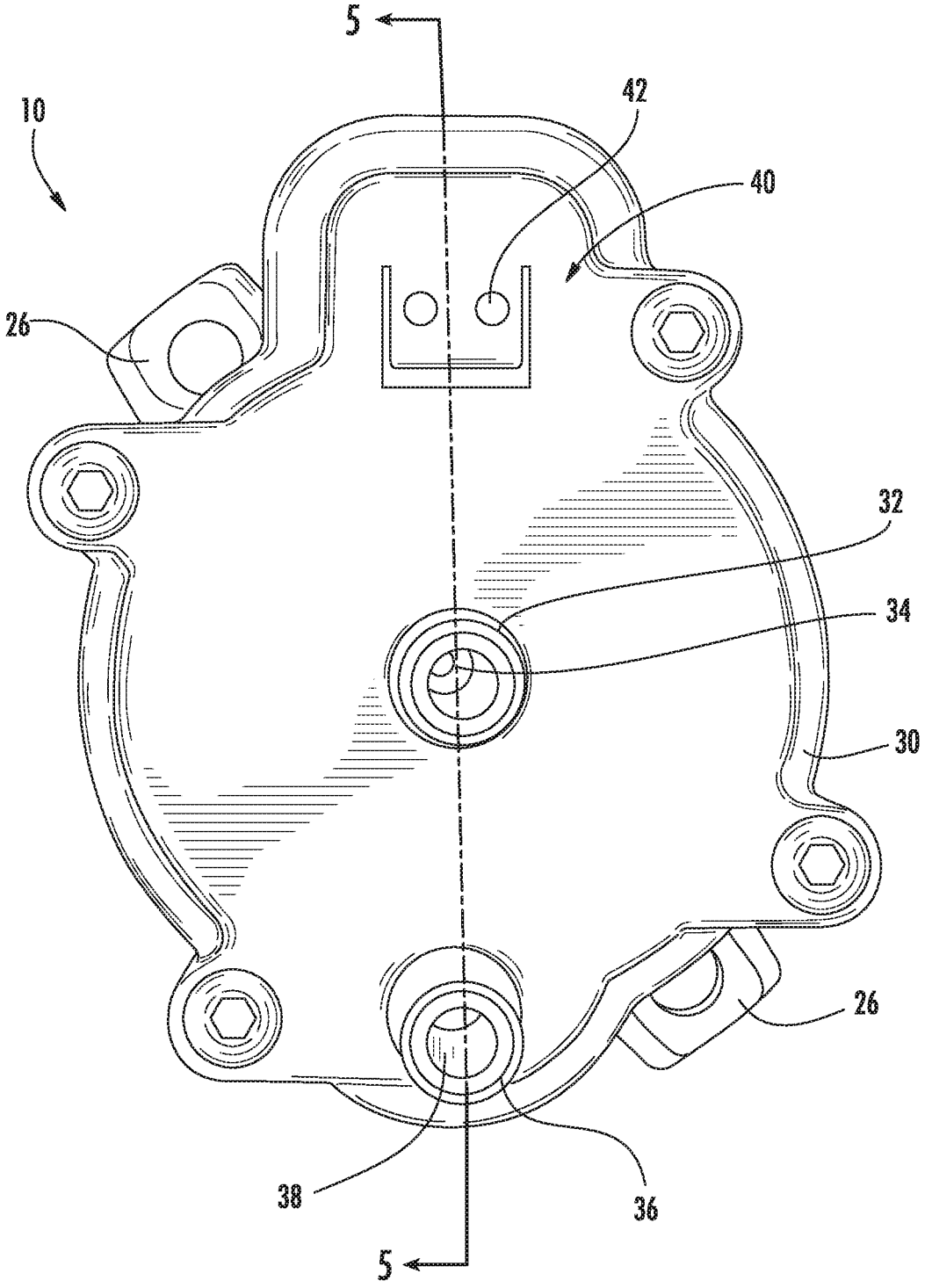
Figure 5:
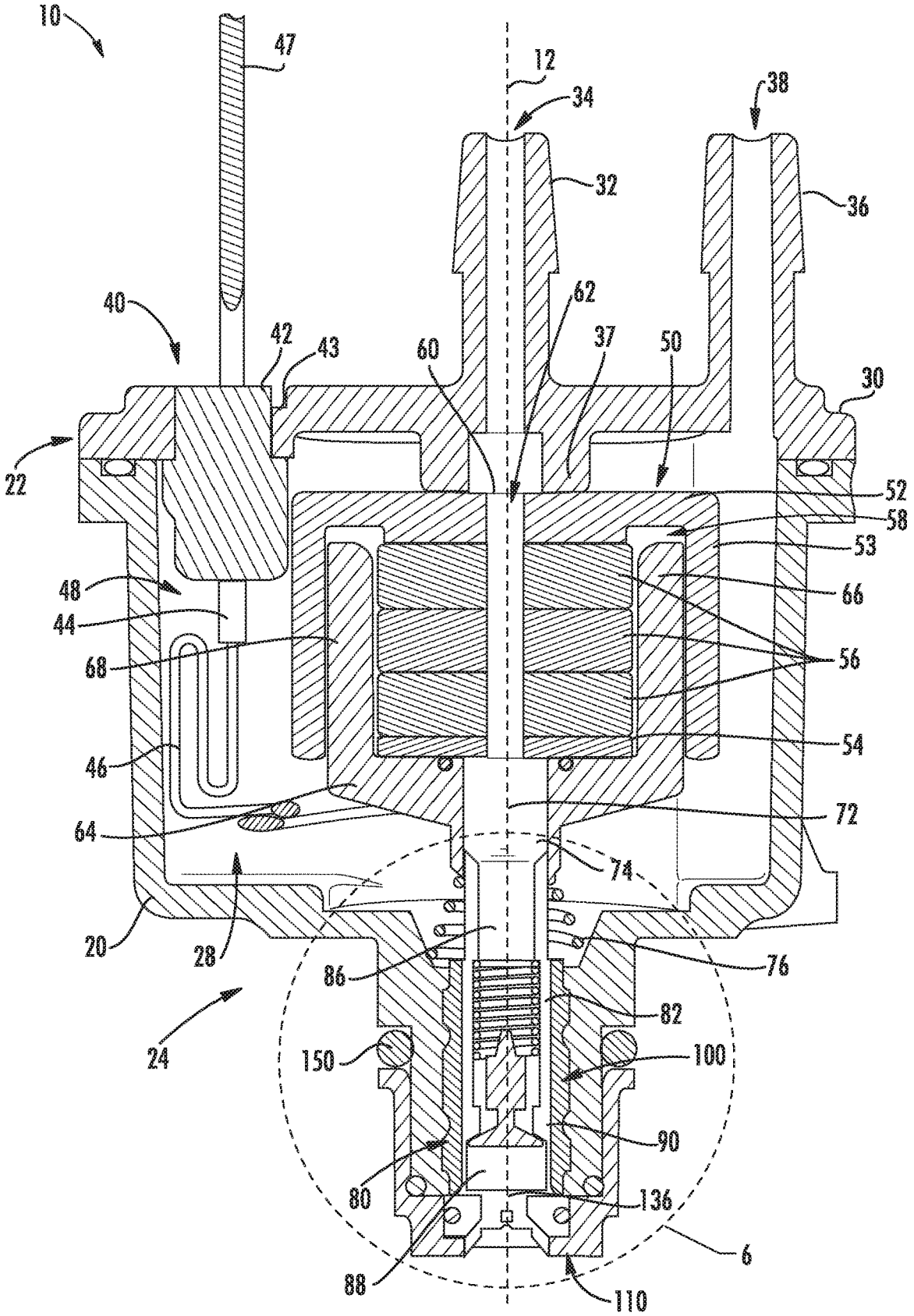
Figure 6:
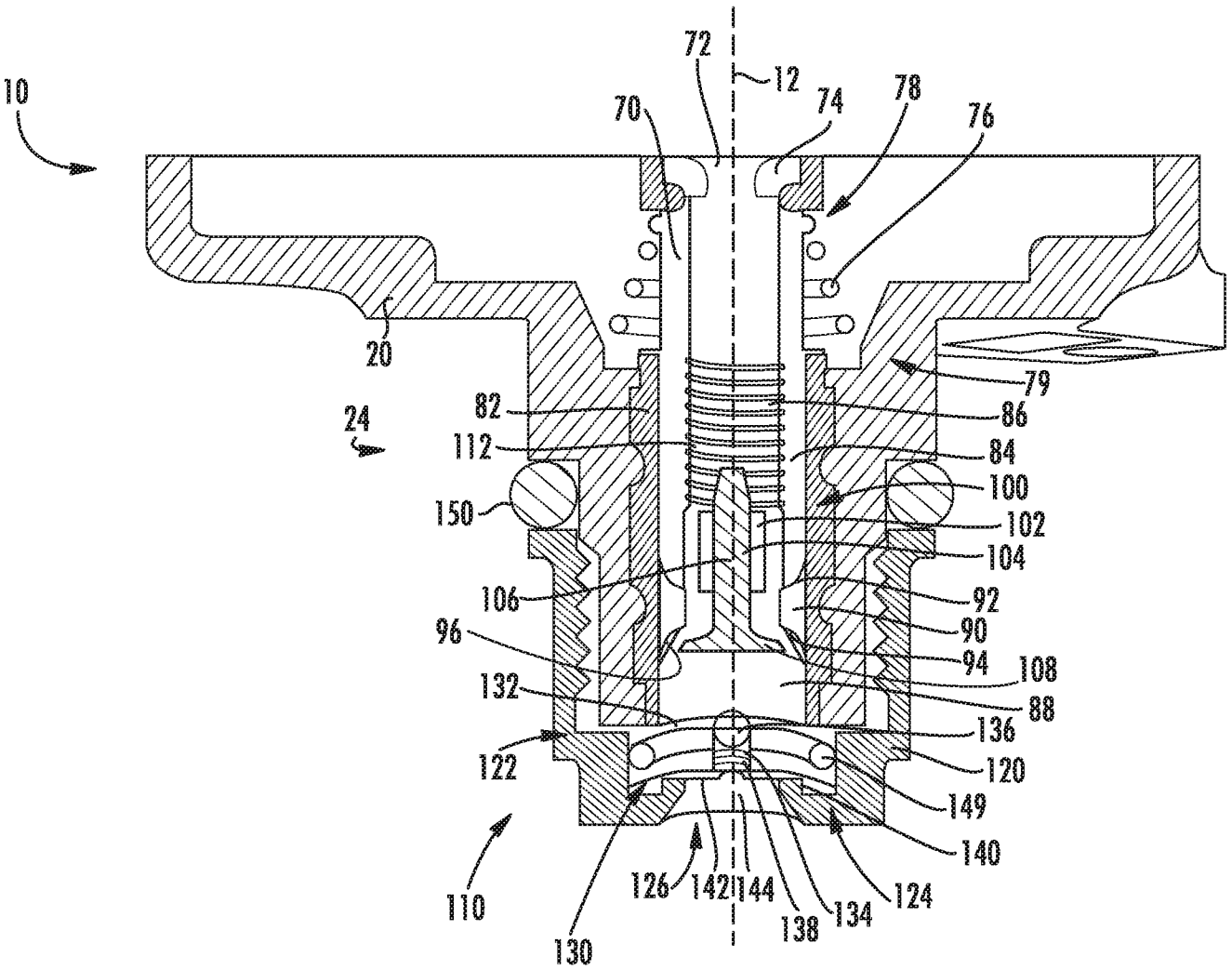
Figure 7:
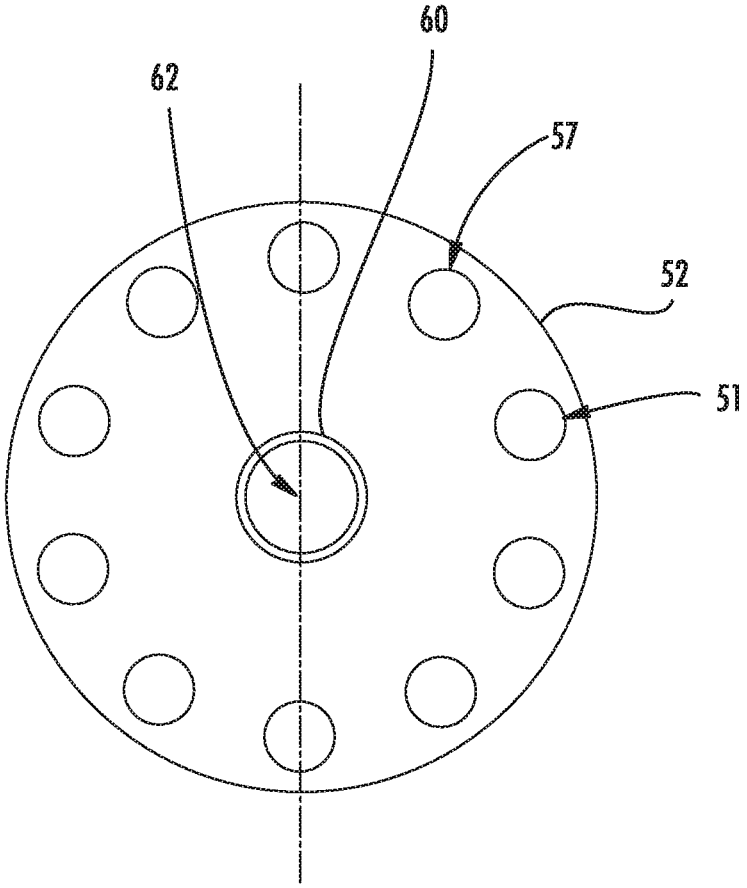

As shown in FIGS. 1-6, the FDI unit 10 includes a power assembly, shown as electrical assembly 40, used to provide electricity to the coil 66. As shown in FIGS. 1 and 5-6, the electrical assembly 40 includes an interface, shown as electrical connector 42, integrally formed with the end cap 30. In one embodiment, the electrical connector 42 is a female connector configured to receive a male connector. In other embodiments, the electrical connector 42 is a male connector. The electrical connector 42 may function as a quick-connect connector configured to electrically couple the FDI unit 10 to a power source (e.g., a battery, a capacitor, etc.) and a controller. In the embodiment shown in FIG. 5, the electrical connector 42 is a female connector including insert molded pins 44 and is integrally formed with the body of the end cap 30. As shown in FIG. 5, the electrical assembly 40 includes a sealing member (e.g., an O-ring, a gasket, epoxy, rubber grommet, etc.), shown as seal 43, positioned between the electrical connector 42 and the end cap 30. The electrical connector 42 fits wholly within the packaging of the housing 20 and the end cap 30 (e.g., approximately flush with end cap 30) and extends into the housing 20 (e.g., into side channel 48). Incorporating the electrical connector 42 into the housing 20 reduces the likelihood of breakage of the electrical connector 42 during the assembly process and/or use of the FDI unit 10. The electrical connector 42 includes lead wires 47 that extend through holes 45 within the end cap 30 (shown in FIG. 3), which may be sealed with epoxy, a rubber grommet, and/or still another sealing system. As shown in FIGS. 3 and 5, the electrical assembly 40 includes a coupling interface, shown as internal connector 44 (e.g., insert molded pins), positioned on an interior of the end cap 30. As shown in FIG. 5, electrical wiring 46 extends from the internal connector 44 to the coil 66. As shown in FIG. 5, the electrical wiring 46 is positioned within a channel, shown as side channel 48, of the housing 20. According to an exemplary embodiment, the electrical wiring 46 is fuel/ethanol tolerant. The electrical wiring 46 freely moves (e.g., situates, positions) within the side channel 48. The electrical wiring 46 extends into the cavity 28 and to the coil 66 such that the electrical assembly 40 may provide power to the coil 66. Providing power to the coil 66 causes the coil 66 to generate a magnetic field that interacts with the magnetic field of the intermediate plates 56 which causes the movement of the bobbin 64. Another embodiment of the electrical assembly 40 includes a butt-splice lead inserted into the end cap 30, including one end connected to the coil 66 lead wires and another end connected to a flying lead that has the electrical connector 42 attached thereto. In other embodiments described herein, the electrical assembly 40 may take on other forms.

As shown in FIGS. 5-6, the bobbin 64 includes a lower portion, shown as stem 70, that extends from the bobbin 64. The stem 70 defines a fourth conduit, shown as fluid conduit 72, positioned to align with the fluid conduit 62 of the pin 60 such that the fluid exiting the fluid conduit 62 of the pin 60 may flow into the fluid conduit 72 of the stem 70. As shown in FIGS. 5-6, the stem 70 defines a plurality of holes, openings, or apertures, shown as holes 74. According to an exemplary embodiment, the holes 74 allow liquid fuel and/or vapor to exit and enter the stem 70 of the bobbin 64 into the cavity 28 of the housing 20. By way of example, the holes 74 may allow vapor to exit the bobbin 64, into the cavity 28, and out of the FDI unit 10 through the outlet conduit 38 (i.e., due to buoyancy). Vapor may come from a fuel supply and/or may be generated inside the FDI unit 10 during movement of the bobbin 64 (e.g., due to a reduction in pressure and/or increase in temperature, etc.). By way of another example, the holes 74 may allow liquid fuel to exit the stem 70 of the bobbin 64 into the cavity 28 of the housing 20 until the cavity 28 reaches a maximum capacity (e.g., the cavity 28 is filled with liquid fuel, etc.). During normal ongoing operation of the FDI unit 10, vapor exits radially through the holes 74 and flows through the cavity 28 to outlet conduit 38. During hot start conditions, vapor exiting through the holes 74 may be forced downward into the cavity 28, causing the liquid fuel to bubble and sending liquid fuel to the outlet conduit 38 instead of the pumping assembly 80. This can be mitigated by changing the location of the holes 74 vertically along the stem 70.

As shown in FIGS. 5-6, the pumping assembly 80 includes a first portion, shown as sleeve 82, and a second portion, shown as piston 90. In some embodiments, the sleeve 82 is press-fit into the body of the housing 20. In some embodiments, the sleeve 82 is insert molded. The piston 90 is received within the sleeve 82. The piston 90 is coupled to the stem 70 of the bobbin 64 such that the bobbin 64 transfers motion and forces generated by the coil 66 to the piston 90, thereby causing the piston 90 to extend and retract within the sleeve 82 (e.g., translate along the central axis 12, etc.). As shown in FIGS. 5-6, the FDI unit 10 includes a spring, shown as return spring 76, positioned between a first step, shown as step 78, defined by the piston 90 and a second step, shown as step 79, defined by the lower portion 24 of the housing 20. According to an exemplary embodiment, the return spring 76 is configured to bias the bobbin 64 towards a resting position (e.g., to return the bobbin 64 back to a resting position after the coil 66 causes the bobbin 64 to extend downward to translate the piston 90 within the sleeve 82, etc.). By way of example, energizing the coil 66 may cause an extension stroke of the piston 90 and the return spring 76 may cause a return stroke of the piston 90 when the coil 66 is de-energized.

Figure 26:
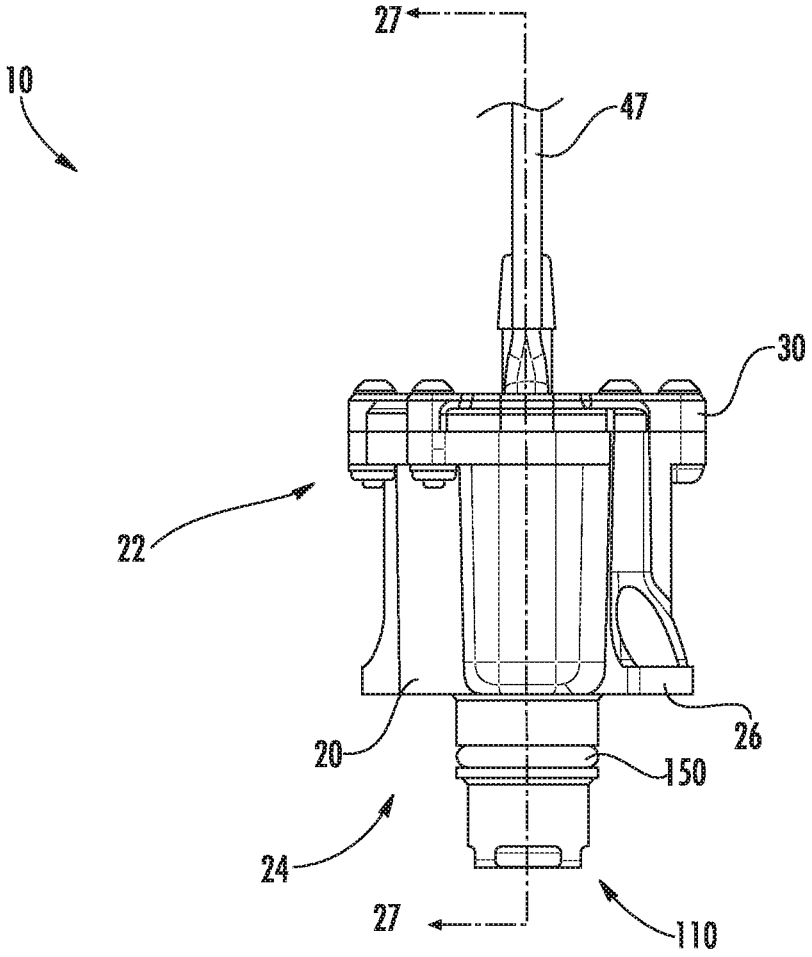
FIGS. 26-28 are various views of a fuel delivery injector unit, according to another exemplary embodiment.
Figure 27:
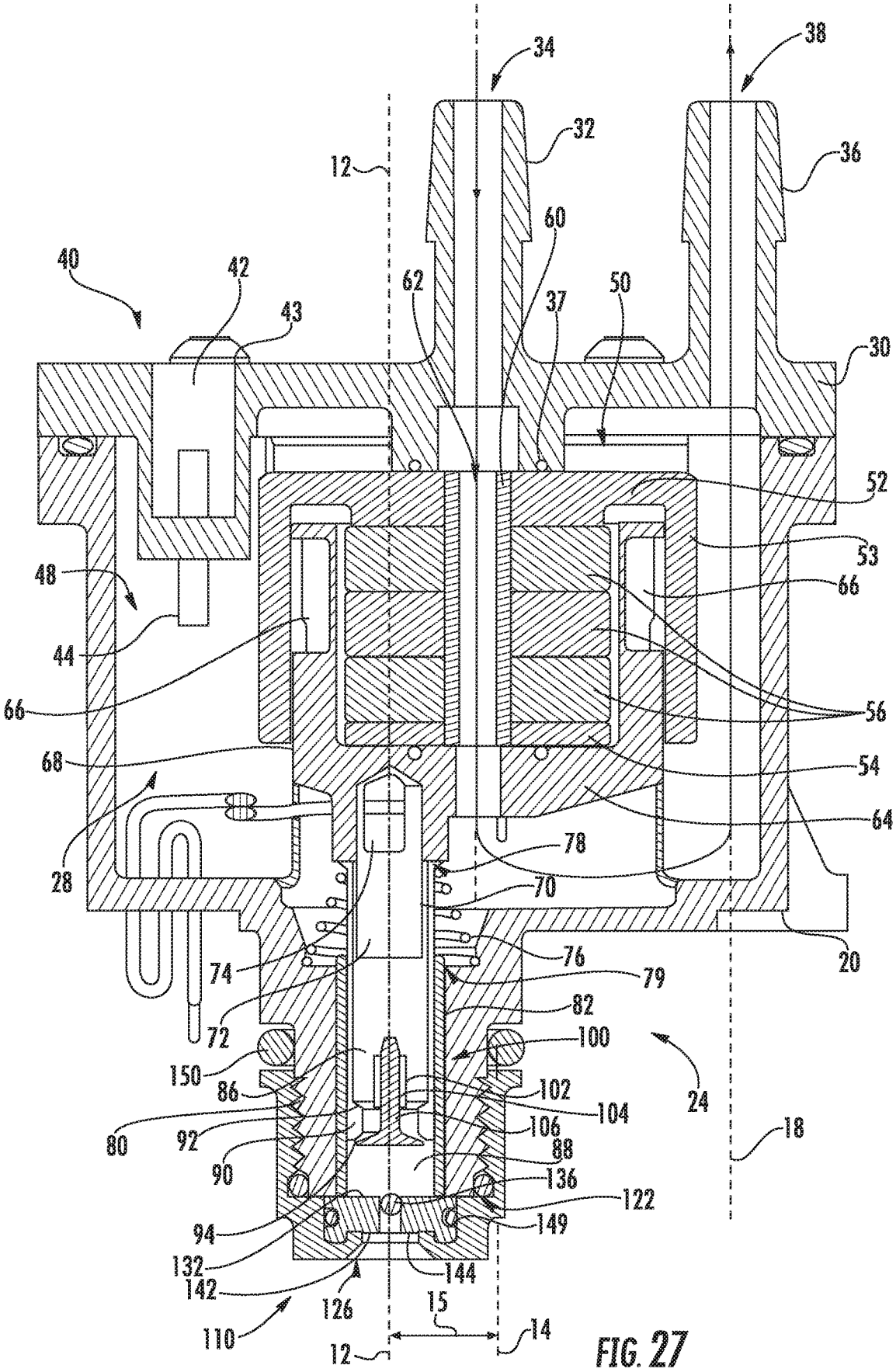
Figure 28:
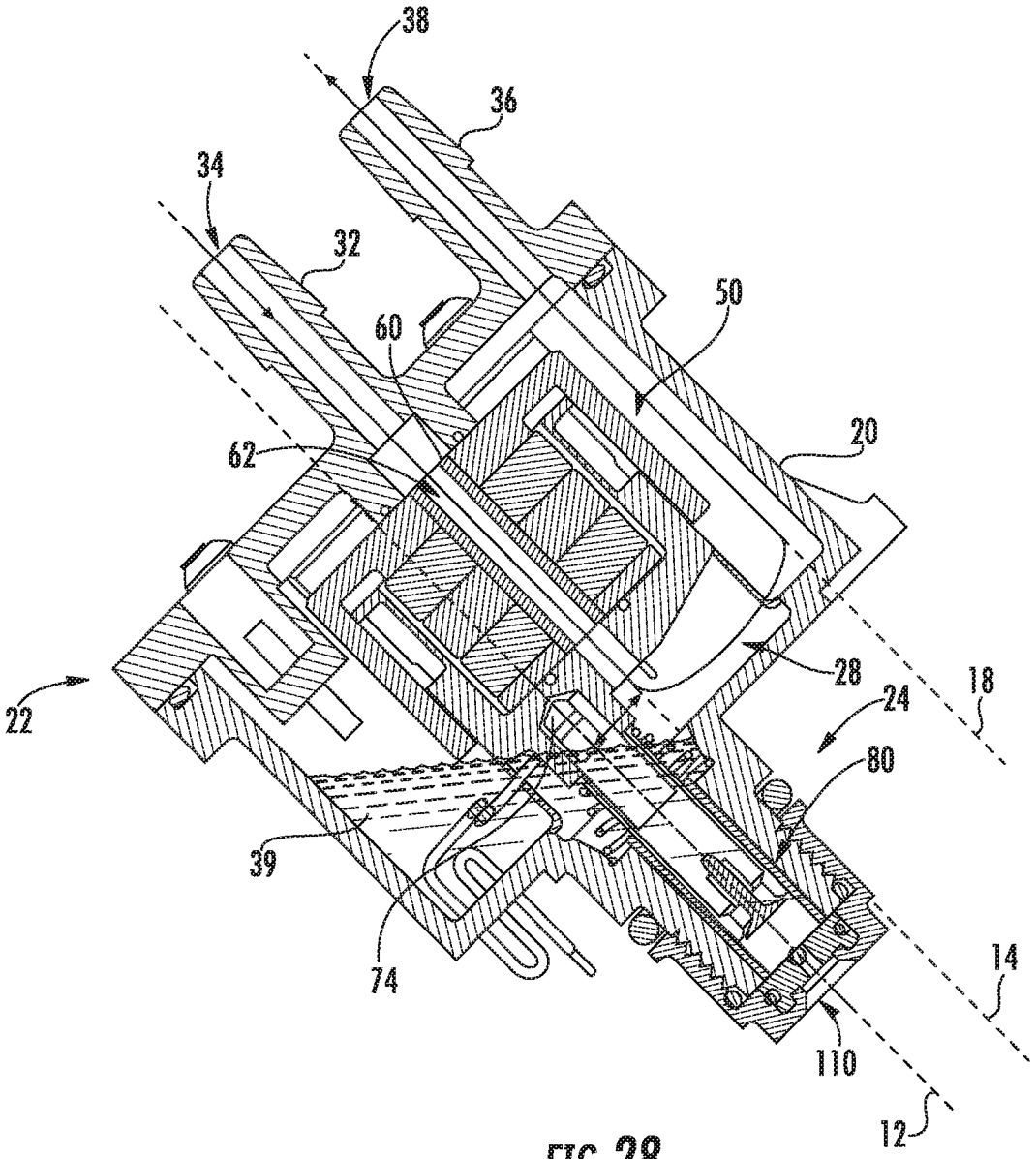

As shown in FIGS. 5-6, the piston 90 includes a first face, shown as interior face 92, and an opposing second face, shown as exterior face 94. The piston 90 is positioned to separate the pumping assembly 80 into a first chamber, shown as inlet chamber 86, and a second chamber, shown as outlet chamber 88. The inlet chamber 86 is defined between the interior face 92 of the piston 90, the wall 84 of the piston 90, and the interface between the piston wall 84 and the stem 70 of the bobbin 64. The outlet chamber 88 is defined between the exterior face 94 of the piston 90, the walls of the sleeve 82, exterior face of the valve body 108, and the outvalve assembly 110. According to the exemplary embodiment shown in FIG. 5, the inlet conduit 34, the fluid conduit 62, the fluid conduit 72, the inlet chamber 86, and the outlet chamber 88 are radially aligned along the central axis 12. In other embodiments, at least one of the inlet conduit 34, the fluid conduit 62, the fluid conduit 72, the inlet chamber 86, and the outlet chamber 88 is radially offset from the central axis 12 (as shown in FIGS. 26-28).

Referring back to FIGS. 5-6, the inlet chamber 86 is positioned to receive liquid fuel from the fluid conduit 72 of the stem 70. As shown in FIGS. 5-6, the invalve assembly 100 is positioned within the inlet chamber 86 of the piston cylinder 84 and extends through the piston 90. According to an exemplary embodiment, the invalve assembly 100 is configured to selectively control the flow of liquid fuel from the inlet chamber 86 to the outlet chamber 88. As shown in FIG. 6, the invalve assembly 100 includes a retainer 102, defining an aperture, shown as retainer aperture 104. The retainer aperture 104 is configured to receive a stem, shown as valve stem 106, having a body, shown as valve body 108, attached thereto. As shown in FIG. 6, the valve body 108 is configured to selectively engage an interface, shown as valve seat 96, defined by the exterior face 94 of the piston 90. Such engagement between the valve body 108 and the valve seat 96 may restrict the flow of the liquid fuel through an aperture of the valve seat 96 of the piston 90 from the inlet chamber 86 to the outlet chamber 88 (i.e., the valve body 108 seals the valve seat 96). The valve stem 106 and the valve body 108 may translate along the central axis 12 to allow liquid fuel to flow through the invalve assembly 100 and the piston 90. The invalve assembly 100 is biased into an open position by a spring 112 such that liquid fuel is free to flow into the outlet chamber 88 through the invalve assembly 100. The valve body 108 may engage the valve seat 96 to restrict fuel flow therethrough in response to an extension stroke of the piston 90 (e.g., caused by energizing the coil 66, due to the liquid fuel within the outlet chamber 88 forcing the valve body 108 against the valve seat 96, etc.)

Figure 8A:
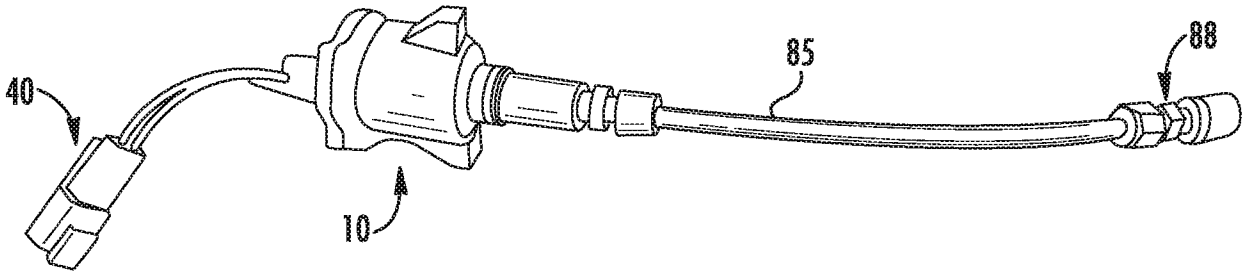
Figure 8B:
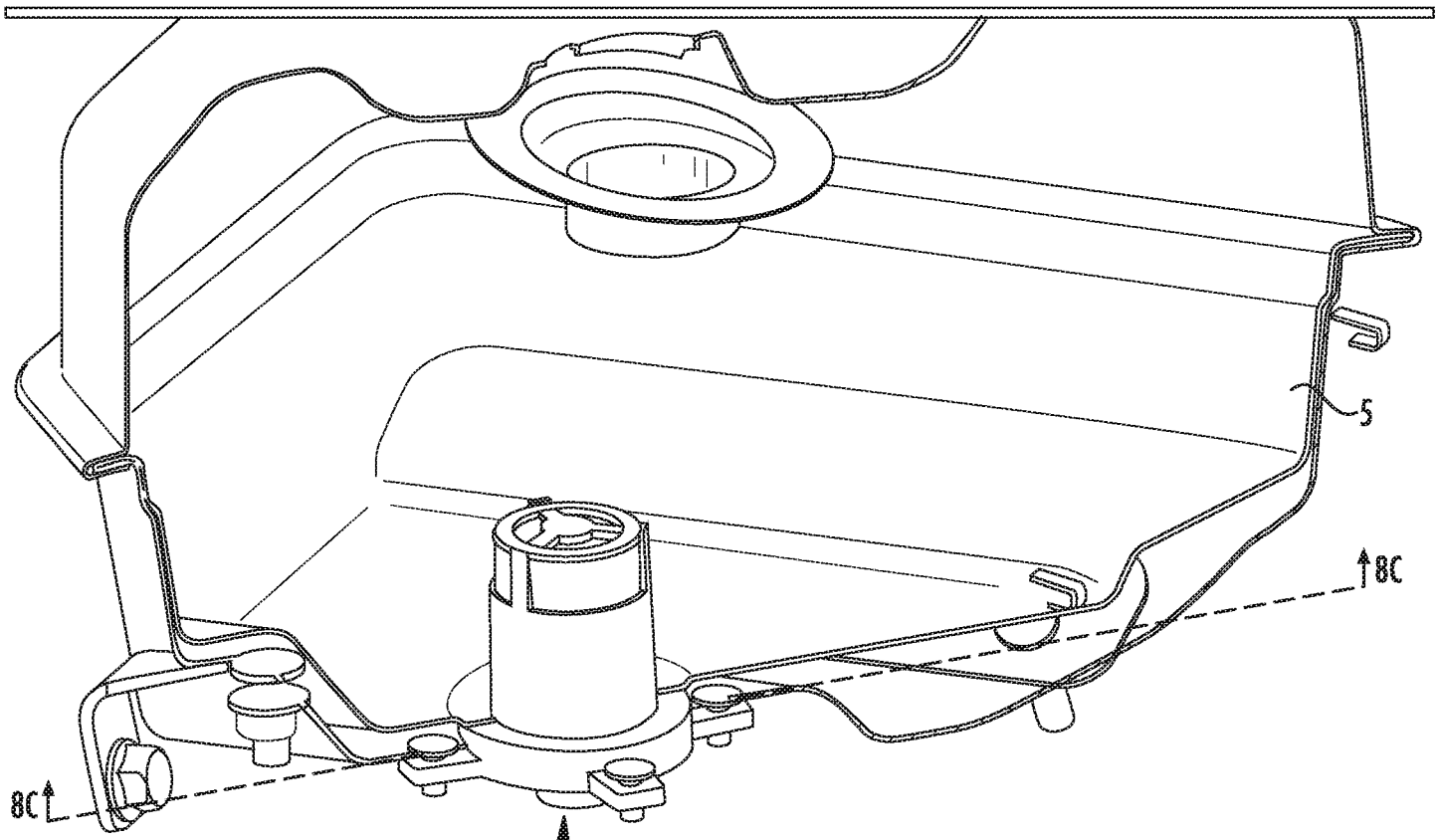
Figure 8C:
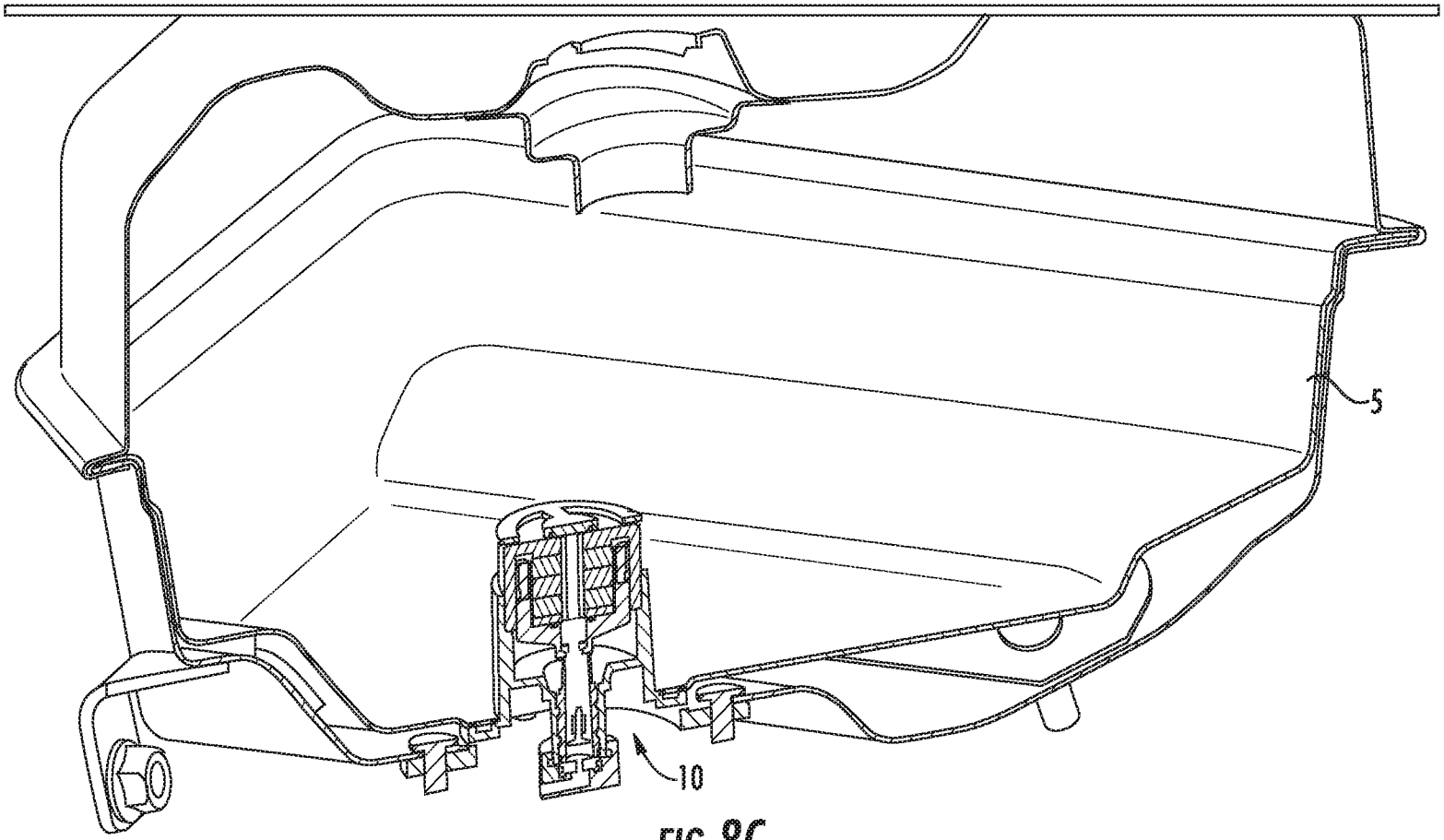
Figure 11:
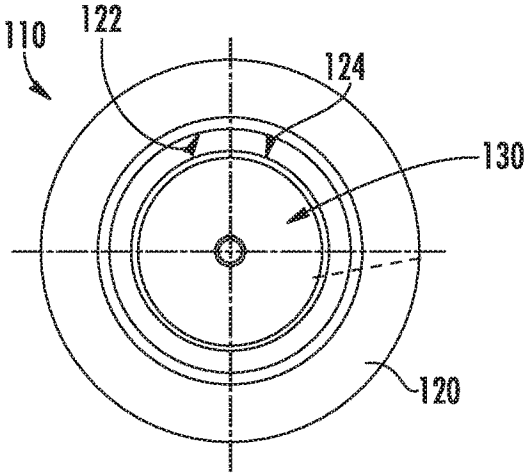
FIGS. 9-12 are various views of an outvalve assembly of the fuel delivery injector unit of FIGS. 1-8C, according to an exemplary embodiment.
Figure 13:
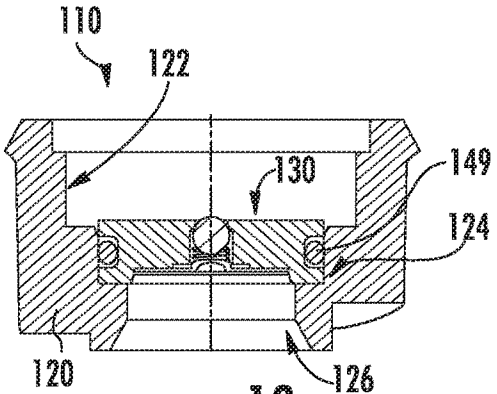
FIGS. 13-18 are various views of an outvalve module of the outvalve assembly of FIGS. 9-12, according to an exemplary embodiment.
Figure 12:
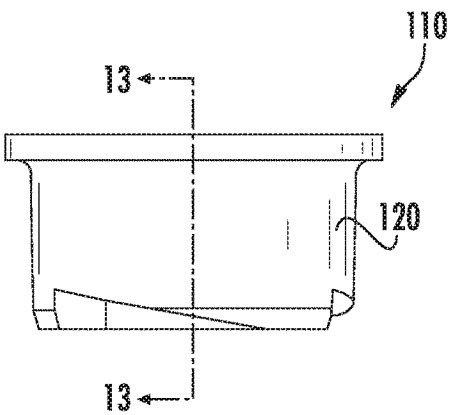
Figure 16:
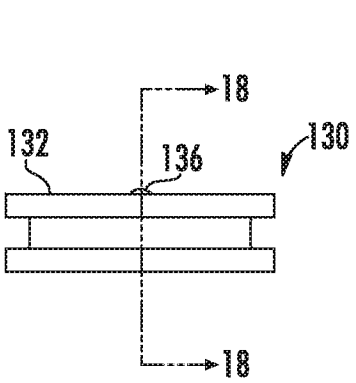
Figure 15:
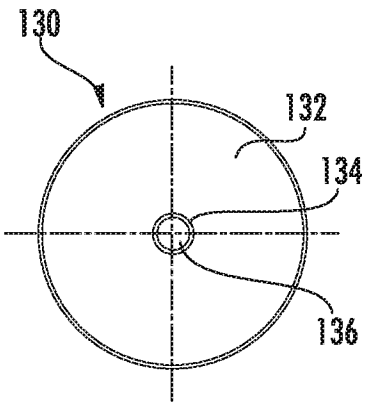
Figure 14:
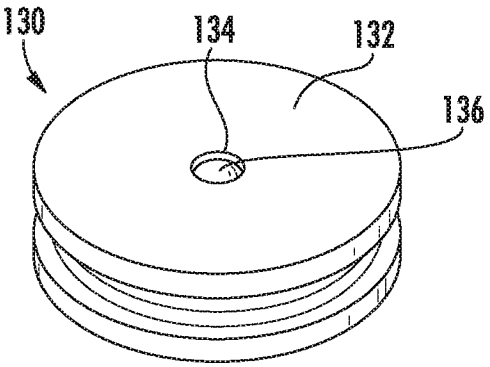

As shown in FIGS. 1 and 5-6, the outvalve assembly 110 is positioned to enclose the outlet chamber 88 of the pumping assembly 80. According to an exemplary embodiment, the outvalve assembly 110 is configured to selectively control the flow of liquid fuel out of the outlet chamber 88 of the pumping assembly 80 (e.g., to a throttle body, to a cylinder head, to a cylinder head intake runner/port, etc.). As shown in FIGS. 6, 9-11, and 13, the outvalve assembly 110 includes a housing, shown as outvalve retainer 120, and an outvalve module, shown as seat assembly 130. As shown in FIGS. 6, 9-10, and 13, the outvalve retainer 120 defines an interface, shown as coupling interface 122, a recess, shown as valve cavity 124, and an outlet, shown as fluid outlet 126. As shown in FIGS. 6, 9, 11, and 13, the valve cavity 124 of the outvalve retainer 120 is configured to receive the seat assembly 130. The seat assembly 130 is secured in place between the lower portion 24 of the housing 20 and the outvalve retainer 120 when the outvalve retainer 120 is secured to the lower portion 24 of the housing 20 (e.g., by spin weld, threads, adhesive, etc.). Alternatively, the seat assembly 130 may be adhesively secured, welded, spin welded, secured with an interference fit, and/or otherwise secured within the valve cavity 124 of the outvalve retainer 120. As shown in FIGS. 6 and 13, the outvalve assembly 110 includes a sealing member (e.g., an O-ring, a gasket, etc.), shown as seal 149, positioned between the seat assembly 130 and the valve cavity 124. As shown in FIG. 6, the coupling interface 122 is configured to engage with the lower portion 24 of the housing 20 such that the seat assembly 130 selectively seals the outlet chamber 88. According to an exemplary embodiment, the outvalve retainer 120 is spin welded onto the lower portion 24 of the housing 20. In other embodiments, the outvalve retainer 120 is otherwise coupled to the lower portion 24 of the housing 20 (e.g., threadedly engaged, adhesively secured, welded, etc.). As shown in FIGS. 1 and 5-6, the FDI unit 10 includes a sealing member (e.g., an O-ring, a gasket, etc.), shown as seal 150, to seal the FDI unit 10 to its operative location (e.g., an engine throttle body, cylinder head, intake runner, intake manifold, etc.). As shown in FIGS. 8A-8C, in other embodiments, the outvalve retainer 120 and/or the seat assembly 130 of the outvalve assembly 110 are remotely positioned from the FDI unit 10 (e.g., coupled to a throttle body, a cylinder head, and/or a cylinder intake runner/port, etc.) and fluidly coupled (e.g., hard plumbed, etc.) to the outlet chamber 88 via a fluid conduit 85.

Figure 18:
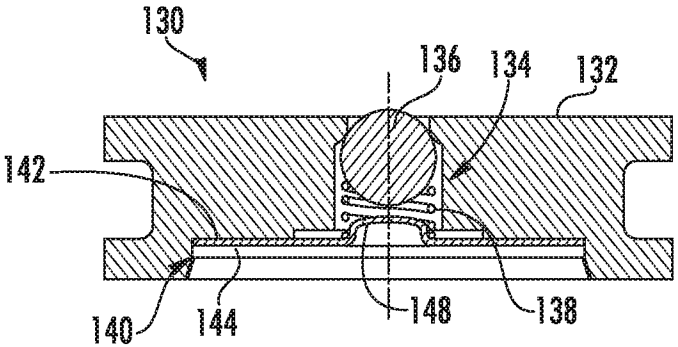

Referring back to FIGS. 6 and 14-18, the seat assembly 130 includes a first surface, shown as interior surface 132, and an opposing second surface, shown as exterior surface 142. As shown in FIG. 6, the interior surface 132 is positioned to face into the outlet chamber 88 of the pumping assembly 80, and the exterior surface 142 is positioned to face outward from the FDI unit 10. As shown in FIG. 6, the seat assembly 130 is arranged such that the interior surface 132 is perpendicular to the motion of the piston 90. In other embodiments, the seat assembly 130 is arranged such that the interior surface 132 is oriented at another angle relative to the motion of the piston 90 (e.g., parallel, thirty degrees, sixty degrees, forty-five degrees, etc.). As shown in FIGS. 6,14-16, and 18, the seat assembly 130 defines an aperture, shown as through-hole 134. As shown in FIGS. 6 and 18, the seat assembly 130 includes a valve body, shown as check ball 136, and a resilient member, shown as spring 138, positioned within the through-hole 134. According to an exemplary embodiment, the spring 138 is configured to bias the check ball 136 against an inlet of the through-hole 134 to prevent liquid fuel from flowing therethrough. In the illustrated embodiments, the spring 138 is a coil compression spring. In other embodiments, the resilient member may be one or more cantilever springs, a spiral coil spring, or other resilient member able to bias the valve body as described above. As shown in FIGS. 6 and 18, the check ball 136 is configured to at least partially protrude through the inlet of the through-hole 134 such that the check ball 136 at least partially extends past the interior surface 132 of the seat assembly 130 into the outlet chamber 88. Thus, as the piston 90 displaces fuel in the outlet chamber 88, the piston 90 may engage (e.g., strike, hit, etc.) the check ball 136, thereby freeing check ball 136 from the inlet of the through-hole 134 (e.g., preventing fuel gumming around the check ball 136 and the inlet of the through-hole 134, etc.)

Figure 10:
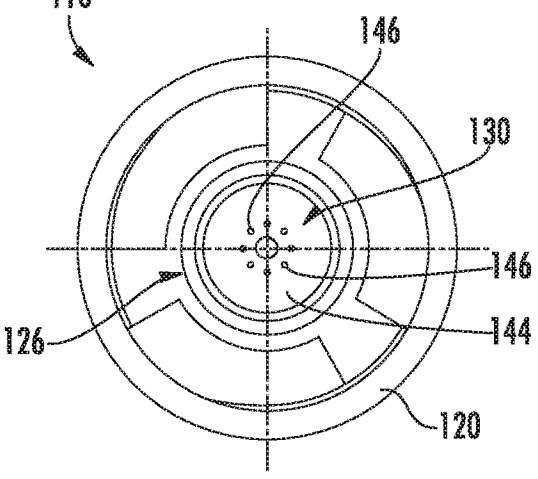
Figure 9:
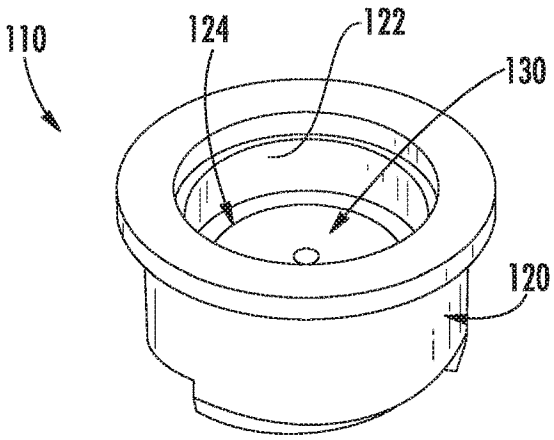
Figure 17:
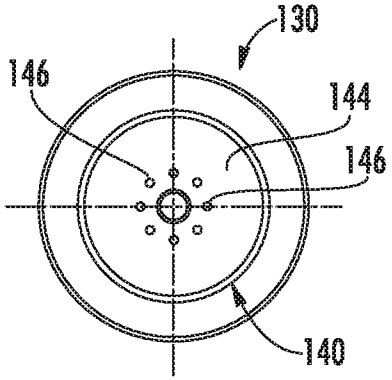

As shown in FIGS. 6 and 17-18, the seat assembly 130 defines a recess, shown as recess 140. The recess 140 is configured to receive a plate, shown as orifice plate 144. As shown in FIG. 18, in some embodiments, the orifice plate 144 may include an alignment member, shown as central dimple 148, positioned to center the spring 138 and the check ball 136 within the through-hole 134. In other embodiments, the orifice plate 144 does not include an alignment member. As shown in FIGS. 10 and 17, the orifice plate 144 includes a plurality of apertures, shown as orifices 146. According to an exemplary embodiment, the orifices 146 are configured to atomize liquid fuel as it flows through the orifices 146. According to an exemplary embodiment, the seat assembly 130 is laser welded to create a single sub-assembly of the outvalve assembly 110. Accordingly, the orifice plate 144 is welded to the seat assembly 130. Alternatively, as shown in FIG. 6, the orifice plate 144 may be retained in the recess 140 between overlapping portions of the outvalve retainer 120 and the seat assembly 130. In other embodiments, the orifice plate is fixed to the seat assembly 130 (e.g., interference fit, adhesive, etc.).

According to an exemplary embodiment, the outvalve assembly 110 and/or the seat assembly 130 are individual components of the FDI unit 10 that may be tested before being coupled to the housing 20. Traditionally, outvalves of FDI units are disposed within and integral with the housing, and therefore can only be tested once the FDI unit is completely assembled. If the outvalve is faulty, the entire FDI unit must be discarded. The outvalve assembly 110 of the FDI unit 10 of the present disclosure is capable of being tested (e.g., for sealing/leaking, for fluid delivery/static flow, pop-off pressure, etc.) independent of the FDI unit 10, and therefore reduces the amount of material discarded and manufacturing costs.

The FDI unit 10 can be customized to provide specific operational characteristics by adjusting certain configurations of the outvalve assembly 110. For example, the output fluid flow characteristics (e.g., the fuel provided for combustion by the engine) can be varied by changing the size and/or number of apertures 146 in the orifice plate 144, the spring rate or constant of the spring 138, the size of the through-hole 134 and the check ball 136, and/or the height (e.g., top to bottom as shown in FIG. 6) of the outvalve assembly. This allows the manufacturer to construct different FDI units having specific operational characteristics tailored to end use by using different outvalve assemblies 110 with the same "body" of the FDI unit 10 (the components other than the outvalve assembly 110).

In operation, the FDI unit 10 receives liquid fuel through the inlet conduit 34, which may then flow through the fluid conduit 62 of the pin 60, into the fluid conduit 72 of the stem 70 of the bobbin 64, and into at least one of (i) the cavity 28 through the holes 74, (ii) into the inlet chamber 86 of the pumping assembly 80, and (iii) into the outlet chamber 88 of the pumping assembly 80 through the invalve assembly 100 (e.g., until the FDI unit 10 is full or saturated with liquid fuel, etc.). An injection event of the FDI unit 10 may operate as follows. At the start of an injection event, the bobbin 64 may be biased by the return spring 76 to a first position against the bottom plate 54. The coil 66 receives an electrical current, which interacts with the magnetic field of the top plate 52, the bottom plate 54, and/or the intermediate plates 56 in the recess 58. Such interaction may cause a downward force on the coil 66, to thereby drive the bobbin 64 to a second position, driving a stroke of the piston 90 within the sleeve 82 (e.g., a down-stroke, etc.). After a first portion of the stroke of the piston 90, the pressure within the outlet chamber 88 exceeds a first target pressure which thereby causes the invalve assembly 100 to close.

After the first portion of the stroke of the piston 90, a second portion of the stroke begins. During the second portion of the stroke of the piston 90, the pressure within the outlet chamber 88 increases rapidly, causing the differential pressure across the check ball 136 to overcome the biasing force of the spring 138 to allow the liquid fuel within the outlet chamber 88 to flow through the through-hole 134 of the seat assembly 130 (e.g., the pressure within the outlet chamber 88 exceeds a second target pressure that causes the spring 138 to compress, etc.). The liquid fuel is then atomized by the orifices 146 of the orifice plate 144 and injected (e.g., sprayed, etc.) into a desired location (e.g., a cylinder head, a throttle body, a cylinder head runner/port, etc.). At the end of the injection event, the coil 66 stops receiving the electrical current that allows the piston spring 76 to return the bobbin 64 back to the first position, thereby retracting the piston 90 within the sleeve 82 (e.g., an up-stroke, etc.) causing the invalve assembly 100 to reopen and the seat assembly 130 to close. During this return stroke of the piston 90, the chamber 88 refills with fuel. The duration of the injection relates to the stroke length of the pumping assembly 80 (e.g., the distance traveled by the piston 90 during the injection event). A longer stroke length provides a larger volume of fuel within the chamber 88 that is expelled during the injection event and a shorter stroke length provides a smaller volume of fuel within the chamber 88 that is expelled during the injection event. The volume of fuel expelled during the injection event of a particular FDI unit 10 can therefore be modified by changing the spring rate or constant of the outvalve spring 138, which controls the first or home position of the pumping assembly 80. The fuel delivery characteristics can also be changed by changing the number and size of the orifice holes 51.

Figure 19:
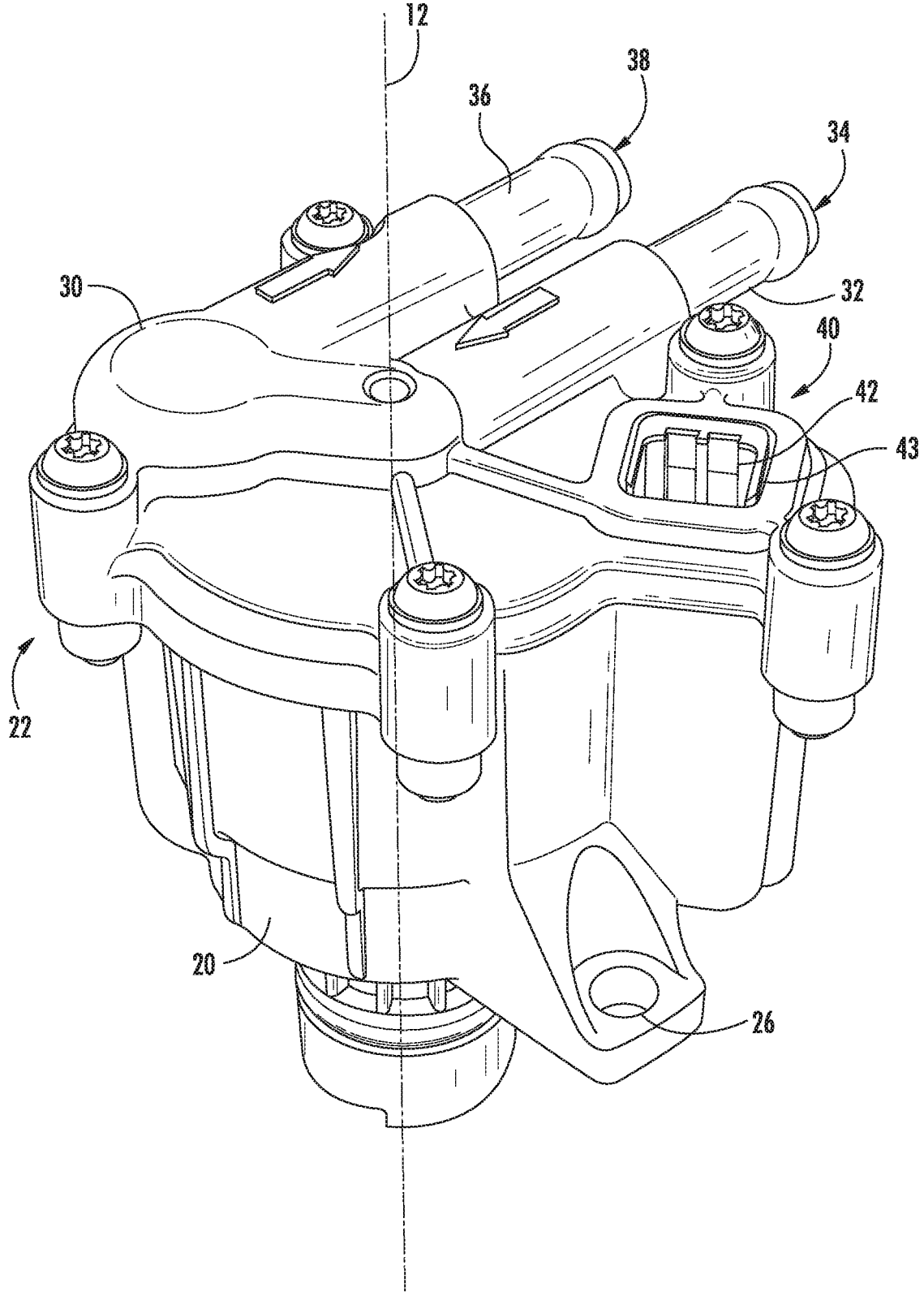
FIGS. 19-21 are various views of a fuel delivery injector unit, according to another exemplary embodiment.
Figure 20:
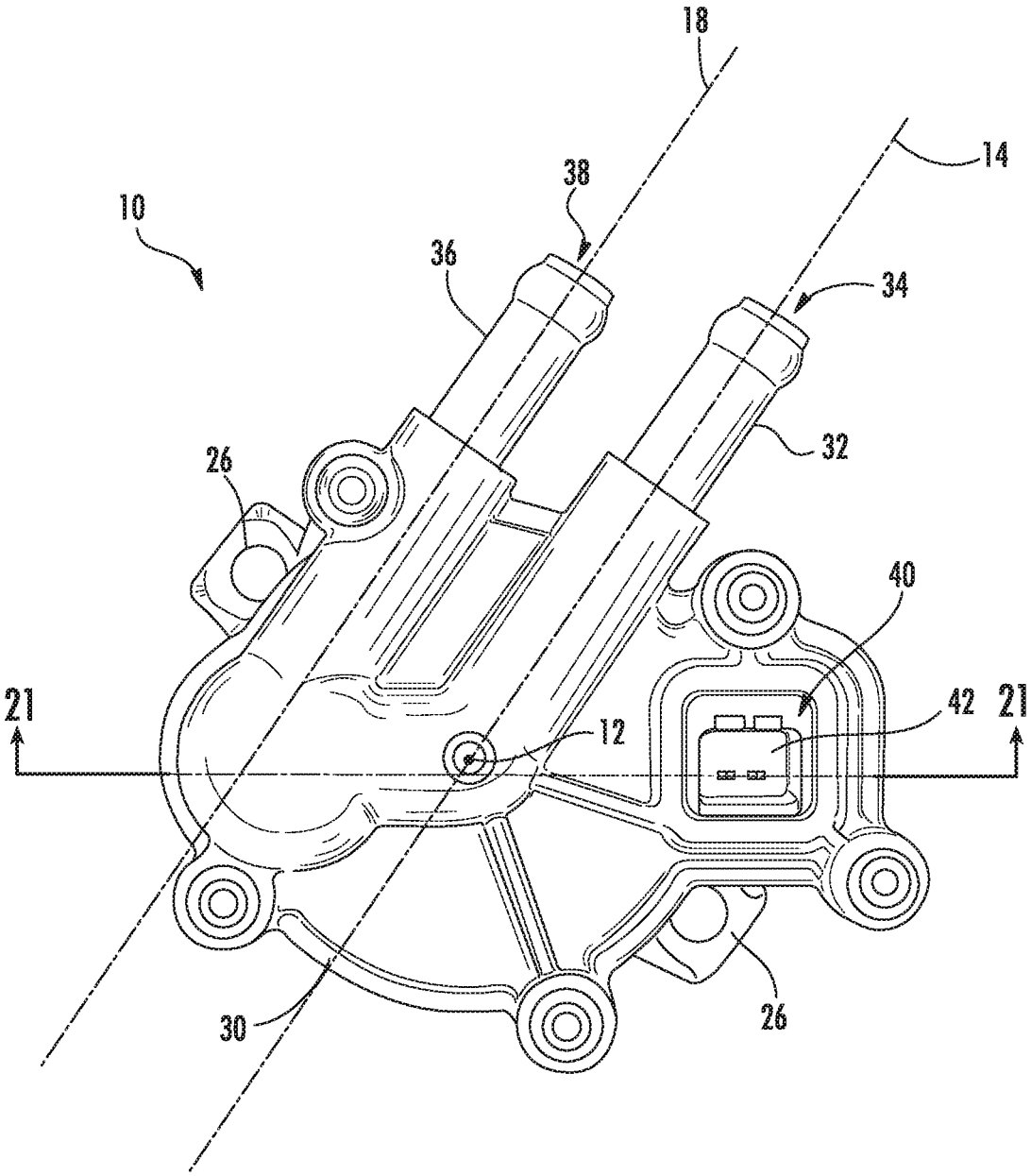
Figure 21:
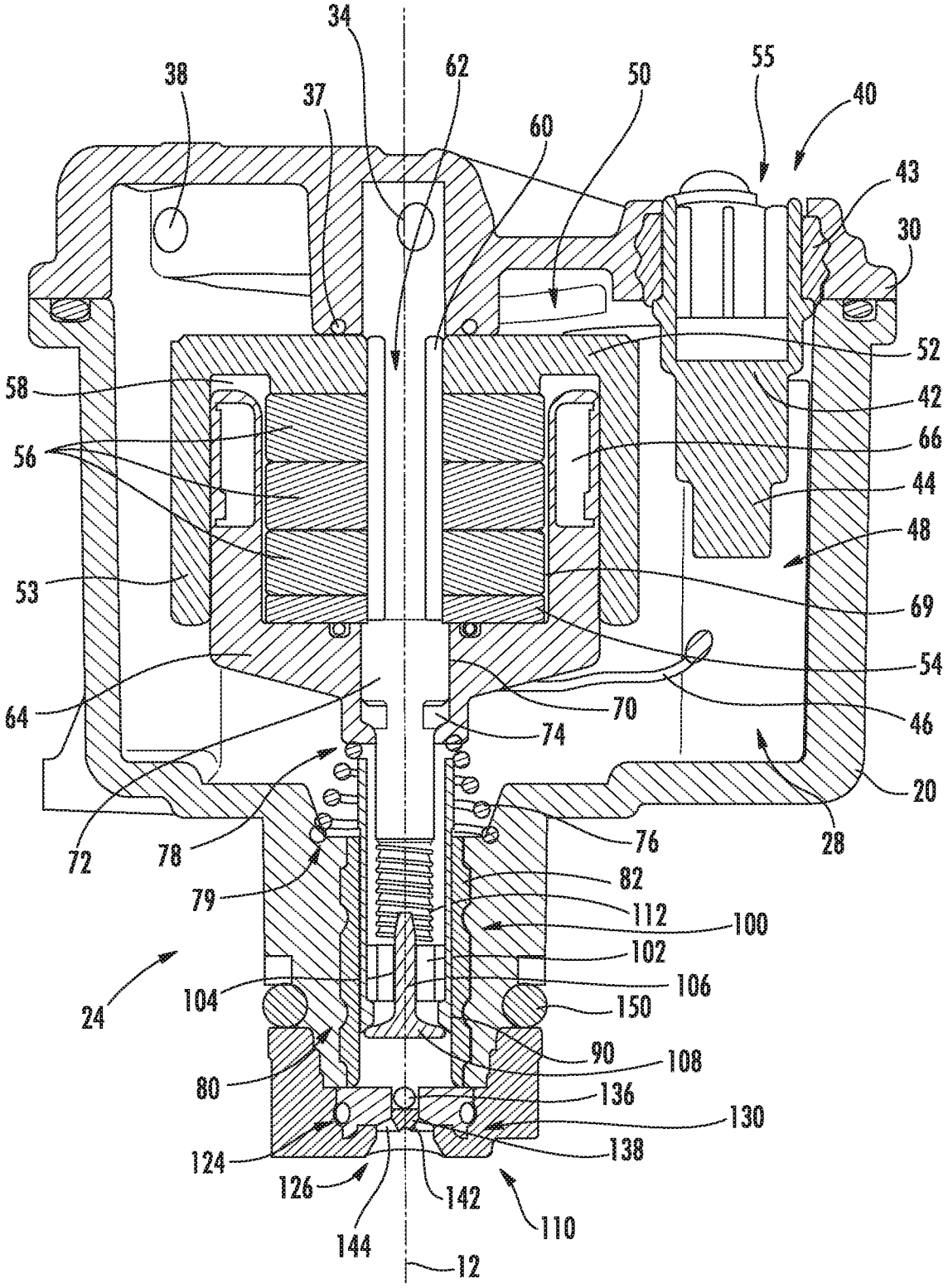

According to another embodiment shown in FIGS. 19-21, the FDI unit 10 includes an alternative end cap 30. The end cap 30 is coupled to the upper portion 22 of the housing 20. In an exemplary embodiment, the end cap 30 is ultrasonically welded to the housing 20. In other embodiments, the end cap 30 is otherwise coupled to the housing 20 (e.g., with fasteners, with a threaded engagement, adhesively secured, laser welded, heat staked, etc.). A ring member (e.g., an O-ring, a gasket, etc.), shown as ring 37, is included between the end cap 30 and the top plate 52 of the magnetic assembly 50 (FIG. 21). As shown in FIGS. 19-21, the end cap 30 include a first port, shown as inlet port 32, defining a first conduit, shown as inlet conduit 34. According to an exemplary embodiment, the inlet conduit 34 is configured to receive and direct a liquid fuel (e.g., liquid gasoline, from a fuel tank, from a fuel pump, etc.) into the cavity 28 of the housing 20. As shown in FIGS. 19-21, the end cap 30 includes a second port, shown as outlet port 36, defining a second conduit, shown as outlet conduit 38. According to an exemplary embodiment, the outlet conduit 38 is configured to receive and direct a vapor (e.g., fuel vapor, air, a fuel-air mixture, etc.) out of the cavity 28 of the housing 20 (e.g., to a fuel tank, to additional injectors, etc.).

As shown in FIG. 20, the inlet conduit 34 extends along inlet conduit axis 14 and the outlet conduit 38 extends along outlet conduit axis 18. The inlet conduit axis 14 and outlet conduit axis 18 extend laterally outward from the housing 20 at substantially perpendicular angles from the central axis 12. In some embodiments, the inlet conduit axis 14 and the outlet conduit axis 18 are substantially parallel to each other. In other embodiments, the inlet conduit axis 14 and the outlet conduit axis 18 are otherwise relatively angled. As shown, the inlet conduit 34 and outlet conduit 38 extend toward the same side of the housing 20 as each other. When referred to herein, the term "substantially" includes +/−5 degrees from the stated angle. In other embodiments, the term "substantially" includes +/−10 degrees from the stated angle.

Figure 22:
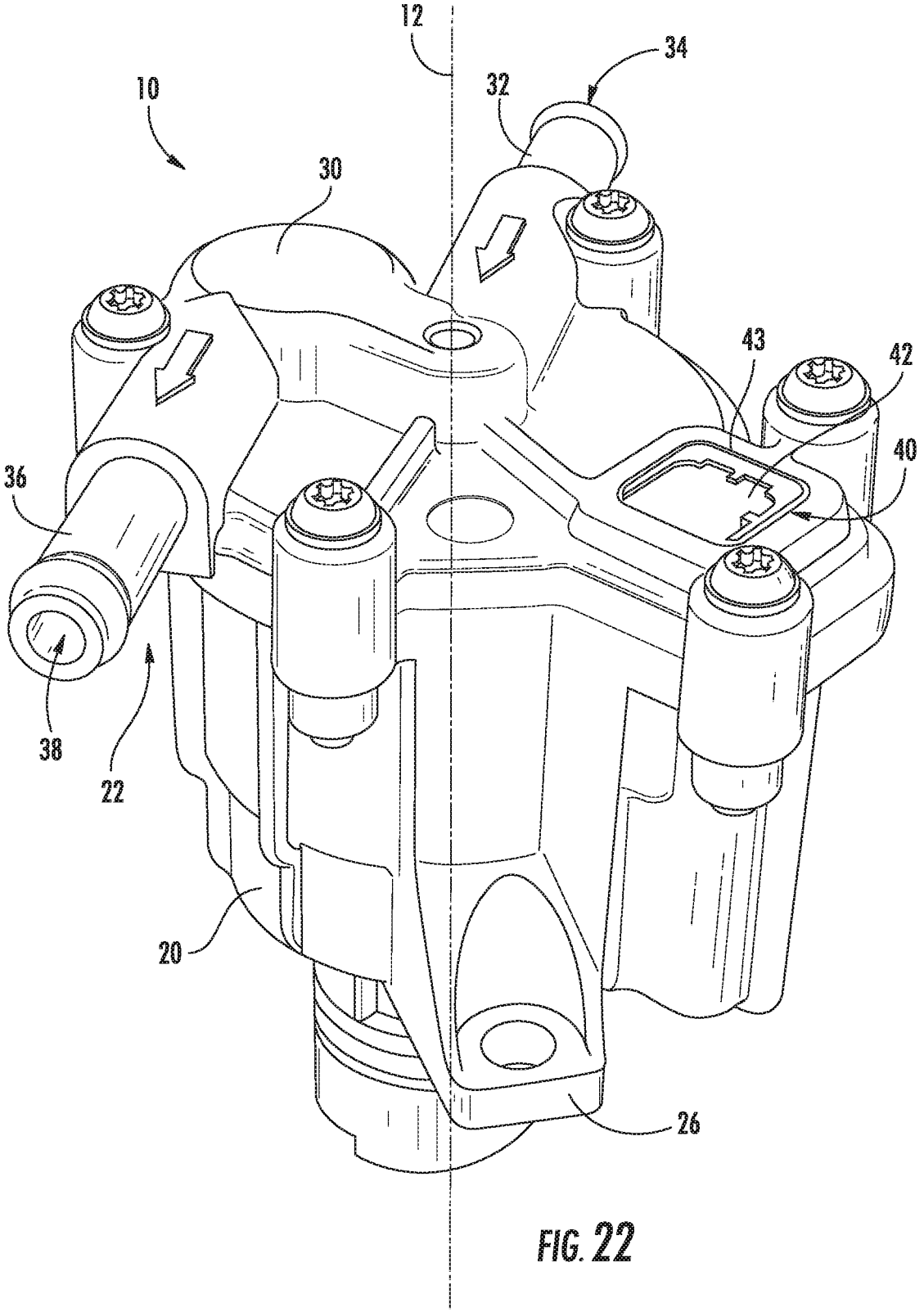
FIGS. 22-24 are various views of a fuel delivery injector unit, according to still another exemplary embodiment.
Figure 23:
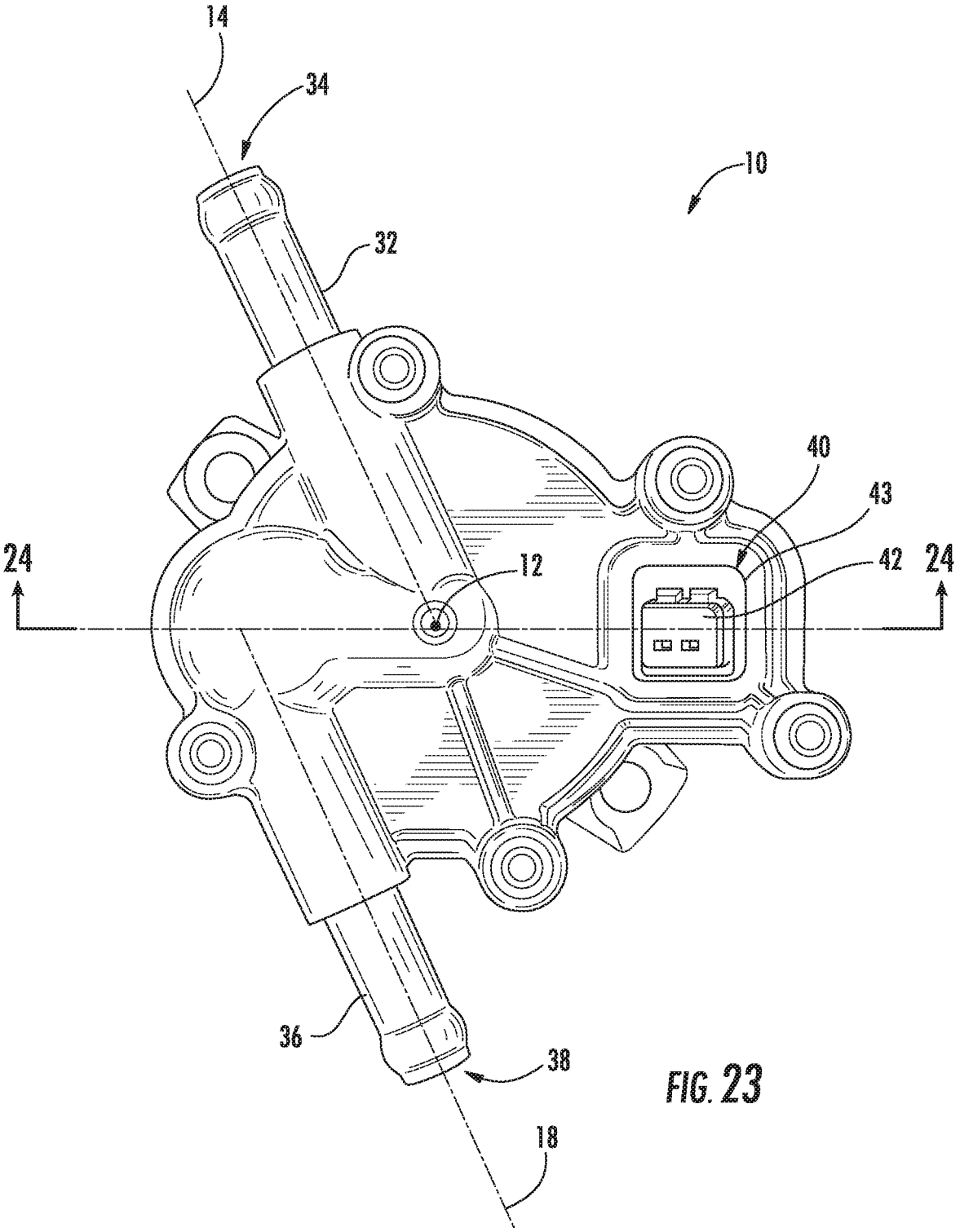
Figure 24:
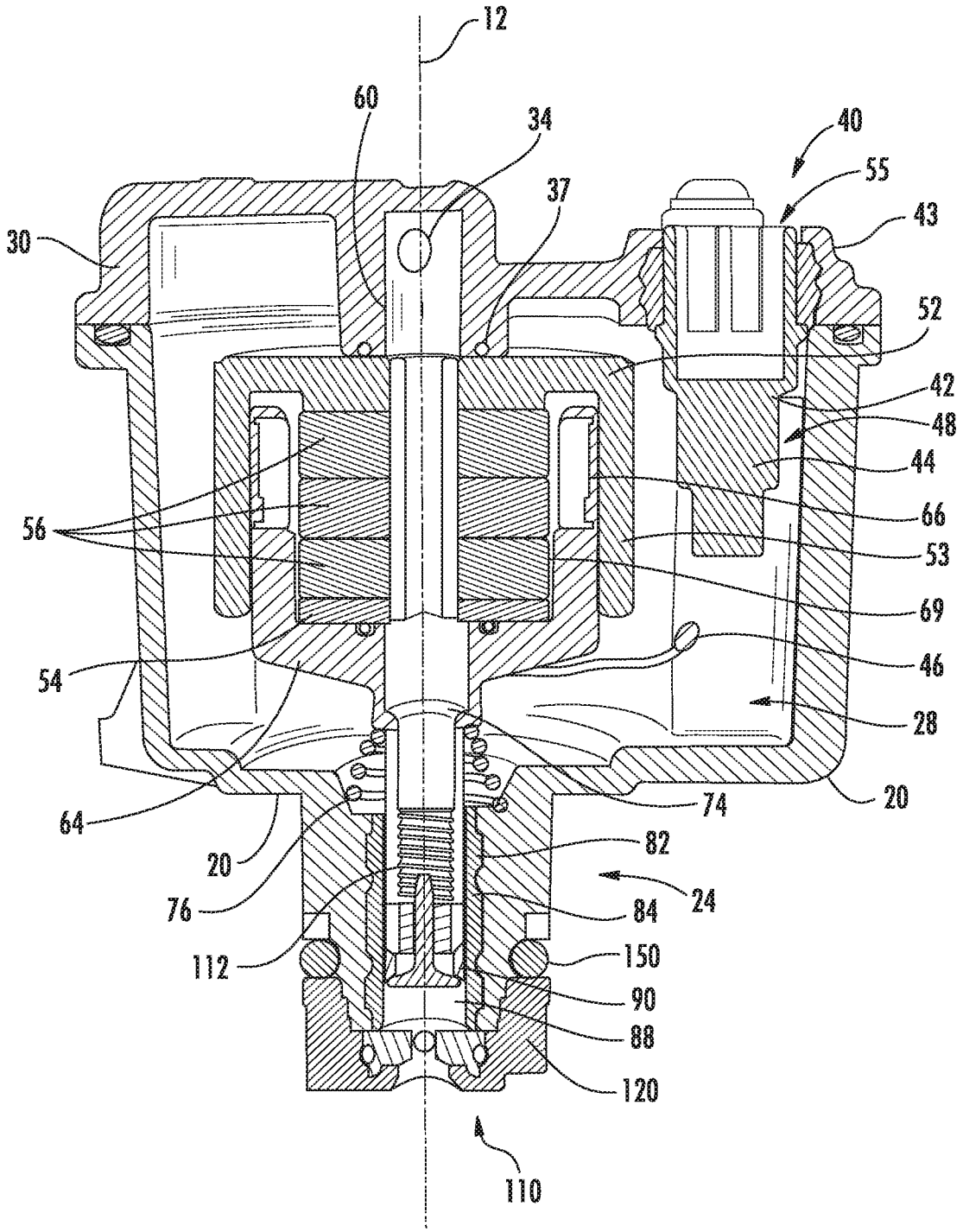

According to another embodiment shown in FIGS. 22-24, the FDI unit 10 includes another alternative end cap 30. The end cap 30 is coupled to the upper portion 22 of the housing 20. In an exemplary embodiment, the end cap 30 is ultrasonically welded to the housing 20. In other embodiments, the end cap 30 is otherwise coupled to the housing 20 (e.g., with fasteners, with a threaded engagement, adhesively secured, laser welded, heat staked, etc.). A ring member (e.g., an O-ring, a gasket, etc.), shown as ring 37, is included between the end cap 30 and the top plate 52 of the magnetic assembly 50 (FIG. 24). As shown in FIGS. 22-24, the end cap 30 include a first port, shown as inlet port 32, defining a first conduit, shown as inlet conduit 34. According to an exemplary embodiment, the inlet conduit 34 is configured to receive and direct a liquid fuel (e.g., liquid gasoline, from a fuel tank, from a fuel pump, etc.) into the cavity 28 of the housing 20. As shown in FIGS. 22-24, the end cap 30 includes a second port, shown as outlet port 36, defining a second conduit, shown as outlet conduit 38. According to an exemplary embodiment, the outlet conduit 38 is configured to receive and direct a vapor (e.g., fuel vapor, air, a fuel-air mixture, etc.) out of the cavity 28 of the housing 20 (e.g., to a fuel tank, to additional injectors, etc.).

As shown in FIG. 23, the inlet conduit 34 extends along inlet conduit axis 14 and the outlet conduit 38 extends along outlet conduit axis 18. The inlet conduit axis 14 and outlet conduit axis 18 extend laterally outward from the housing 20 at substantially perpendicular angles from the central axis 12. The inlet conduit axis 14 and the outlet conduit axis 18 are substantially parallel to each other. In other embodiments, the inlet conduit axis 14 and the outlet conduit axis 18 are otherwise relatively angled. As shown, the inlet conduit 34 and outlet conduit 38 extend toward different (e.g., opposite) sides of the housing 20 as each other.

Referring to FIGS. 19-24, a recess 55 is formed in the end cap 30. The recess 55 is configured to receive an electrical connector 42. The electric connector 42 is separate from the end cap 30. In some embodiments, the electrical connector 42 is coupled (e.g., via electrical wires 46) as a subassembly to the coil 66 of the bobbin 64. When the end cap 30 is attached (via any method described herein), the electrical connector 42 is fitted within the recess 55. This configuration allows use of the electrical connector 42 without assembling the electrical connector 42 to the bobbin 64 during a final assembly of the FDI unit 10. In this way, no attachment (e.g., crimping, soldering) of electrical wires between the connector 42 and bobbin 64 is necessary during final assembly of the FDI unit 10.

Figure 25:
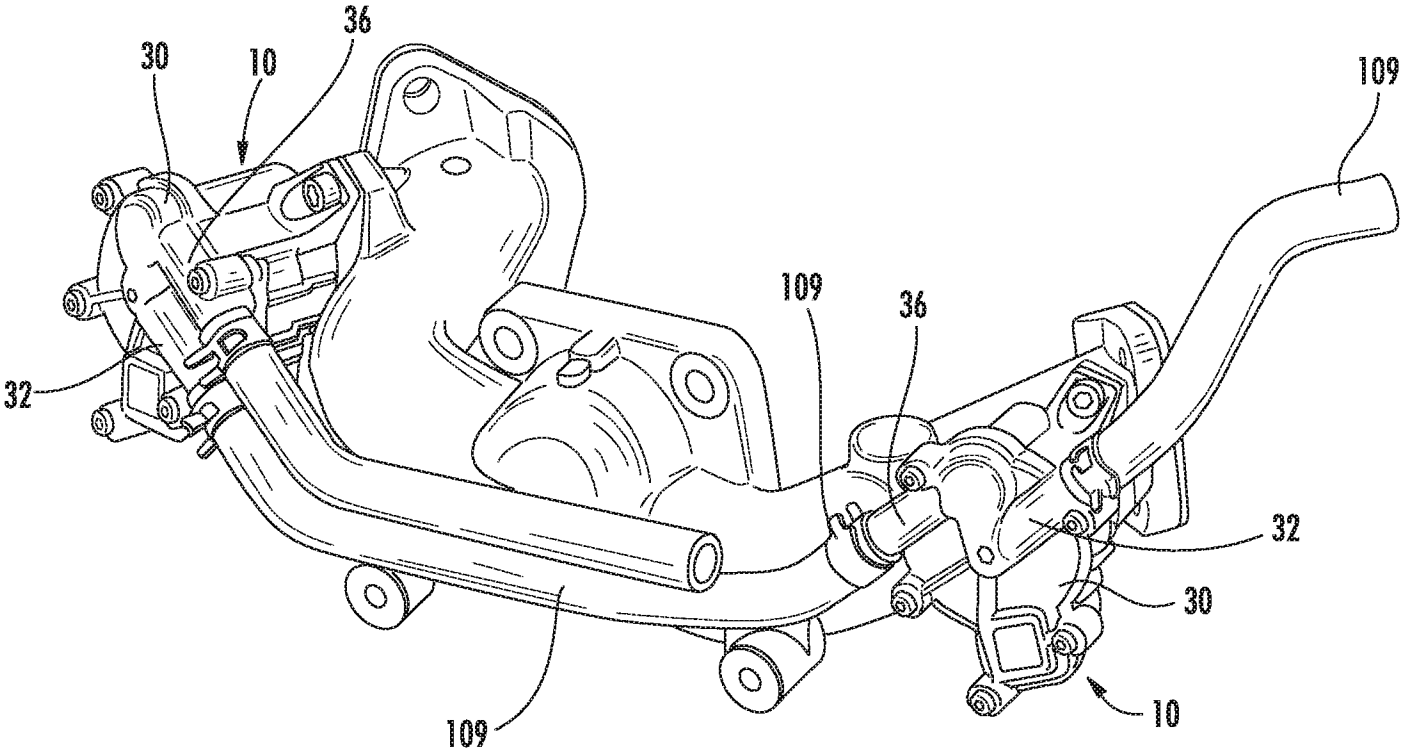
FIG. 25 is a perspective view of the fuel delivery injector units of FIGS. 19-24 in use with a manifold of an engine, according to still another exemplary embodiment.

The end cap embodiments shown in FIGS. 19-24 allow the FDI unit 10 (including any hoses and hose fittings) to fit within pre-sized packaging on various engines. For example, in FIG. 25, the end cap embodiments described in FIGS. 19-24 are shown in use on an engine manifold 105 with attached hose fittings 107 and hoses 109. The inlet and outlet ports 32, 36 extend substantially along the same direction as the hoses 109 necessarily extend and thus, the hoses 109 do not need to be bent (e.g., formed, shaped) to comply with the shape or size of the manifold assembly. In this configuration, the FDI unit 10 can fit within a standard engine package (e.g., in applications with carburetors, tight-fitting to equipment hoods, engine compartment walls, etc.) without any or with little adjustment to the hoses, hose fittings, or other components of the engine.

According to another embodiment shown in FIGS. 26-28, a fuel delivery injector unit, shown as FDI unit 10, includes a body, shown as housing 20; a cap, shown as end cap 30; a magnetic actuation assembly, shown as magnetic assembly 50; a pumping assembly, shown as pumping assembly 80; a first valve assembly, shown as invalve assembly 100; and a second valve assembly, shown as outvalve assembly 110. As shown in FIG. 27, the housing 20 defines a central, longitudinal axis, shown as central axis 12. The housing 20 has a first end, shown as upper portion 22, and an opposing second end (e.g., neck, etc.), shown as lower portion 24. The end cap 30 is coupled to the upper portion 22 of the housing 20. A ring member (e.g., an O-ring, a gasket, etc.), shown as ring 37, is included between the end cap 30 and the top plate 52 of the magnetic assembly 50 (FIG. 27). As shown in FIG. 27, the outvalve assembly 110 is coupled to the lower portion 24 of the housing 20. The housing 20 includes a coupling interface, shown as bosses or mounting locations 26. According to an exemplary embodiment, the mounting locations 26 are configured to facilitate coupling (e.g., attaching, securing, etc.) the FDI unit 10 to a component of a fuel delivery system (e.g., within and/or to a fuel tank, to a throttle body, to a cylinder head, to a cylinder head intake runner/port, etc.) by providing a location for a fastener or other attachments to couple the FDI unit 10 to another component. The housing 20 defines an internal cavity, shown as cavity 28. The cavity 28 is configured (e.g., sized, structured, etc.) to receive and/or support the magnetic assembly 50 (e.g., with the upper portion 22 thereof, etc.), the pumping assembly 80 (e.g., with the lower portion 24 thereof, etc.), and a volume of fuel 39 (shown in FIG. 28).

The end cap 30 include a first port, shown as inlet port 32, defining a first conduit, shown as inlet conduit 34. According to an exemplary embodiment, the inlet conduit 34 is configured to receive and direct a liquid fuel (e.g., liquid gasoline, from a fuel tank, from a fuel pump, etc.) into the cavity 28 of the housing 20. The end cap 30 includes a second port, shown as outlet port 36, defining a second conduit, shown as outlet conduit 38. According to an exemplary embodiment, the outlet conduit 38 is configured to receive and direct a vapor (e.g., fuel vapor, air, a fuel-air mixture, etc.) out of the cavity 28 of the housing 20 (e.g., to a fuel tank, to additional injectors, etc.). The inlet conduit 34 extends along an inlet conduit axis 14 and the outlet conduit 38 extends along an outlet conduit axis 18. As shown in FIG. 27, in this embodiment, the magnetic assembly 50 and conduit 62 are positioned offset from the central axis 12. Further, the inlet conduit axis 14 is also offset from the central axis 12 of the housing by a distance 15, as will be described further herein. In some embodiments, the FDI unit 10 includes one or more filter elements positioned within the inlet conduit 34 and/or the outlet conduit 38.

As shown in FIG. 27, the FDI unit 10 further includes a reciprocating member, shown as bobbin 64, configured to interface with the magnetic assembly 50. According to an exemplary embodiment, the bobbin 64 is configured to translate (i.e., oscillate) linearly along the inlet conduit axis 14, relative to the top plate 52, the bottom plate 54, and the intermediate plates 56. As shown in FIG. 27, the top plate 52 includes an overhang, shown as cup 53, that extends down and around a periphery of the intermediate plates 56, forming an annular gap therebetween, shown as recess 58. The recess 58 forms an annular gap for receiving the bobbin 64. The bobbin 64 has a peripheral wall, shown as wall 68, that extends around the periphery of the bobbin 64. The wall 68 defines a cup shape having a cavity, shown as cavity 69. The wall 68 of the bobbin 64 extends within the recess 58, and the cavity 69 receives the bottom plate 54 and the intermediate plates 56 such that the top plate 52 interfaces with the bobbin 64 allowing axial movement of the bobbin 64 along the central axis 12. As shown in FIG. 7, the top plate 52 includes a number of vent apertures or holes 51. The holes 51 are located adjacent to the recess 58 to allow vapor or air to pass through the top plate 52 to and from the recess.

As shown in FIG. 27, the bobbin 64 includes a lower portion, shown as stem 70, that extends from the bobbin 64. The stem 70 defines a fourth conduit, shown as fluid conduit 72. The fluid conduit 72 of the stem 70 is not aligned with the fluid conduit 62 of the pin 60, which is offset from central axis 12. Fluid exiting the fluid conduit 62 of the pin 60 may flow into the cavity 28 and then into the fluid conduit 72 of the stem 70 through the holes 74 and down to the pumping assembly 80.

Referring to FIG. 28, the FDI unit 10 of FIGS. 26 and 27 is shown in an example angled mounting configuration. During operation, vapor may come from a fuel supply and/or may be generated inside the FDI unit 10 during movement of the bobbin 64 (e.g., due to a reduction in pressure and/or increase in temperature, etc.). During normal ongoing operation of the FDI unit 10, vapor exits the FDI unit 10 directly through the cavity 28 and through the outlet conduit 38. Accordingly, in this configuration, during hot start conditions, the amount of vapor coming into contact with the liquid fuel 39 is reduced, thus reducing the amount of potential liquid fuel flowing to the outlet conduit 38 instead of to the pumping assembly 80. In this configuration, the vapor easily exits via the outlet conduit 38 without causing bubbling of the liquid fuel 39 in the housing 20.

Figure 29:
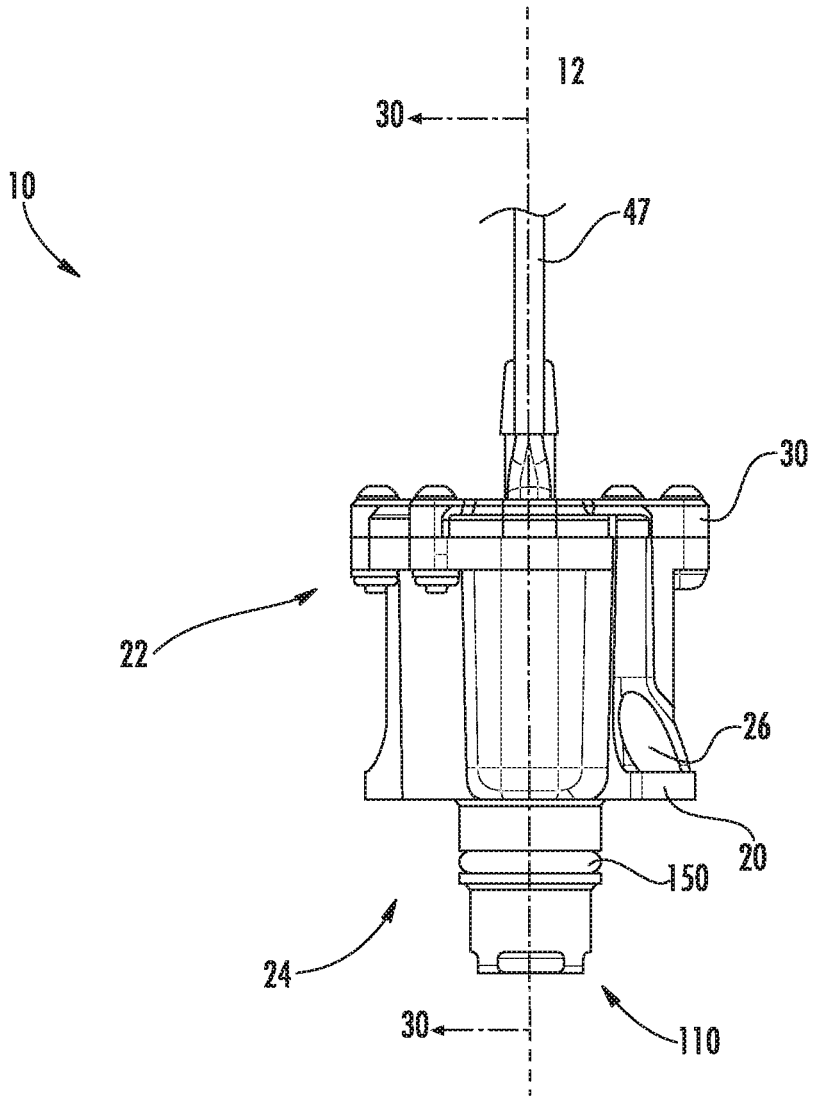
FIGS. 29-30 are various views of a fuel delivery injector unit, according to still another exemplary embodiment.
Figure 30:
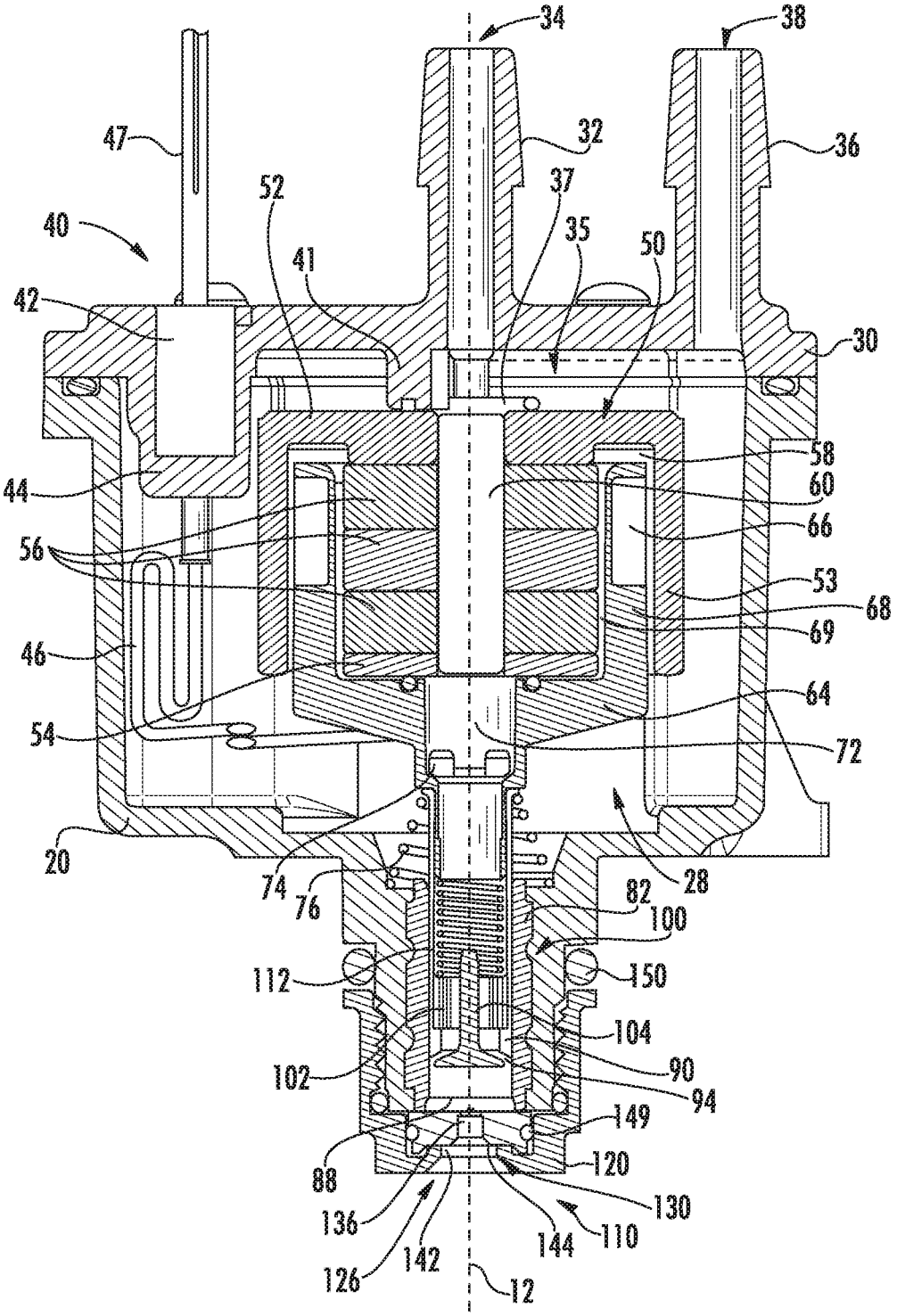

Referring now to FIGS. 29-30, an alternative embodiment of the FDI unit 10 is shown. The FDI unit 10 includes a body, shown as housing 20; a cap, shown as end cap 30; a magnetic actuation assembly, shown as magnetic assembly 50; a pumping assembly, shown as pumping assembly 80; a first valve assembly, shown as invalve assembly 100; a second valve assembly, shown as outvalve assembly 110, and a deflector 41. As shown in FIGS. 29-30, the housing 20 defines a central, longitudinal axis, shown as central axis 12. The housing 20 has a first end, shown as upper portion 22, and an opposing second end (e.g., neck, etc.), shown as lower portion 24. As shown in FIGS. 29-30, the end cap 30 is coupled to the upper portion 22 of the housing 20. A ring member (e.g., an O-ring, a gasket, etc.), shown as ring 37, is included between the end cap 30 and the top plate 52 of the magnetic assembly 50 (FIG. 30). The outvalve assembly 110 is coupled to the lower portion 24 of the housing 20. The housing 20 includes a coupling interface, shown as bosses or mounting locations 26. According to an exemplary embodiment, the mounting locations 26 are configured to facilitate coupling (e.g., attaching, securing, etc.) the FDI unit 10 to a component of a fuel delivery system (e.g., within and/or to a fuel tank, to a throttle body, to a cylinder head, to a cylinder head intake runner/port, etc.) by providing a location for a fastener or other attachments to couple the FDI unit 10 to another component. The housing 20 defines an internal cavity, shown as cavity 28. The cavity 28 is configured (e.g., sized, structured, etc.) to receive and/or support the magnetic assembly 50 (e.g., with the upper portion 22 thereof, etc.), the pumping assembly 80 (e.g., with the lower portion 24 thereof, etc.), and a volume of fuel.

As shown in FIGS. 29-30, the end cap 30 includes an inlet port 32, defining a first conduit, shown as inlet conduit 34. According to an exemplary embodiment, the inlet conduit 34 is configured to receive and direct a liquid fuel (e.g., liquid gasoline, from a fuel tank, from a fuel pump, etc.) into the cavity 28 of the housing 20. The end cap 30 includes an outlet port 36, defining a second conduit, shown as outlet conduit 38. According to an exemplary embodiment, the outlet conduit 38 is configured to receive and direct a fuel vapor and/or liquid fuel (e.g., fuel vapor, air, a fuel-air mixture, etc.) out of the cavity 28 (and second inlet conduit 35) of the housing 20 (e.g., to a fuel tank, to additional injectors, etc.).

As shown in FIG. 30, the magnetic assembly 50 includes a first plate, shown as top plate 52, a second plate, shown as bottom plate 54, and a plurality of intermediate plates, shown as intermediate plates 56. According to an exemplary embodiment, the top plate 52, the bottom plate 54, and the intermediate plates 56 are fixed (e.g., stationary, do not move, etc.) within the cavity 28. As shown in FIG. 30, the magnetic assembly 50 includes a pin 60. According to an exemplary embodiment, the pin 60 extends through a central aperture in the top plate 52, the bottom plate 54, and the intermediate plates 56. The top plate 52, the bottom plate 54, and the intermediate plates 56 are aligned (e.g., slip fit, press fit, etc.) and held together by the pin 60, according to an exemplary embodiment. In this arrangement, the pin 60 does not include a conduit positioned therein. As shown in FIG. 30, the pin 60 is a solid (e.g., filled in) piece, which may be aligned with the inlet conduit 34 of the end cap 30. According to an exemplary embodiment, the pin 60 is formed from a non-magnetic material such as stainless steel, aluminum, plastic, and/or another non-magnetic, fuel compatible material.

As shown in FIG. 30, the end cap 30 includes a deflector 41 extending into the housing 20. Upon attachment of the end cap 30 to the housing 20, the deflector 41 is positioned proximate to or contacting the top plate 52 of the magnetic assembly 50. In operation, the deflector 41 redirects vapor from incoming liquid fuel and vapor toward outlet conduit 38. The end cap 30 defines a second inlet conduit 35 fluidly coupled to the inlet conduit 34. The second inlet conduit 35 is positioned to extend radially between the inlet conduit 34 and the outlet conduit 38, thereby fluidly coupling the inlet port 32 to the outlet port 36. Instead of flowing through a conduit formed in pin 60, as vapor and liquid fuel enters the FDI unit 10 through inlet conduit 34, the liquid fuel flows through inlet conduit 34 down into cavity 28 past the deflector 41 (e.g., on the left side of magnetic assembly 50 as shown in FIG. 30). Any vapor that flows toward the left as shown in FIG. 30, hits the deflector 41 and is redirected back through the second inlet conduit 35 and into the outlet conduit 38 to exit from the FDI unit 10.

Figure 31:
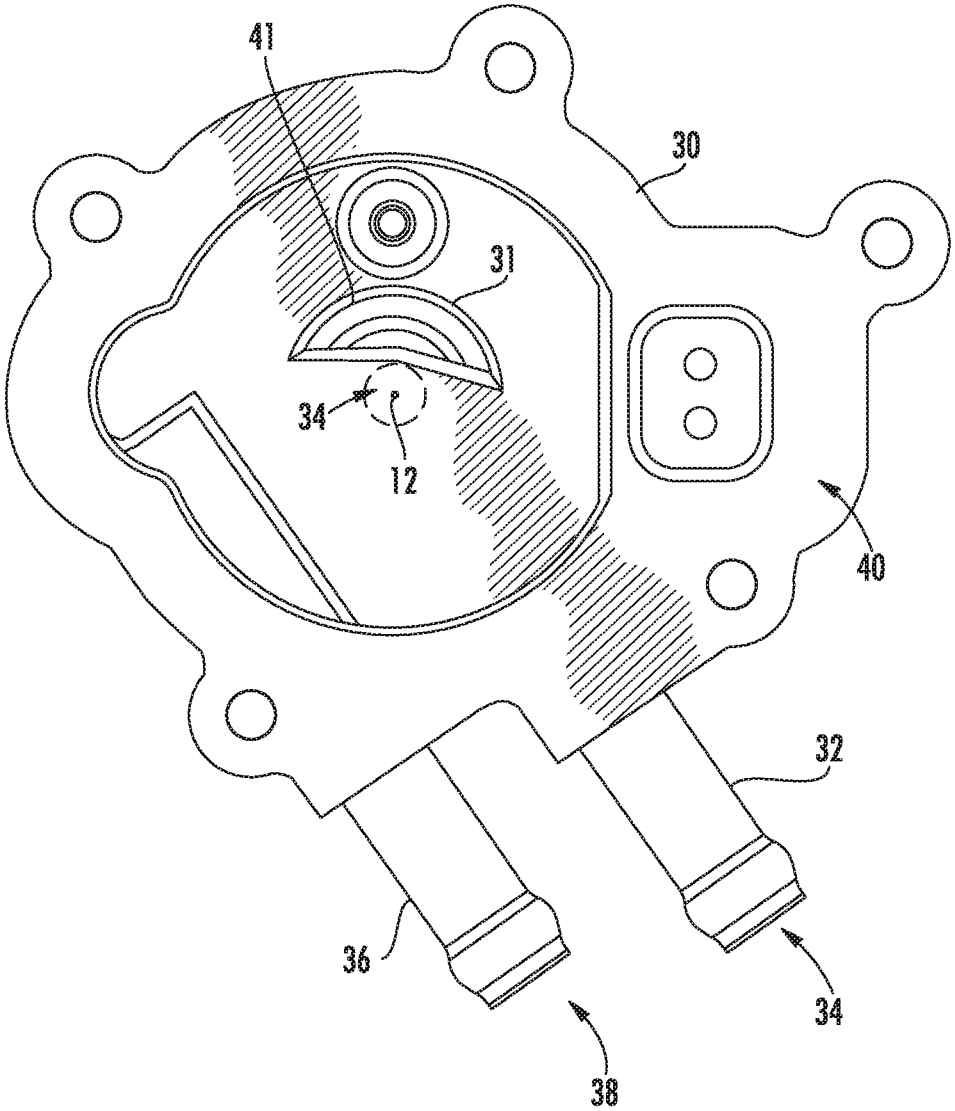
FIGS. 31-36 are various views of end caps for use with a fuel delivery injector unit, according to an exemplary embodiment.
Figure 32:
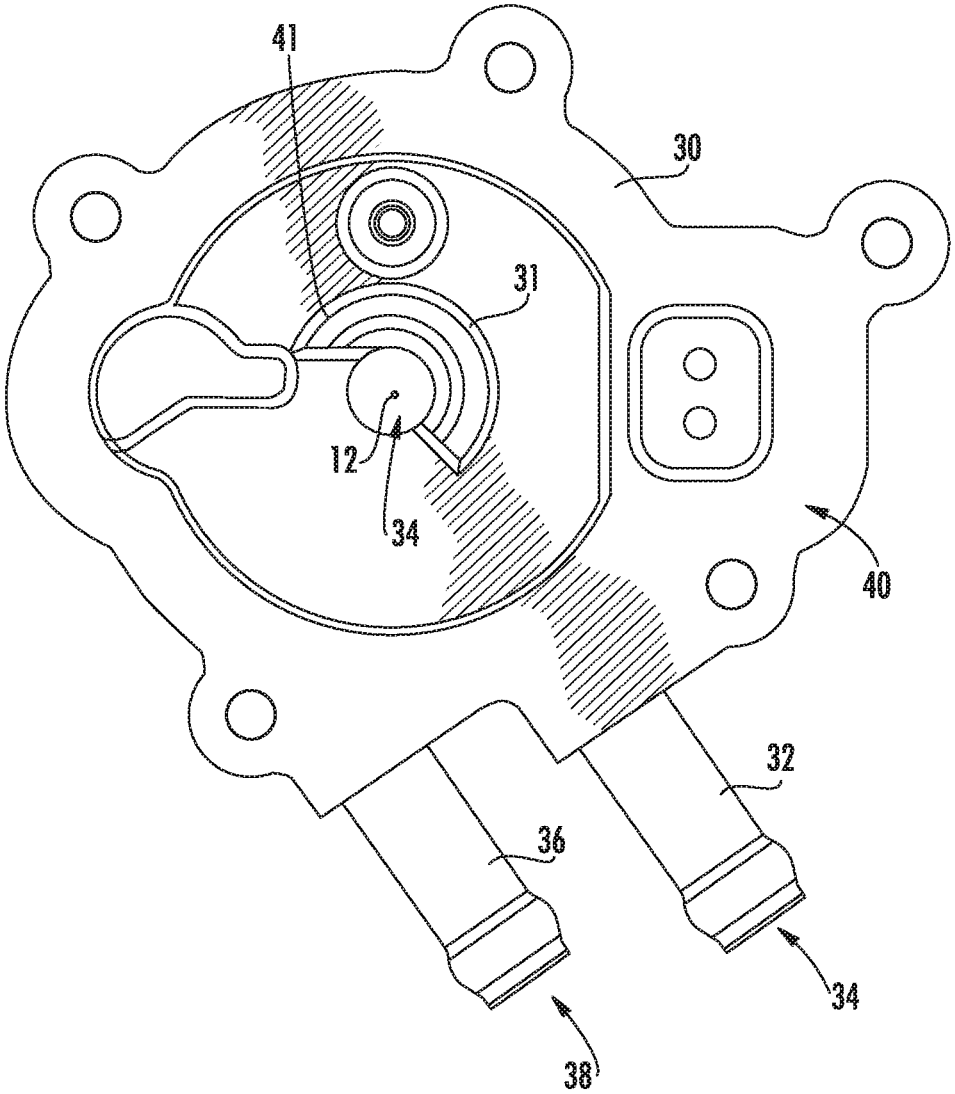
Figure 33:
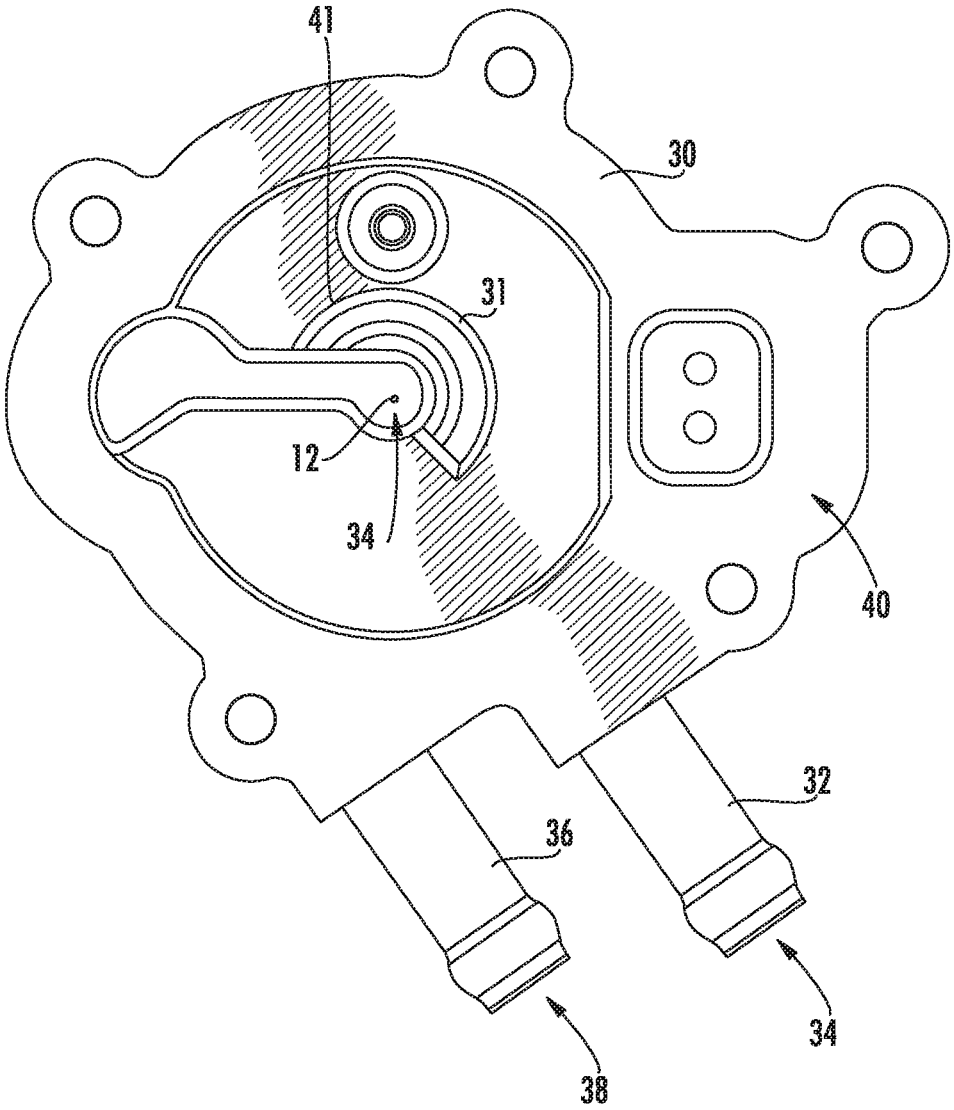

Referring to FIGS. 31-33, various embodiments of an end cap 30 as described in FIGS. 19-21 are shown from a bottom view. As shown in FIGS. 31-33, each end cap 30 may include a deflector 41. The deflector 41 is configured to redirect fuel vapor toward outlet conduit 38. Vapor may come from a fuel supply and/or may be generated inside the FDI unit 10 during movement of the bobbin 64 (e.g., due to a reduction in pressure and/or increase in temperature, etc.). According to various embodiments, the deflector 41 can be varying shapes. These shapes can include a wall 31 that extends radially around the center axis 12 of the housing 20 partially surrounding the inlet conduit 34 on the underside of end cap 30.

Figure 34:
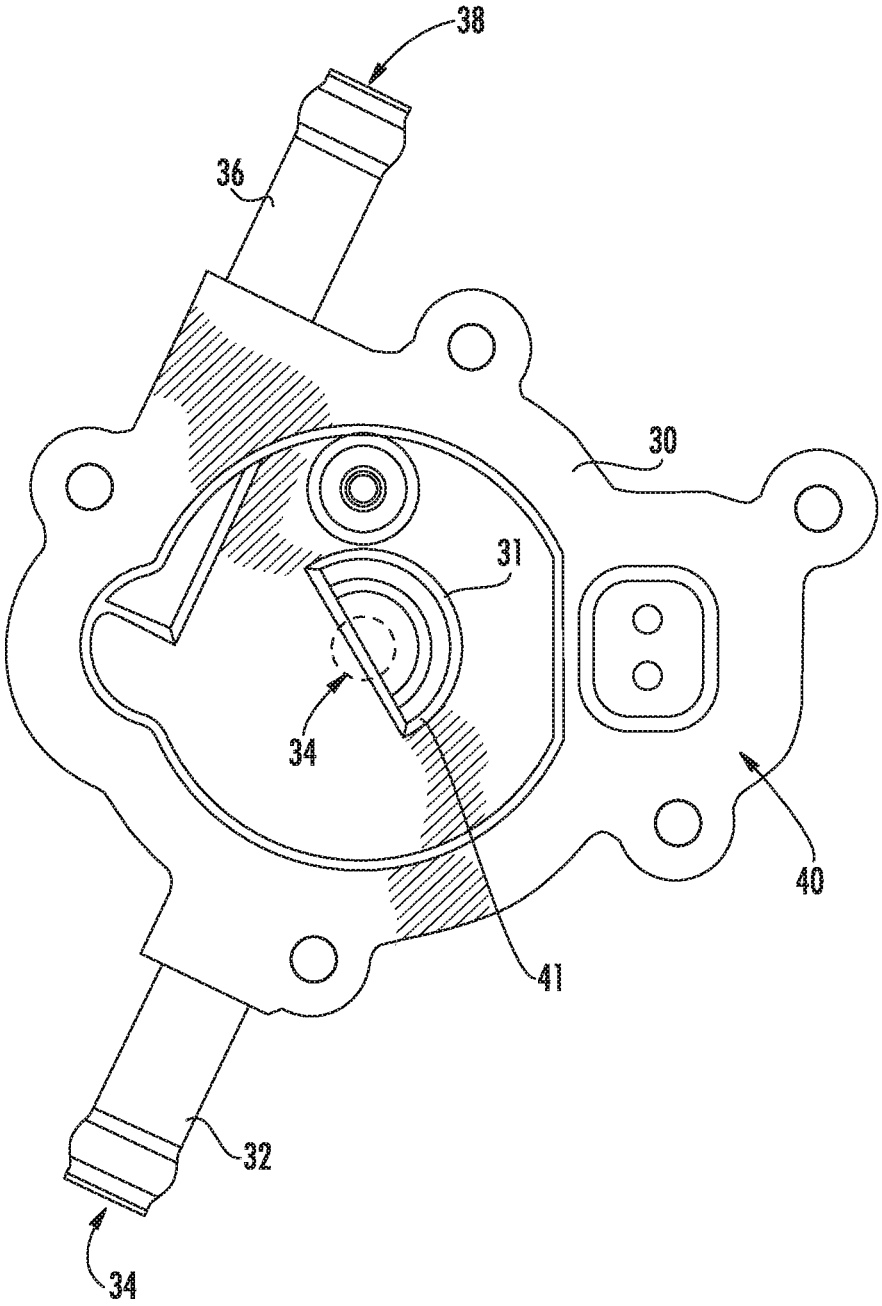
Figure 35:
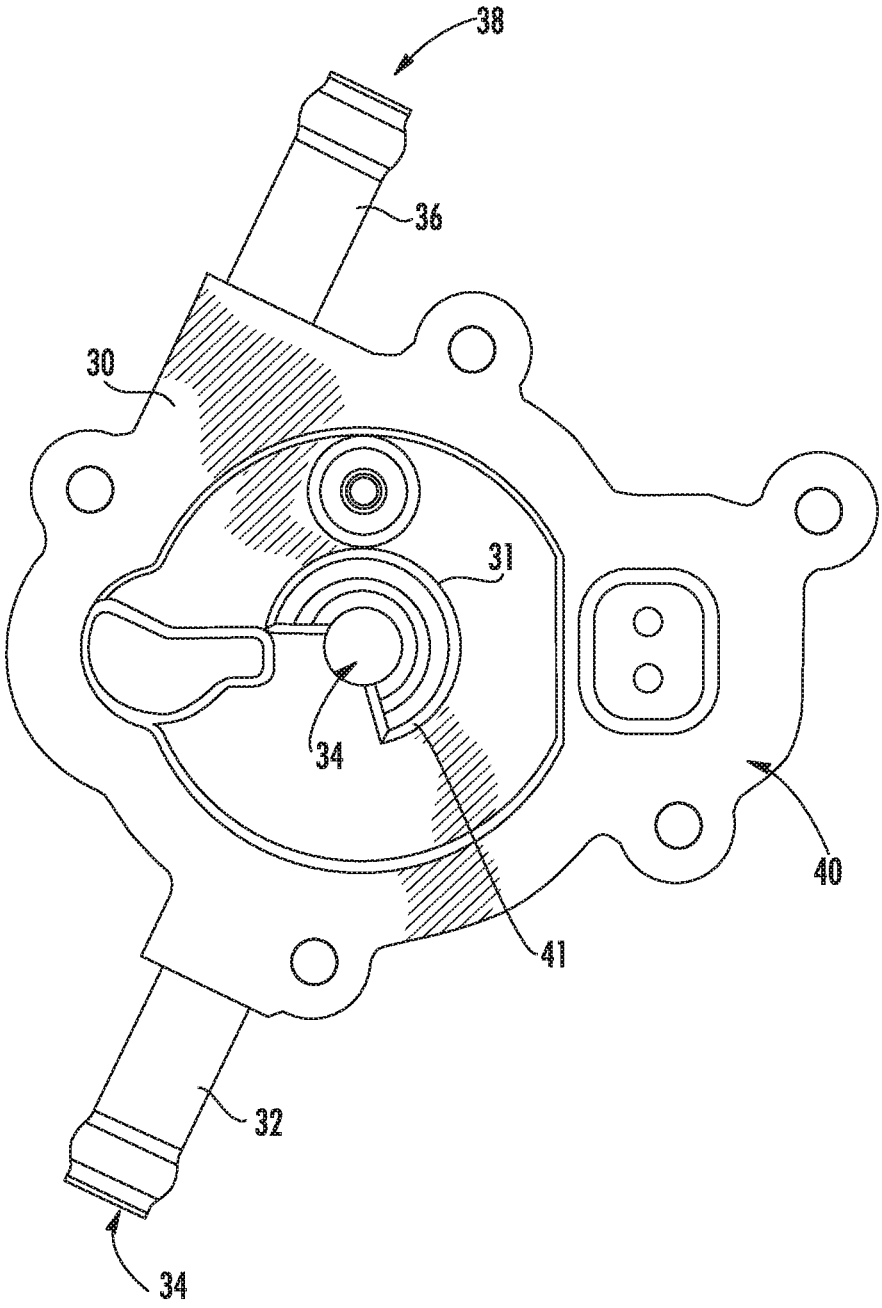
Figure 36:
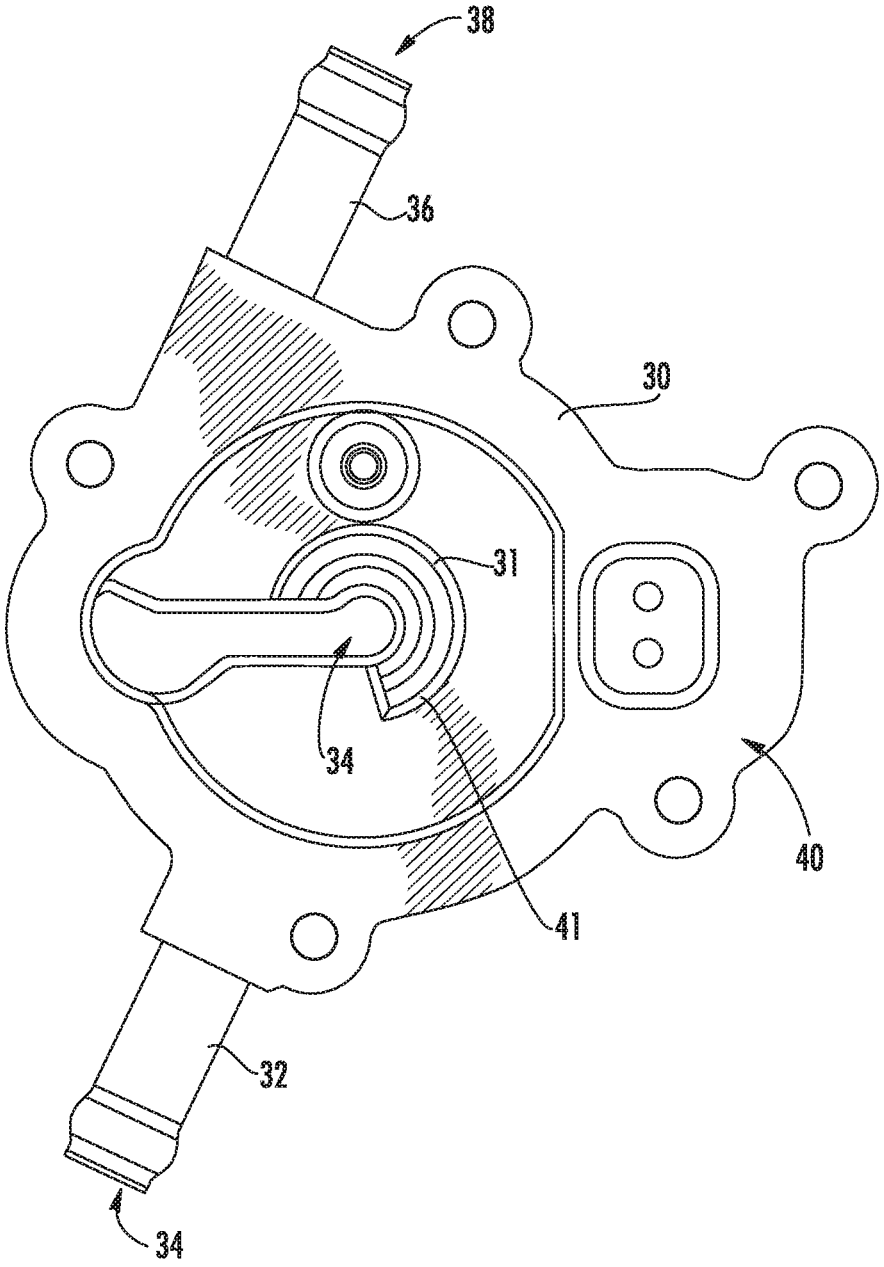
Figure 38:
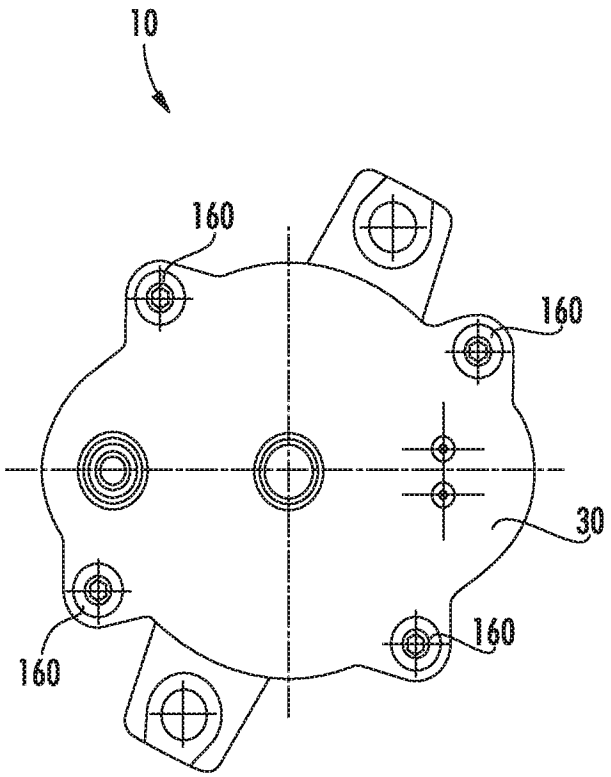
FIGS. 37-39 are various views of a fuel delivery injector unit, according to another exemplary embodiment.
Figure 37:
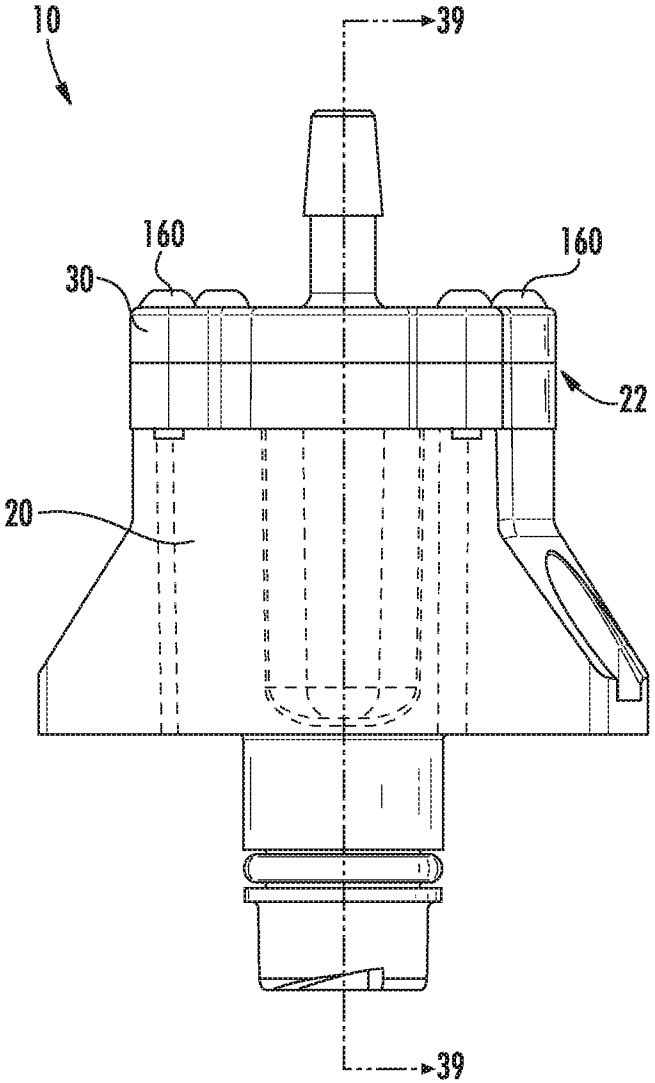

Referring to FIGS. 34-36, various embodiments of an end cap 30 as described in FIGS. 22-24 are shown from a bottom view. As shown in FIGS. 34-36, each end cap 30 may include a deflector 41. The deflector 41 is configured to redirect fuel vapor toward outlet conduit 38. Vapor may come from a fuel supply and/or may be generated inside the FDI unit 10 during movement of the bobbin 64 (e.g., due to a reduction in pressure and/or increase in temperature, etc.). According to various embodiments, the deflector 41 can be varying shapes. These shapes can include a wall 31 that extends radially around the center axis 12 of the housing 20 partially surrounding the inlet conduit 34 on the underside of end cap 30.

Alternative Fuel Delivery Injector Units

Figure 39:
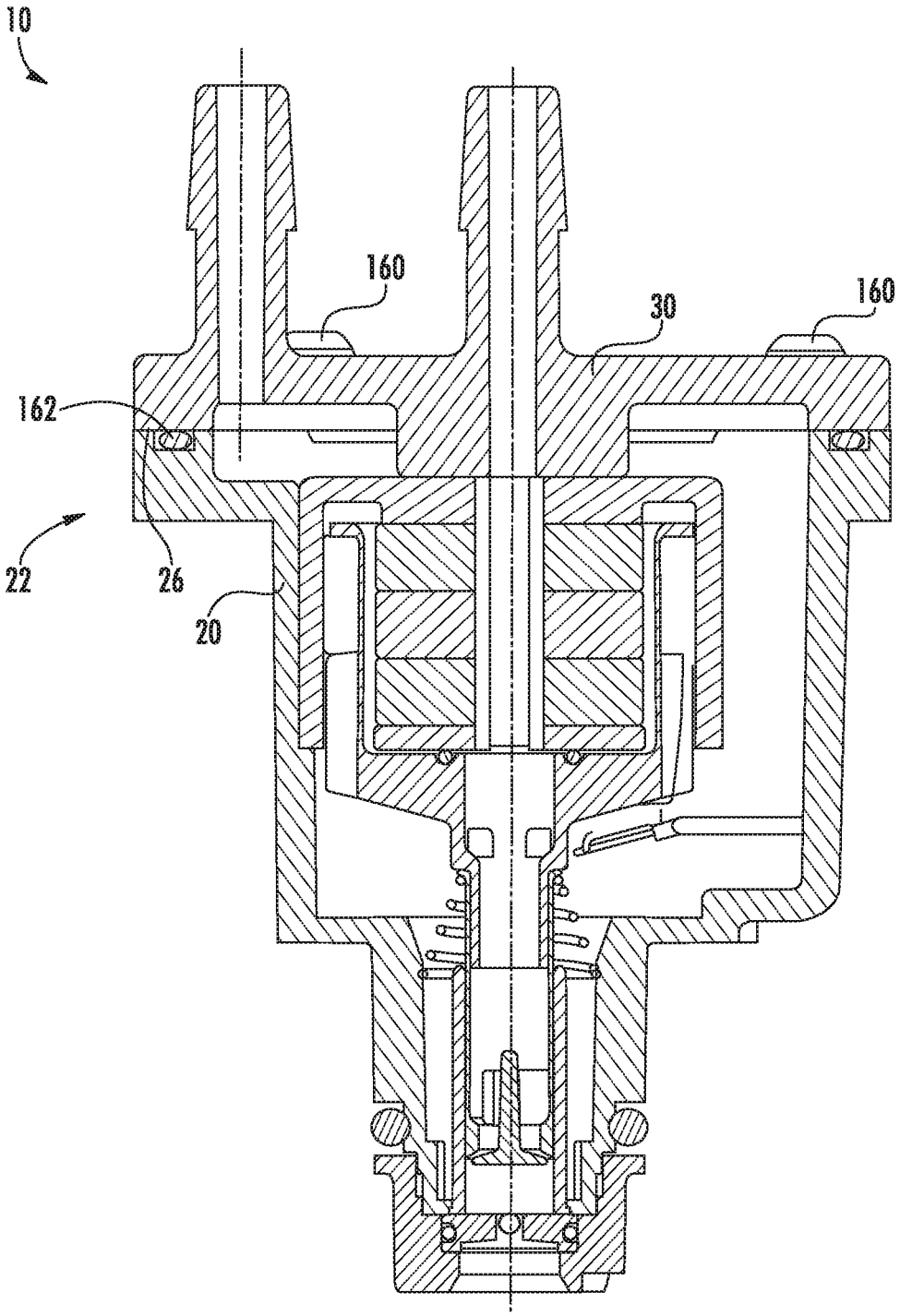
Figure 40:
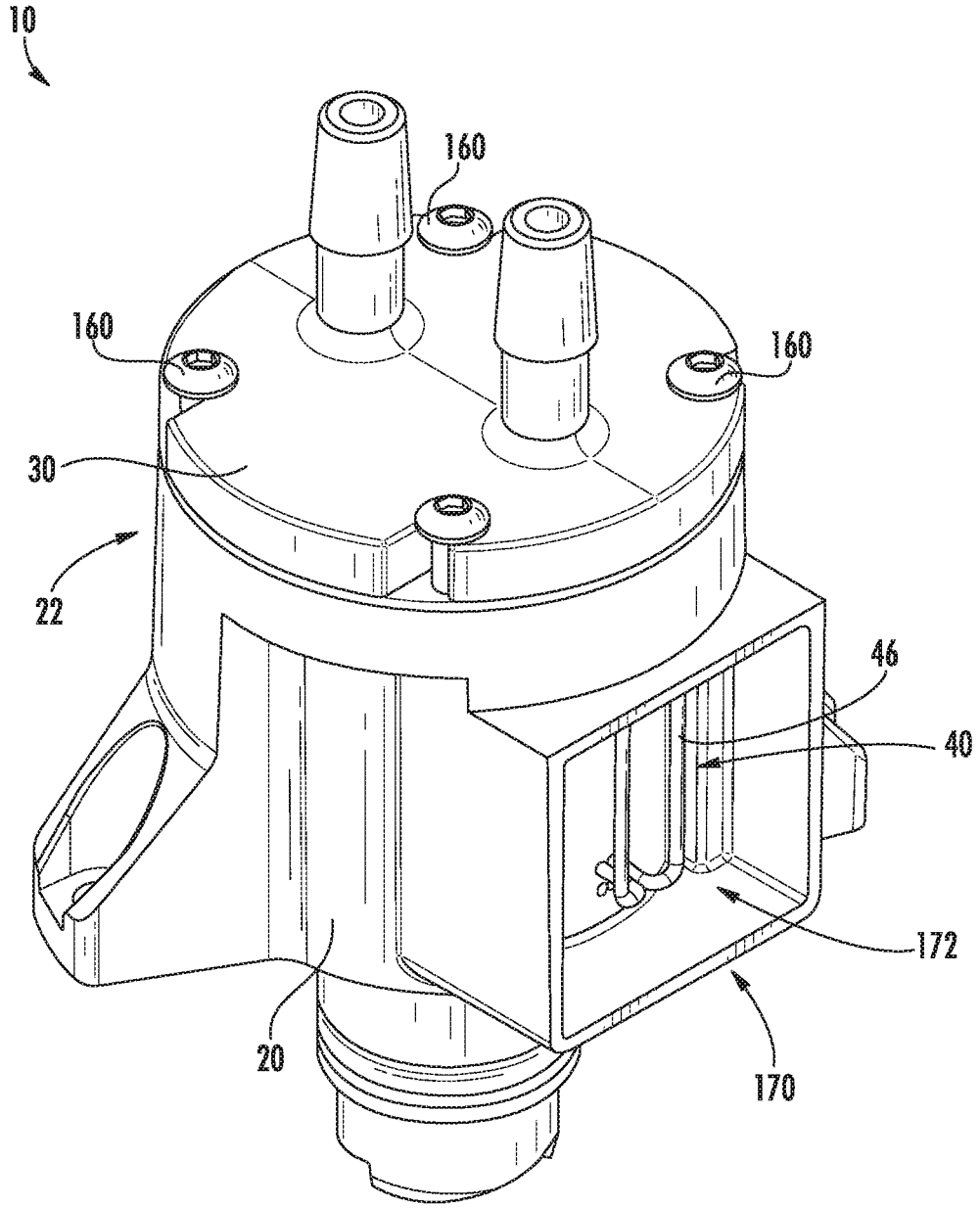
FIGS. 40-43 are various views of a fuel delivery injector unit, according to another exemplary embodiment.
Figure 42:
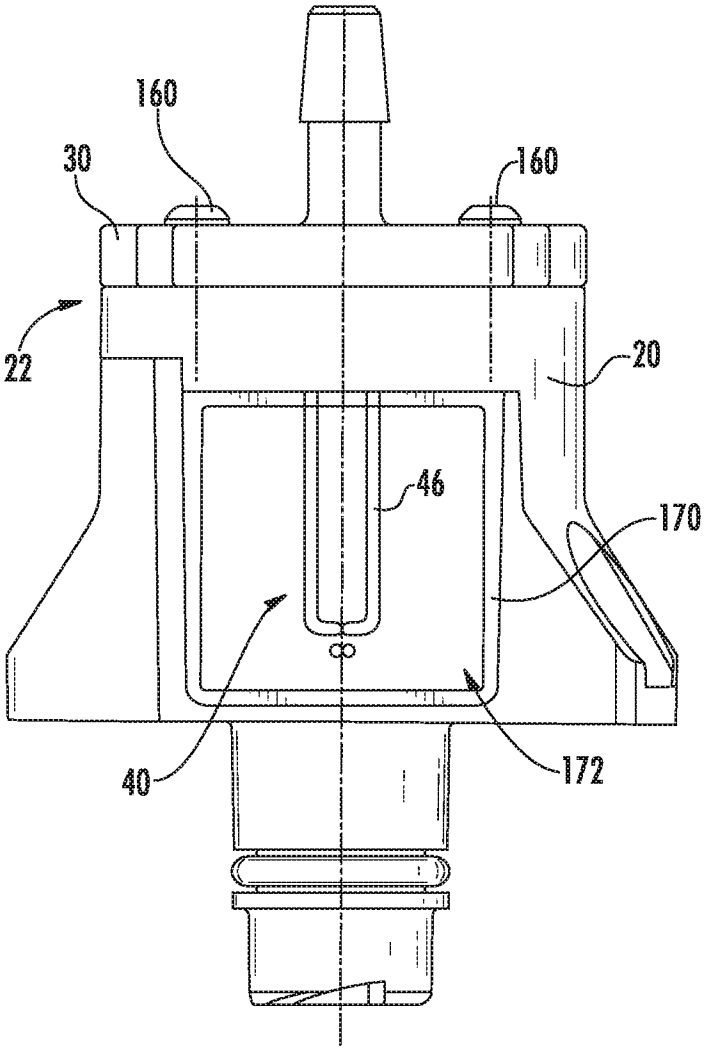
Figure 41:
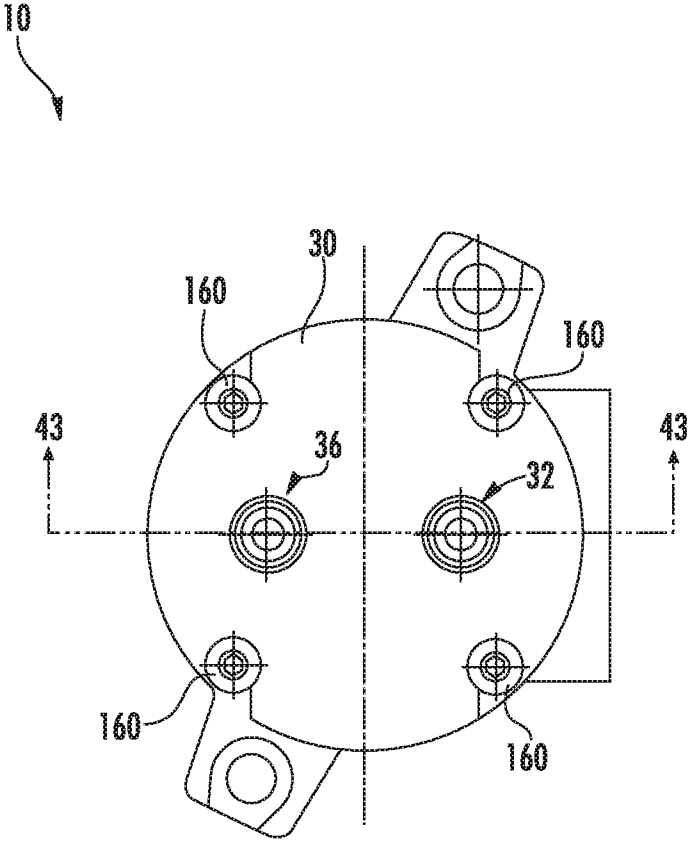
Figure 43:
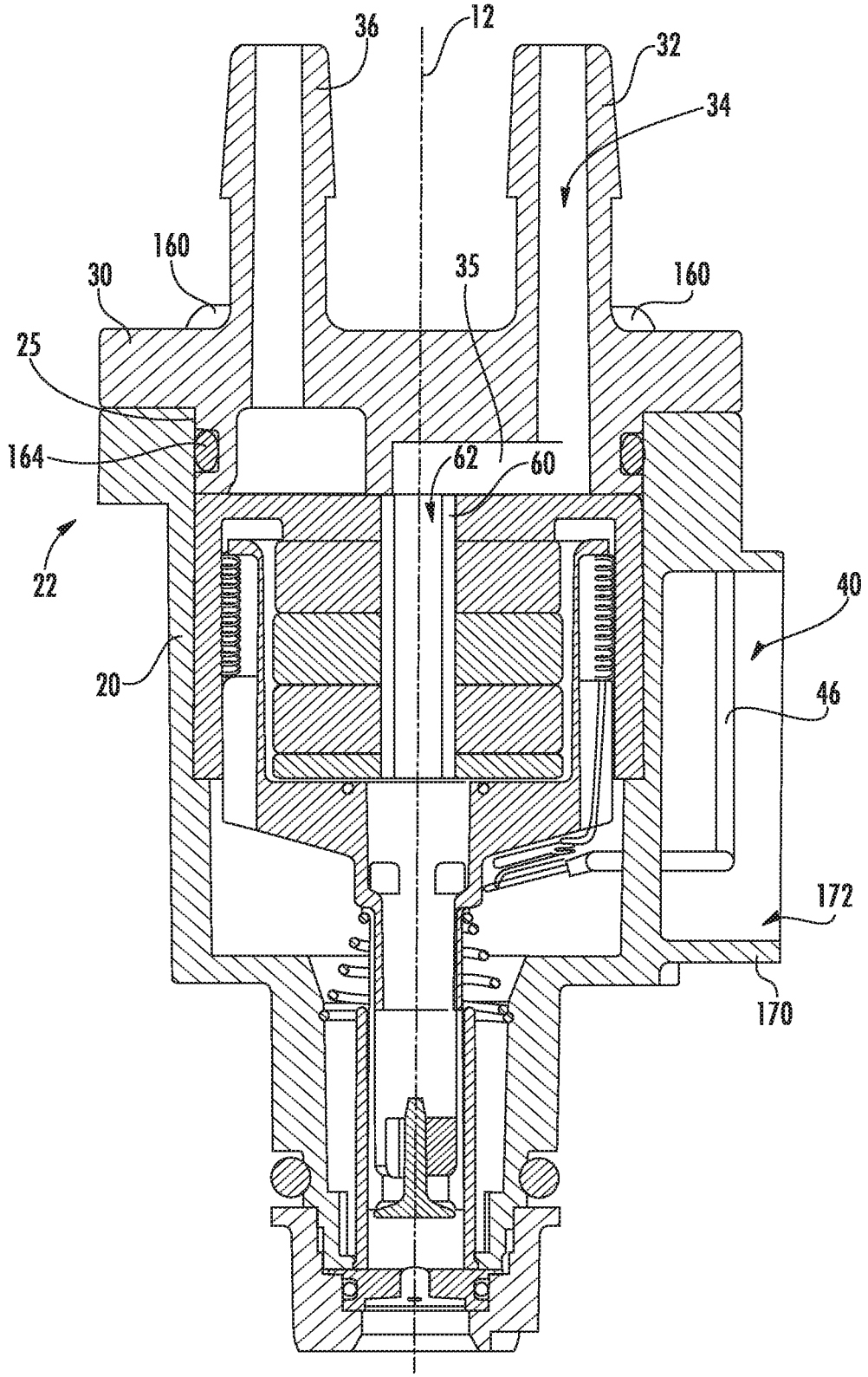

According to the embodiment shown in FIGS. 37-43, the end cap 30 of the FDI unit 10 is coupled (e.g., releasably secured, fastened, attached, etc.) to the upper portion 22 of the housing 20 with a plurality of fasteners (e.g., screws, rivets, clips, clamps, etc.), shown as fasteners 160. As shown in FIG. 39, the FDI unit 10 includes a sealing member (e.g., an O-ring, a gasket, etc.), shown as axial seal 162, positioned between the end cap 30 and an upper wall, shown as rim 23, of the housing 20. As shown in FIG. 43, the FDI unit 10 includes a sealing member (e.g., an O-ring, a gasket, etc.), shown as radial seal 164, positioned between the end cap 30 and an interior wall, shown as inner rim 25, of the housing 20. As shown in FIGS. 41 and 43, the inlet port 32 and the outlet port 36 are radially offset from the central axis 12. As shown in FIG. 43, the end cap 30 defines a secondary inlet conduit, shown second inlet conduit 35, fluidly coupled to the inlet conduit 34. The second inlet conduit 35 is positioned to extend radially between the fluid conduit 62 of the pin 60 and the inlet conduit 34, thereby fluidly coupling the inlet port 32 to the pin 60.

Figure 44:
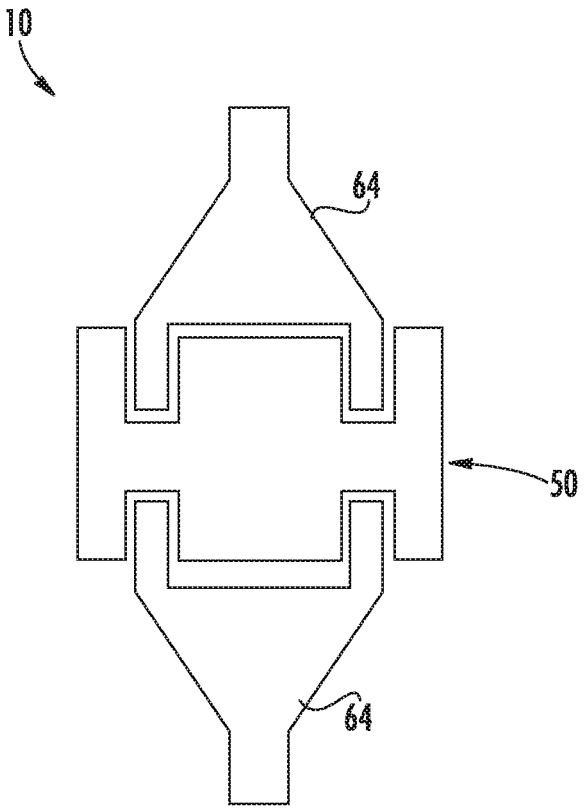
FIG. 44 is a front schematic view of a fuel delivery injector unit, according to another exemplary embodiment.
Figure 45:
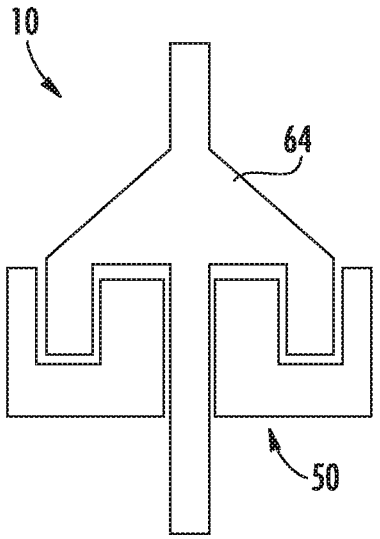
FIG. 45 is a front schematic view of a fuel delivery injector unit, according to another exemplary embodiment.

According to another embodiment shown in FIGS. 44-45, the FDI unit 10 is configured as a dual FDI unit. By way of example, as shown in FIG. 44, the FDI unit 10 may include a magnetic assembly 50 including the top plate 52, the bottom plate 54, and the intermediate plates 56, but further includes two bobbins 64 positioned at each longitudinal end thereof. For example, a first bobbin 64 may be positioned to interface with the top plate 52 and a second bobbin 64 may be positioned to interface with the bottom plate 54. Each of the first bobbin 64 and the second bobbin 64 may be coupled (e.g., fluidly, physically, etc.) to a respective pumping assembly 80, invalve assembly 100, and outvalve assembly 110 such that when an electrical current is provided to the coils 66 of each bobbin 64, the first bobbin 64 and the second bobbin 64 separate and drive their respective pumping assembly 80. Thus, the FDI unit 10 may include a pair of bobbins 64, coils 66, return springs 76, pumping assemblies 80, invalve assemblies 100, and outvalve assemblies 110. Such a dual FDI unit may be used to provide fuel injection to two cylinders with a single FDI unit, or increased fuel injection to a single cylinder. In other embodiments, as shown in FIG. 45, the FDI unit 10 includes a single bobbin 64 configured to oscillate around the top plate 52, the bottom plate 54, and the intermediate plates 56 (e.g., the bobbin 64 surrounds the top plate 52, the bottom plate 54, and the intermediate plates 56, etc.) such that the single bobbin 64 may drive two pumping assemblies 80, two invalve assemblies 100, and two outvalve assemblies 110. For example, the bobbin 64 may simultaneously drive an extension stroke of a first pumping assembly 80 and a return stroke of second pumping assembly 80.

Smart Fuel Delivery Injector Unit

According to the exemplary embodiment shown in FIGS. 40-43, the FDI unit 10 is configured as a smart FDI unit. As shown in FIGS. 40-43, the housing 20 defines a compartment or box, shown as circuitry compartment 170, extending from the side of the housing 20. The circuitry compartment 170 defines a cavity, shown as circuitry cavity 172. The circuitry cavity 172 may be configured to receive at least a portion of control circuitry (e.g., a printed circuit board (PCB), the circuit 500 of FIG. 59, the circuit 600 of FIG. 60, etc.) for the FDI unit 10. As shown in FIGS. 40-43, the electrical wiring 46 of the electrical assembly 40 extends through the side of housing 20 into the circuitry cavity 172. Thus, the coil 66 may be directly coupled to the control circuitry disposed within the circuitry compartment 170 via the electrical wiring 46. According to an exemplary embodiment, the circuitry cavity 172 is filled with a resin to seal the control circuitry and the electrical wiring 46 within the circuitry compartment 170.

Fuel Delivery Injector Unit Integration

According to the exemplary embodiment shown in FIGS. 46-54, the FDI unit 10 is configured to be used within a fuel delivery system of an internal combustion engine system, shown as engine system 200. The engine system 200 may be used in outdoor power equipment, standby generators, portable jobsite equipment, or other appropriate uses. Outdoor power equipment includes lawn mowers, riding tractors, snow throwers, pressure washers, portable generators, tillers, log splitters, zero-turn radius mowers, walk-behind mowers, riding mowers, industrial vehicles such as forklifts, utility vehicles, etc. Outdoor power equipment may, for example, use an internal combustion engine to drive an implement, such as a rotary blade of a lawn mower, a pump of a pressure washer, the auger a snow thrower, the alternator of a generator, and/or a drivetrain of the outdoor power equipment. Portable jobsite equipment includes portable light towers, mobile industrial heaters, and portable light stands.

As shown in FIGS. 46-54, the engine system 200 includes an engine 210 having a cylinder 212, a piston 214, a cylinder head 216, and a cylinder intake port 218 (e.g., intake manifold, etc.). The piston 214 reciprocates in the cylinder 212 to drive a crankshaft. The crankshaft rotates about a crankshaft axis. As illustrated, the engine 210 includes a single cylinder 212. In other embodiments, the engine 210 includes two cylinders arranged in a V-twin configuration. In other embodiments, the engine 210 includes two or more cylinders that can be arranged in different configurations (e.g., inline, horizontally opposed, etc.). In some embodiments, the engine 210 is vertically shafted, while in other embodiments, the engine 210 is horizontally shafted.

As shown in FIGS. 46-49, the engine system 200 includes an air cleaner, shown as air cleaner 220; an air flow regulator, shown as a throttle body 230; a fluid reservoir, shown as fuel tank 240; and a fluid transfer pump; shown as fuel pump 250. According to an exemplary embodiment, the air cleaner 220 is configured to receive and filter ambient air from an external environment to remove particulates (e.g., dirt, pollen, etc.) from the air. As shown in FIGS. 46-49, the air cleaner 220 is fluidly coupled to the throttle body 230 with a first conduit, shown as cleaned air conduit 222, such that the clean air may travel from the air cleaner 220 to the throttle body 230. According to an exemplary embodiment, the throttle body 230 is configure to receive and selectively control (e.g., throttle, etc.) the amount of air that flows from the throttle body 230 to the cylinder intake port 218 of the cylinder 212 (e.g., to provide a desired amount of air for an air-fuel mixture for combustion within the cylinder head 216, etc.). As shown in FIGS. 46-49, the throttle body 230 is fluidly coupled to the cylinder intake port 218 with a second conduit, shown as throttled air conduit or manifold 232, such that the throttled air may travel from throttle body 230 into the cylinder head 216. In some embodiments, the throttle body 230 is directly coupled to an intake manifold (e.g., the cylinder intake port 218, etc.) of the engine 210.

As shown in FIGS. 46-49, the fuel tank 240 includes a first conduit, shown as outlet conduit 242, and a second conduit, shown as fuel vapor and/or liquid fuel return conduit 244. The outlet conduit 242 is configured to fluidly couple the fuel pump 250 to the fuel tank 240. According to an exemplary embodiment, the fuel pump 250 is configured to pump fuel from the fuel tank 240 (e.g., received via the outlet conduit 242, etc.) to the FDI unit 10 (e.g., the inlet port 32 thereof, etc.) via a fuel conduit, shown as fuel line 252. In one embodiment, the fuel pump 250 is an electrically-driven pump (e.g., powered by a battery, a power source, etc.). In another embodiment, the fuel pump is a mechanically-driven pump (e.g., a pulse pump powered by the engine 210, etc.). In other embodiments, the engine system 200 of FIGS. 46-49 does not include the fuel pump 250 or the fuel line 252. By way of example, the fuel tank 240 may be positioned elevated relative to the FDI unit 10 and/or the engine 210 such that fuel may flow from the fuel tank 240 to the FDI unit 10 via the outlet conduit 242 due to a pressure head of the fuel induced by gravity. As shown in FIGS. 46-49, the fuel vapor and/or liquid fuel return conduit 244 fluidly couples the FDI unit 10 (e.g., the outlet port 36 thereof, etc.) to the fuel tank 240 to provide vapor relief and/or overflow to the FDI unit 10.

Figure 46:
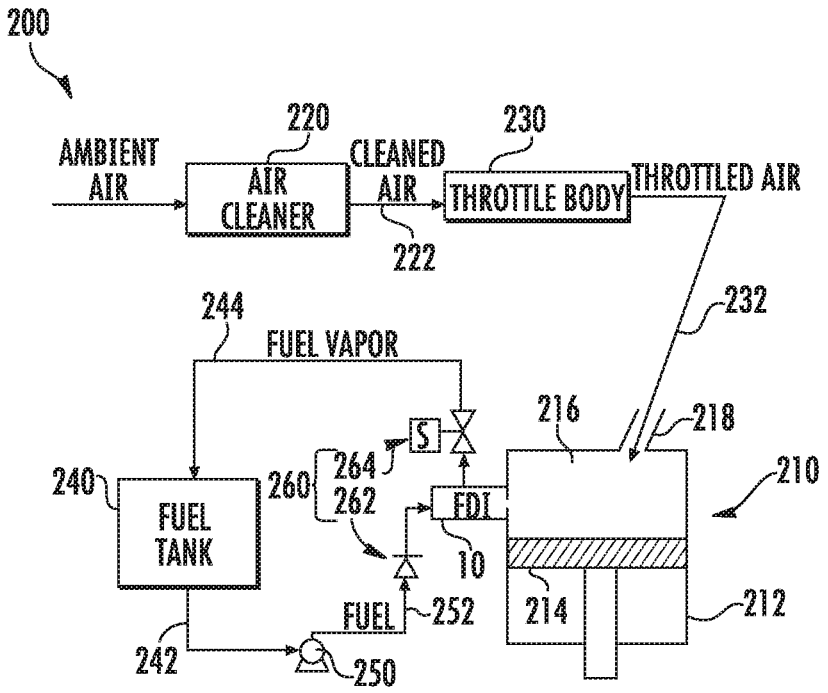
FIGS. 46-47 are various schematic diagrams of an engine system for an internal combustion engine, according to various exemplary embodiments.
Figure 47:
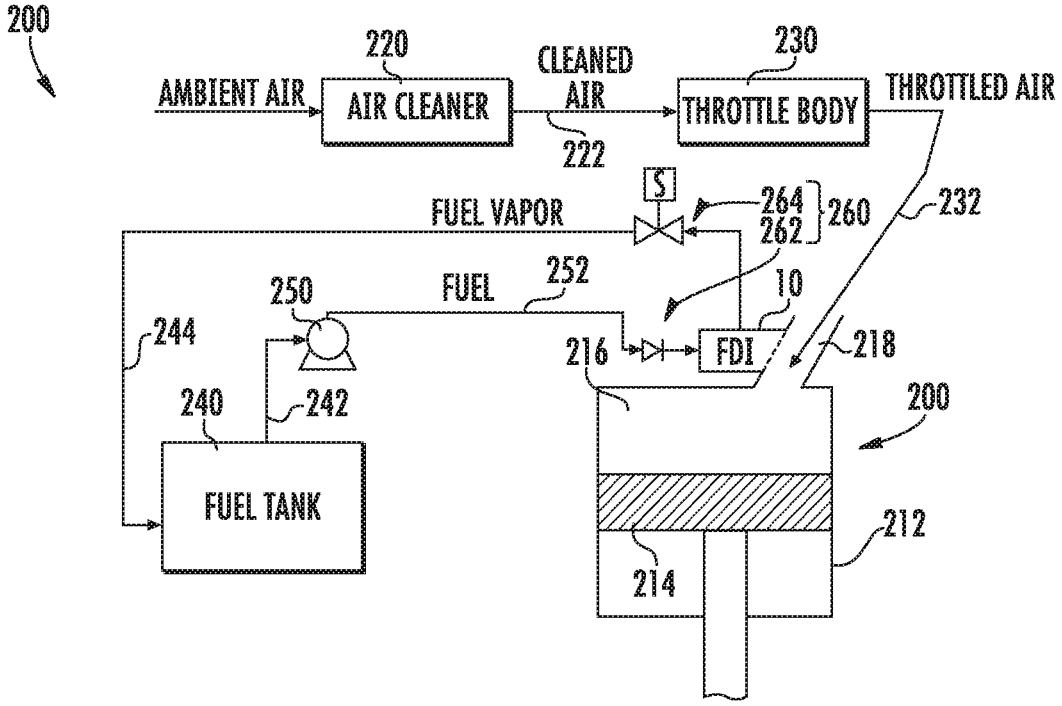
Figure 48:
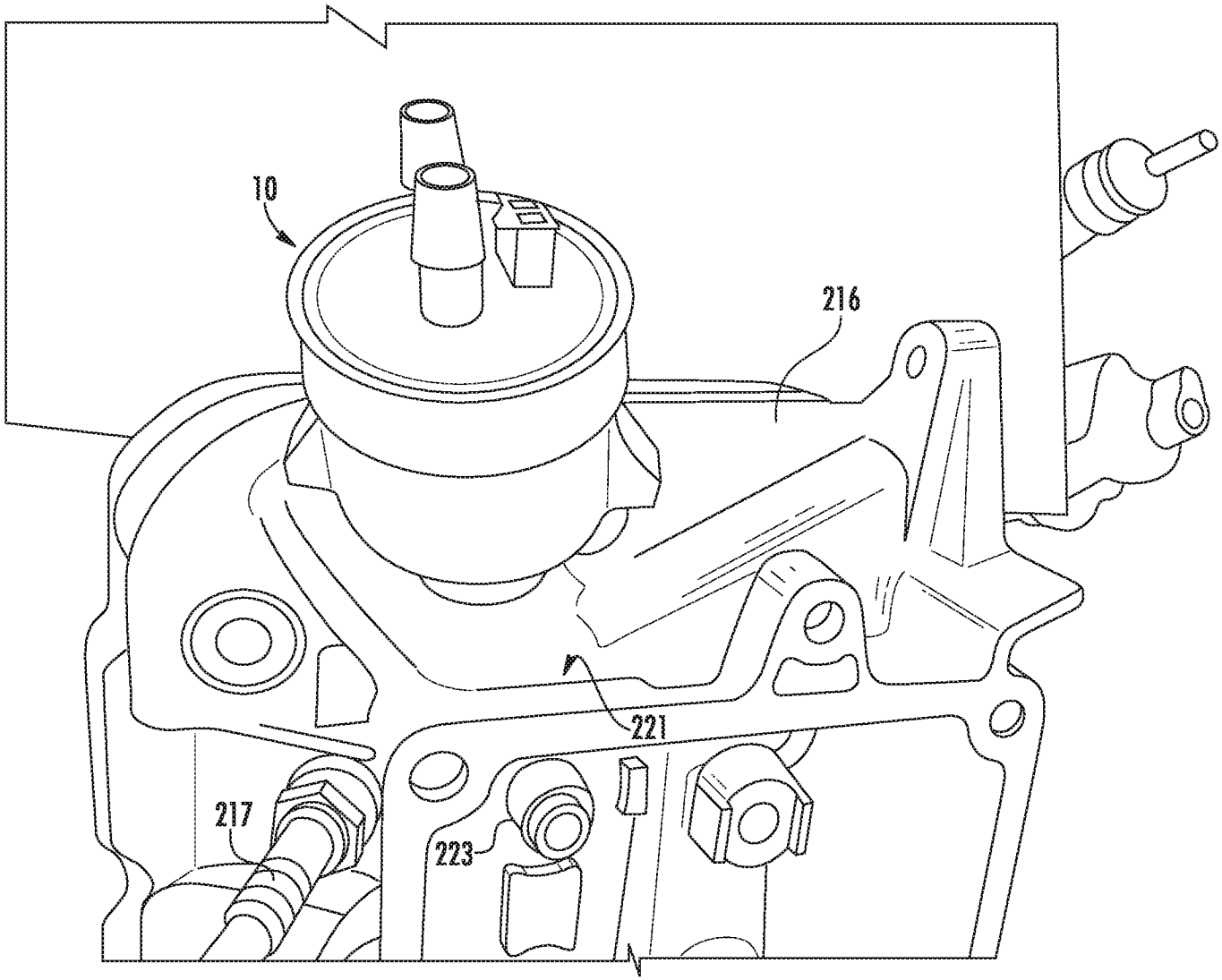
FIG. 48 is a perspective view of a fuel delivery injector unit in use with an internal combustion engine, according to an exemplary embodiment.
Figure 49:
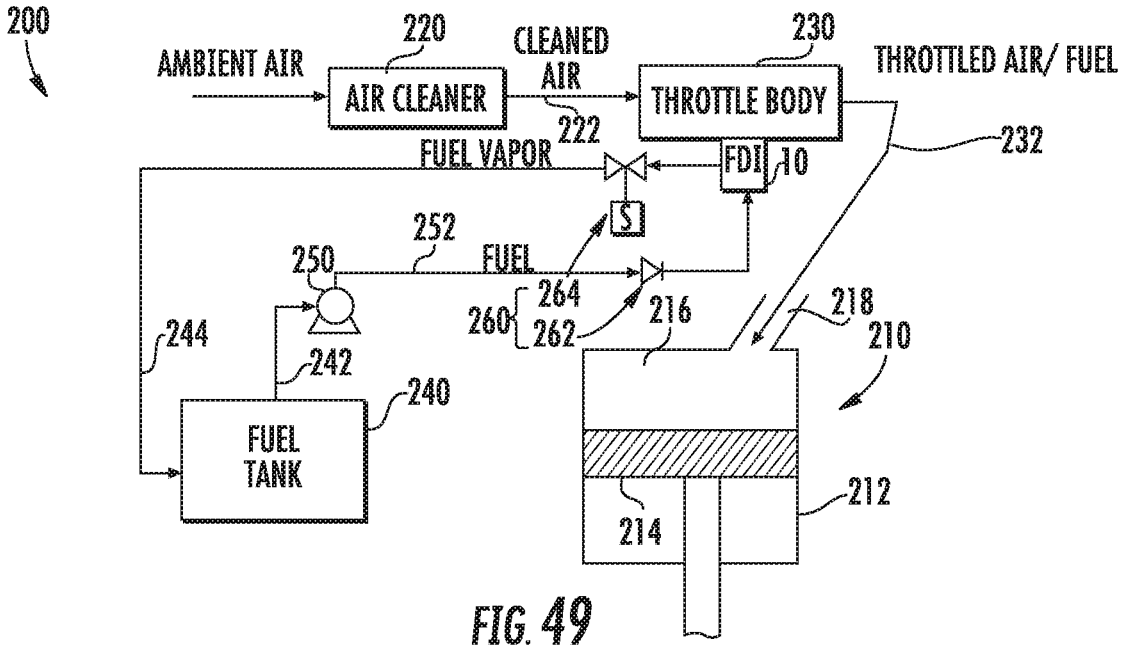
FIGS. 49-50 are various schematic diagrams of an engine system for an internal combustion engine, according to various exemplary embodiments.
Figure 51:
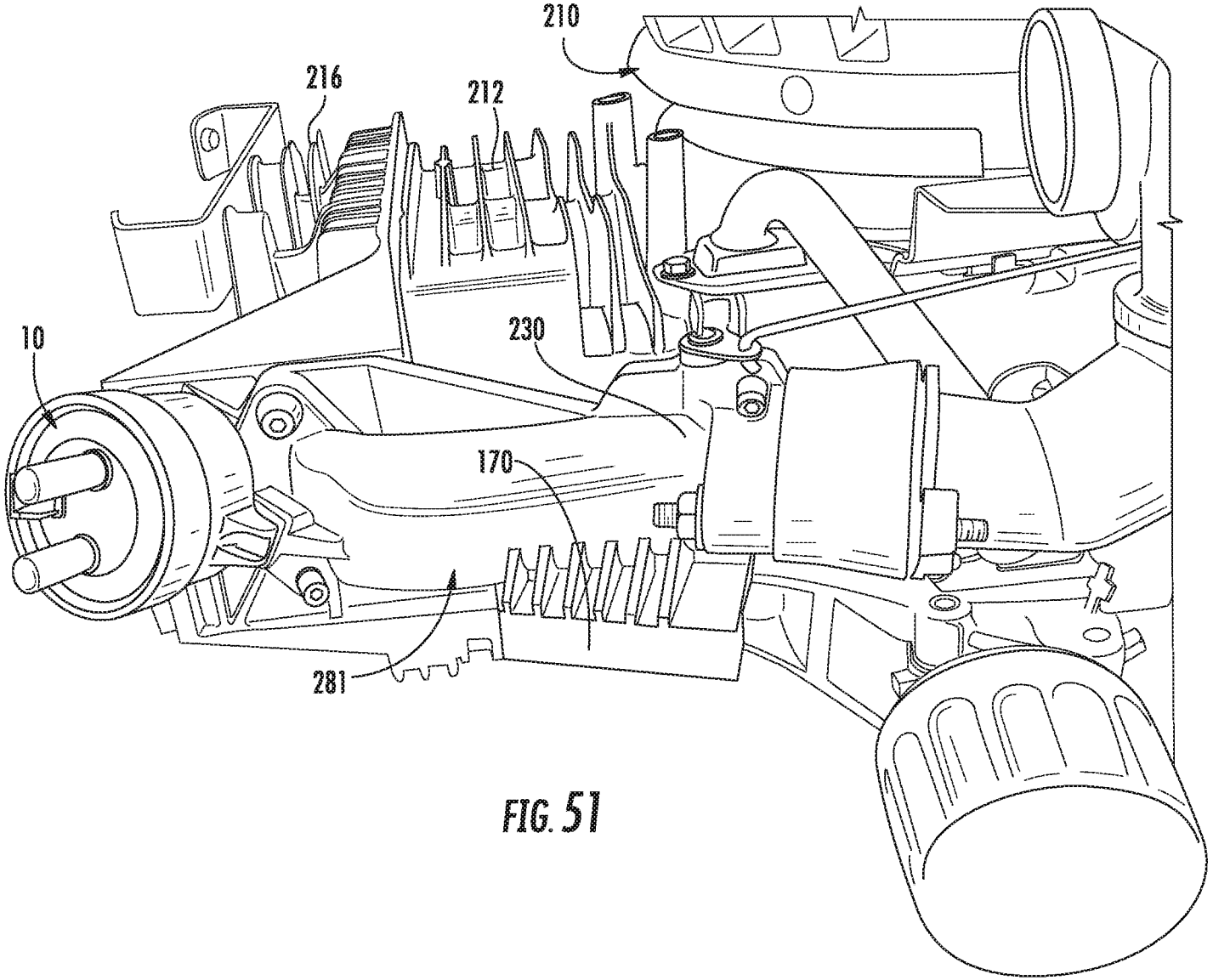
FIGS. 51-52 are perspective views of a fuel delivery injector unit in use with an internal combustion engine, according to an exemplary embodiment.
Figure 52:
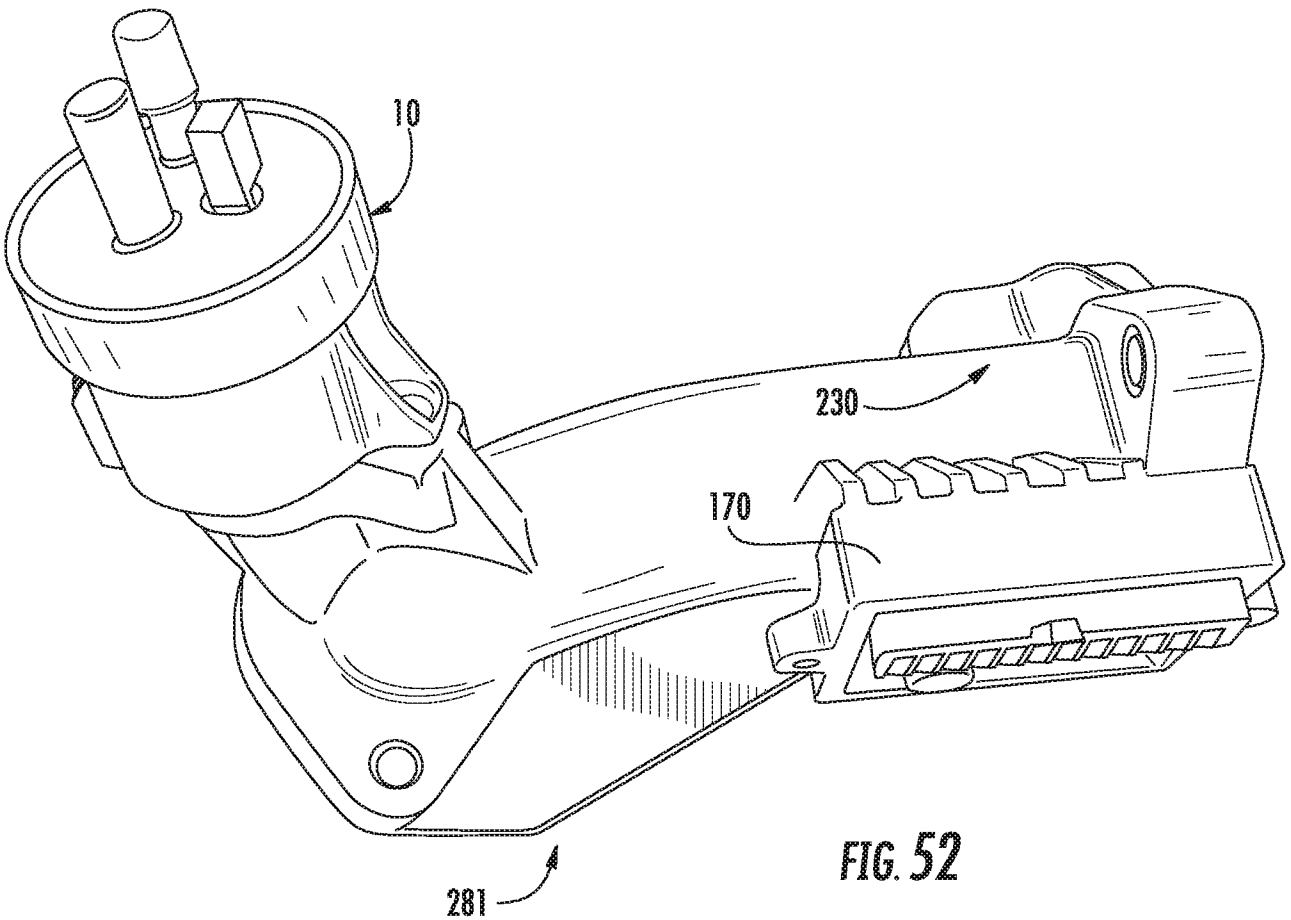

As shown in FIG. 46, the FDI unit 10 is coupled to (e.g., mounted directly within, etc.) the cylinder head 216 of the cylinder 212 for direct injection (DI) of fuel into the combustion chamber of the engine 200 through the cylinder head 216. The fuel from the FDI unit 10 may thereby mix with the air from the throttle body 230 directly within the cylinder head 216. As shown in FIG. 48, the FDI unit 10 is coupled to (e.g., mounted directly within, etc.) the cylinder head 216 of the cylinder 212 and delivers fuel into the intake valve pocket or cavity 221 of the cylinder head 216 associated with the intake valve 223. The fuel from the FDI unit 10 may thereby mix with the air from the throttle body 230 directly within the valve pocket 221. Semi-direct injection (SDI) is performed by timing injection of fuel from the FDI unit 10 into the valve pocket with the intake stroke of the associated piston. As shown in FIG. 47, the FDI unit 10 is coupled to (e.g., mounted directly within, etc.) the cylinder intake port 218 of the cylinder 212 for port injection of fuel into the cylinder head 216 through the cylinder intake port 218. The fuel from the FDI unit 10 may thereby mix with the air from the throttle body 230 within the cylinder intake port 218 and then flow into the cylinder head 216. As shown in FIG. 49, the FDI unit 10 is coupled to the throttle body 230. The fuel from the FDI unit 10 may thereby mix with the air within the throttle body 230 and then the air-fuel mixture may be delivered to the cylinder intake port 218. In some alternative embodiments, as shown in FIGS. 51-52, the FDI unit 10 is coupled a manifold 281 including an integrated throttle body 230. The fuel from the FDI unit 10 may thereby mix with the air within the manifold 281 and then the air-fuel mixture may be delivered to the cylinder intake port 218.

As shown in FIGS. 46-49, in some embodiments, the engine system 200 includes a shut-off system, shown as shut-off system 260. In other embodiments, the shut-off system 260 is not included. The shut-off system 260 may be positioned to selectively isolate the FDI unit 10 from the fuel tank 240. As shown in FIGS. 46-49, the shut-off system 260 includes a first valve (e.g., a check-valve, etc.), shown as inlet valve 262, positioned along the fuel line 252 between the fuel tank 240 and the inlet port 32 of the FDI unit 10. According to an exemplary embodiment, the inlet valve 262 is configured to selectively prevent liquid fuel from exiting the FDI unit 10 through the inlet port 32. As shown in FIGS. 46-49, the shut-off system 260 includes a second valve (e.g., a switch valve, a solenoid valve, etc.), shown as outlet valve 264, positioned between the fuel tank 240 and the outlet port 36 of the FDI unit 10. According to an exemplary embodiment, the outlet valve 264 is configured to selectively prevent fuel vapor and/or liquid fuel from exiting the FDI unit 10 through the outlet port 36.

According to an exemplary embodiment, the shut-off system 260 is engaged when the engine 210 is powered off. Engaging the shut-off system 260 when the engine 210 is shut-off may effectively isolate the fuel within the FDI unit 10. Such isolation may prevent the liquid fuel from interacting with oxygen, humidity, and/or other environmental exposure. Such isolation may also prevent vaporization of the liquid fuel within the FDI unit 10 (e.g., the fuel within the FDI unit 10 is held at increased pressure, etc.). Such isolation may also facilitate improving hot restart of the engine 210.

Figure 50:
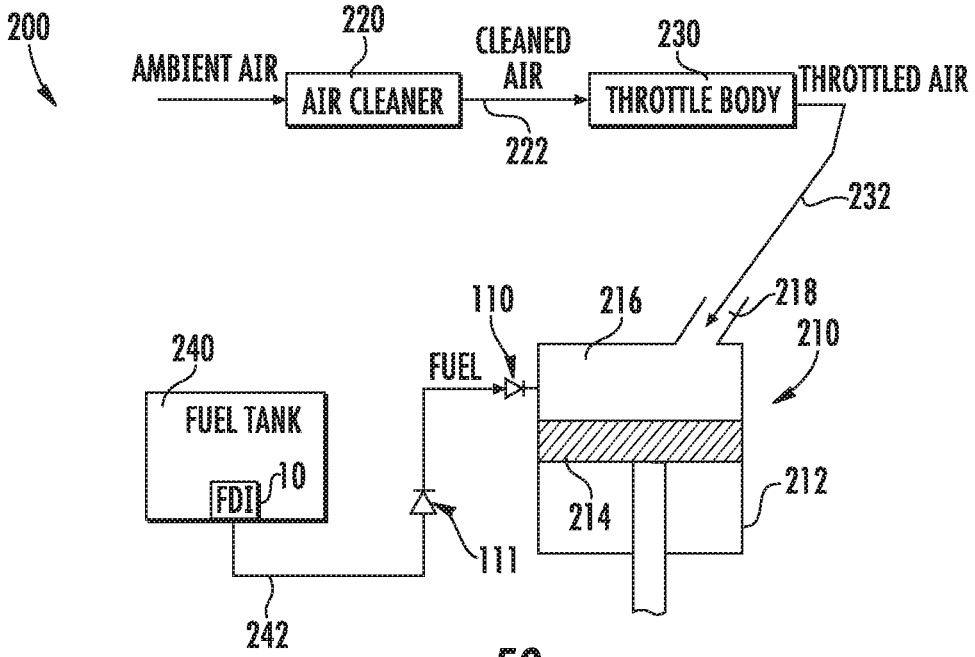
Figure 53:
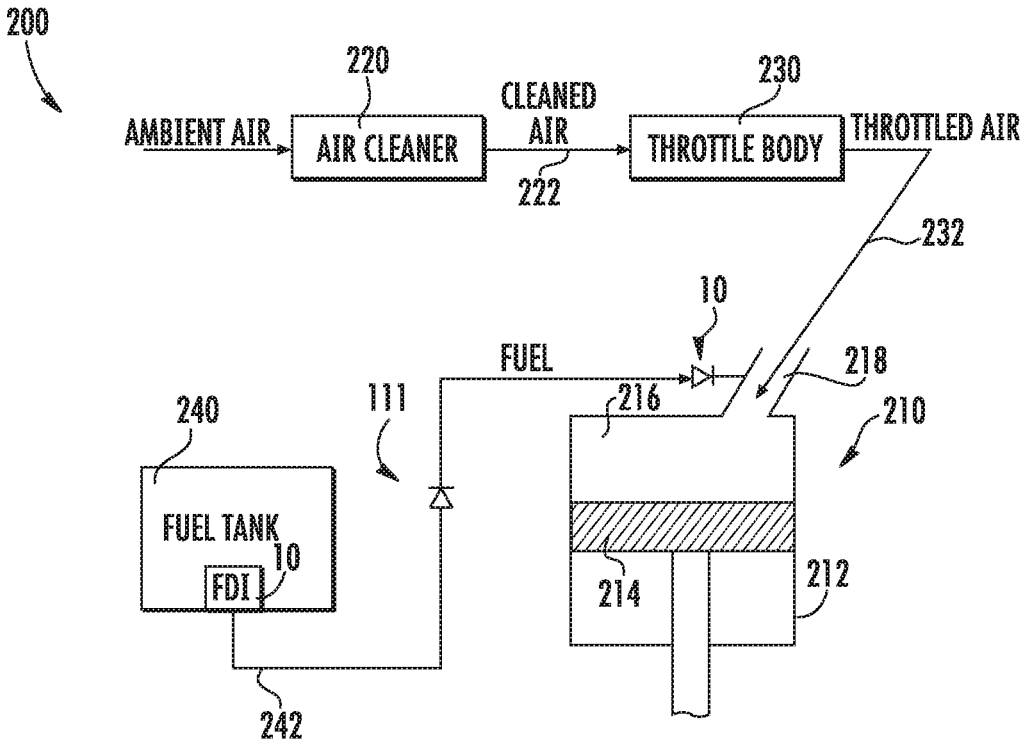
FIGS. 53-54 are various schematic diagrams of an engine system for an internal combustion engine, according to various exemplary embodiments.
Figure 54:
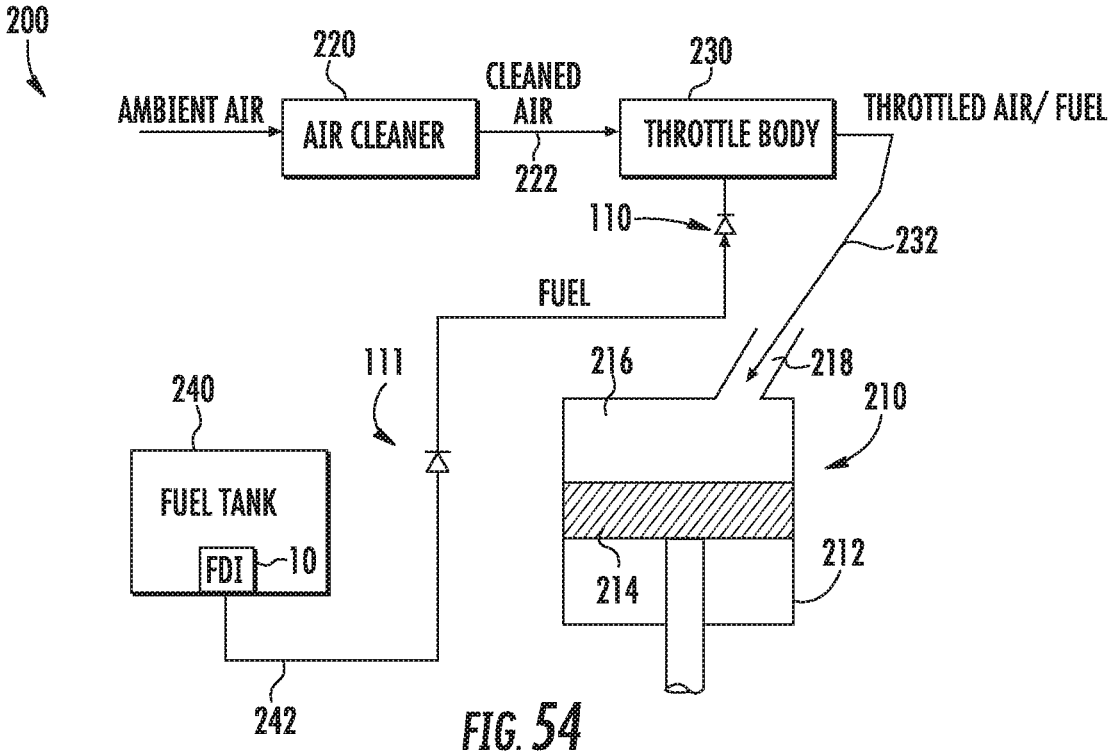

As shown in FIGS. 50 and 53-54, the FDI unit 10 is coupled to (e.g., mounted directly within, etc.) the fuel tank 240 (e.g., submerged in fuel, etc.) and the outvalve assembly 110 (e.g., the outvalve retainer 120, the seat assembly 130, etc.) is positioned remotely from the FDI unit 10. In such embodiments, the engine system 200 does not include the return conduit 244. As shown in FIGS. 50 and 53-54, the engine system 200 does not include the fuel pump 250 or the fuel line 252 as the FDI unit 10 may be capable of providing sufficient pressure to deliver fuel to the outvalve assembly 110 through the outlet conduit 242. Mounting the FDI unit 10 to the fuel tank 240 may be particularly useful in engines 210 where the fuel tank 240 is a component of or mounted to the engine 210 (e.g., as in many horizontal shaft engines and in many vertical shaft engines including those used on walk-behind lawn mowers), rather than engines 210 where the fuel tank 240 is mounted remotely from the engine 210 (e.g., in many ride-on lawn tractors). In other applications, such as generator sets, it may be useful to mount the FDI unit 10 separately from the engine 210.

As shown in FIG. 50, the outvalve assembly 110 is coupled to (e.g., mounted directly within, etc.) the cylinder head 216 of the cylinder 212 for direct injection of fuel into the combustion chamber through the cylinder head 216. The fuel from the outvalve assembly 110 may thereby mix with the air from the throttle body 230 directly within the cylinder 212. Alternatively, the outvalve assembly 110 is coupled to the cylinder head 216 to deliver fuel into the intake valve pocket 221 of the cylinder head 216 associated with the intake valve 223. The fuel from the FDI unit 10 may thereby mix with the air from the throttle body 230 directly within the valve pocket 221. Semi-direct injection (SDI) is performed by timing injection of fuel from the FDI unit 10 into the valve pocket with the intake stroke of the associated piston. As shown in FIG. 53, the outvalve assembly 110 is coupled to (e.g., mounted directly within, etc.) the cylinder intake port 218 of the cylinder 212 for port injection of fuel into the cylinder head 216 through the cylinder intake port 218. The fuel from the outvalve assembly 110 may thereby mix with the air from the throttle body 230 within the cylinder intake port 218 and then flow into the cylinder head 216. As shown in FIG. 54, the outvalve assembly 110 is coupled to the throttle body 230. The fuel from the outvalve assembly 110 may thereby mix with the air within the throttle body 230 and then the air-fuel mixture may be delivered to the cylinder intake port 218. According to an exemplary embodiment, the "pump-in-tank" arrangement of the FDI unit 10 of FIGS. 50 and 53-54 with the remotely positioned outvalve assembly 110 may allow the FDI unit 10 to be used in systems with little available space, allowing for improved packaging (e.g., especially for systems for smaller engines, etc.). In some embodiments of the engine systems 200 shown in FIGS. 50 and 53-54, a second outvalve assembly, shown as outvalve assembly 111, may be located between the FDI unit 10 located in the fuel tank 240 and the first outvalve assembly 110 located remotely from the FDI unit 10 due to the distance between the first outvalve assembly 110 and the FDI unit 10 and the associated amount of fuel volume from the FDI unit 10 to first outvalve assembly 110 that must be pressurized to open the outvalve assembly 110. Using two outvalve assemblies 110 results in a charge of fuel being stored in the volume or space between the two outvalve assemblies 110, with the first outvalve assembly 110 opening due to pressure in this volume to discharge fuel for combustion. The two outvalve assemblies 110 may be configured differently (e.g., different spring rates, check ball sizes, orifice hole sizes, etc.) depending on the requirements of the system needed to provide the appropriate amount of fuel for combustion.

Figure 55:
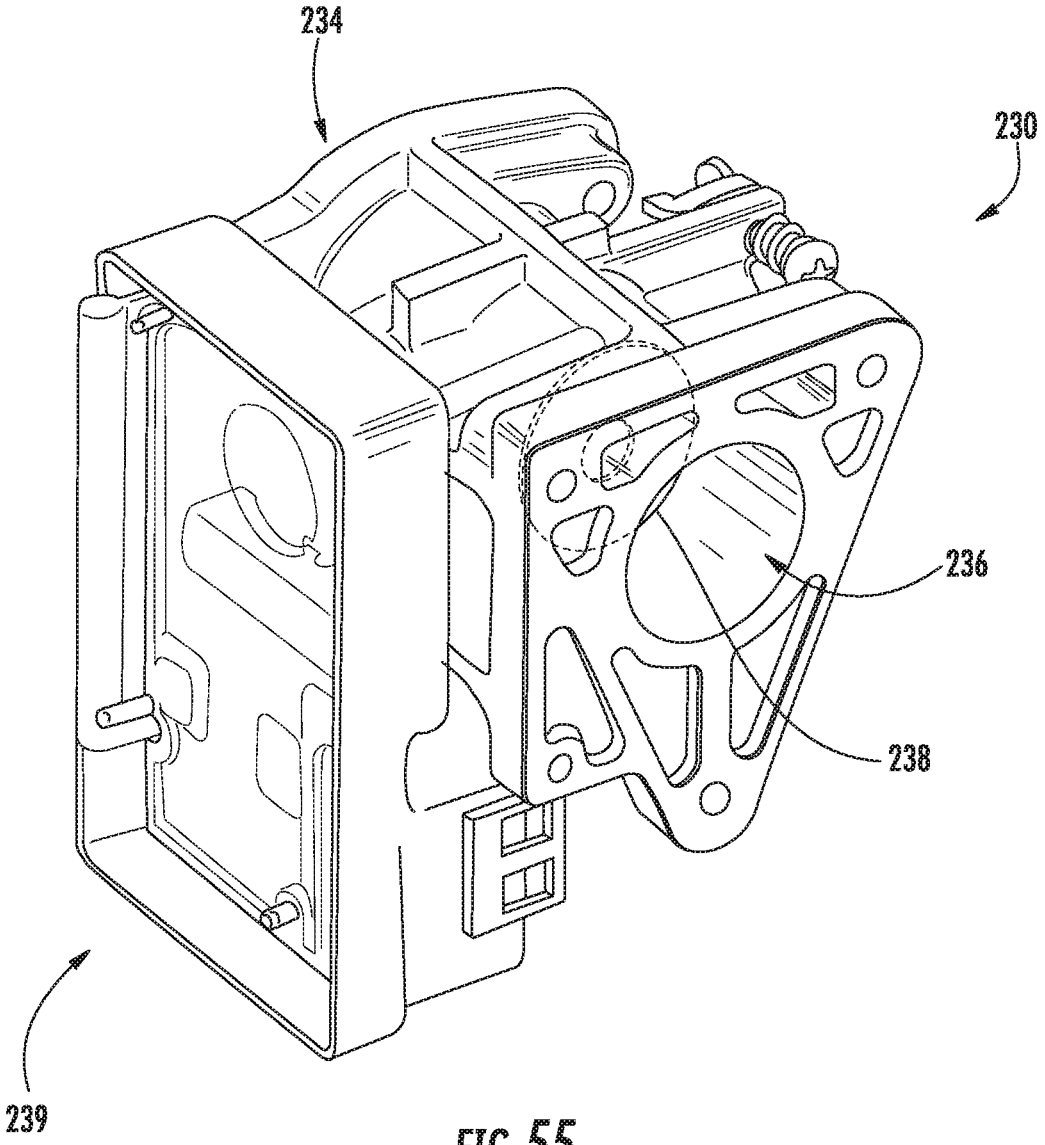
FIGS. 55-56 are various views of a throttle body, according to an exemplary embodiment.
Figure 56:
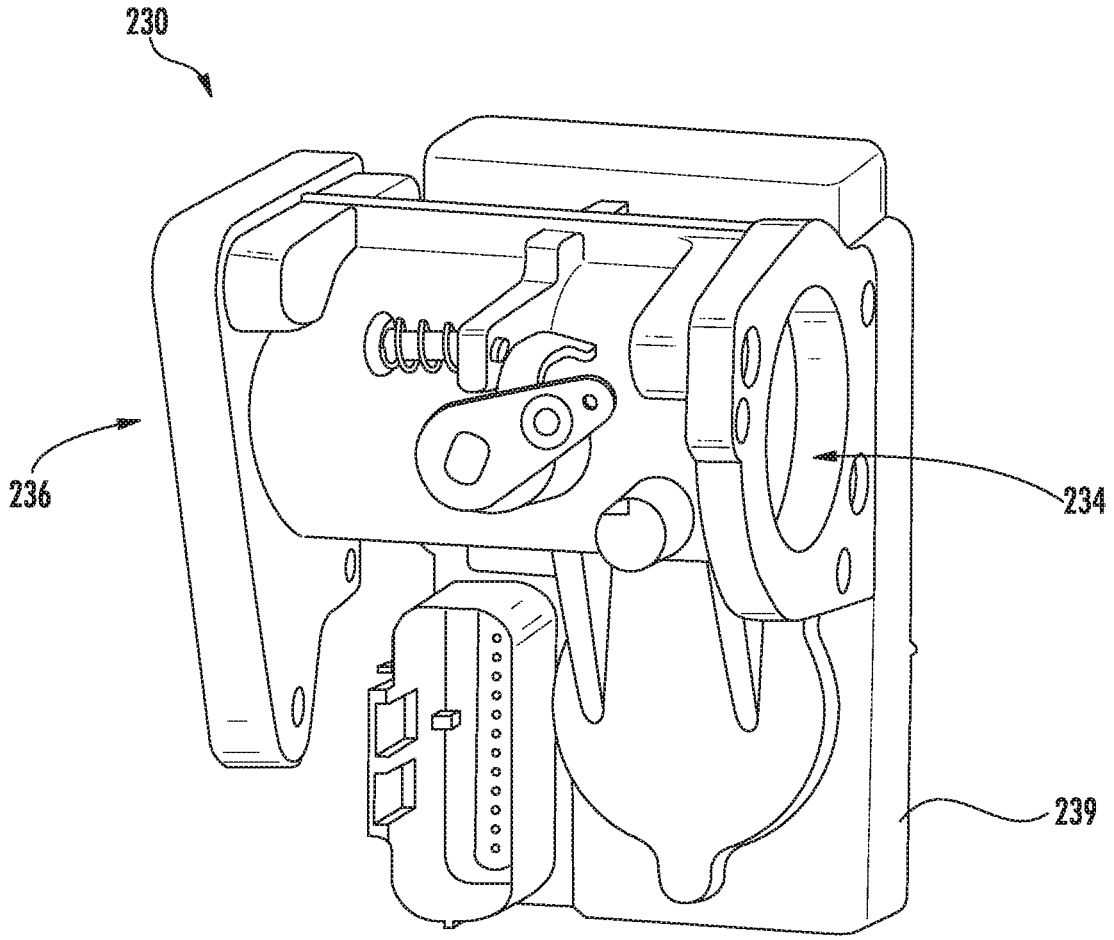

According to the exemplary embodiment shown in FIGS. 55-56, the throttle body 230 includes an inlet, shown as inlet port 234, an outlet, shown as outlet port 236, throttle plate 238, and a recess, shown as circuitry compartment 239. According to an exemplary embodiment, the inlet port 234 is configured to couple to the cleaned air conduit 222 such that the throttle body 230 receives clean air. The throttle plate 238 may be selectively controlled (e.g., by a throttle lever, etc.) to modulate (e.g., throttle, etc.) the flow of air exiting the throttle body 230. In some embodiments, the throttle body 230 includes a mounting interface to facilitate coupling the FDI unit 10 and/or the outvalve assembly 110 directly to the throttle body 230. The outlet port 236 is configured to couple to the throttled air conduit 232 and/or directly to an intake manifold of the engine 210 such that the throttle body 230 may provide throttled air and/or a throttled air-fuel mixture to the cylinder head 216. According to an exemplary embodiment, the circuitry compartment 239 is configured to receive least a portion of control circuitry (e.g., a PCB, the circuit 400 of FIG. 58, etc.) for the throttle body 230 and/or the FDI unit 10.

Various injection systems may be used in conjunction with the FDI unit 10 described herein. These injection systems may include, but are not limited to, direct injection, semi-direct injection (valve pocket), port injection, manifold injection, and throttle body injection.

Fuel Delivery Injector Unit Controls

Figure 57:
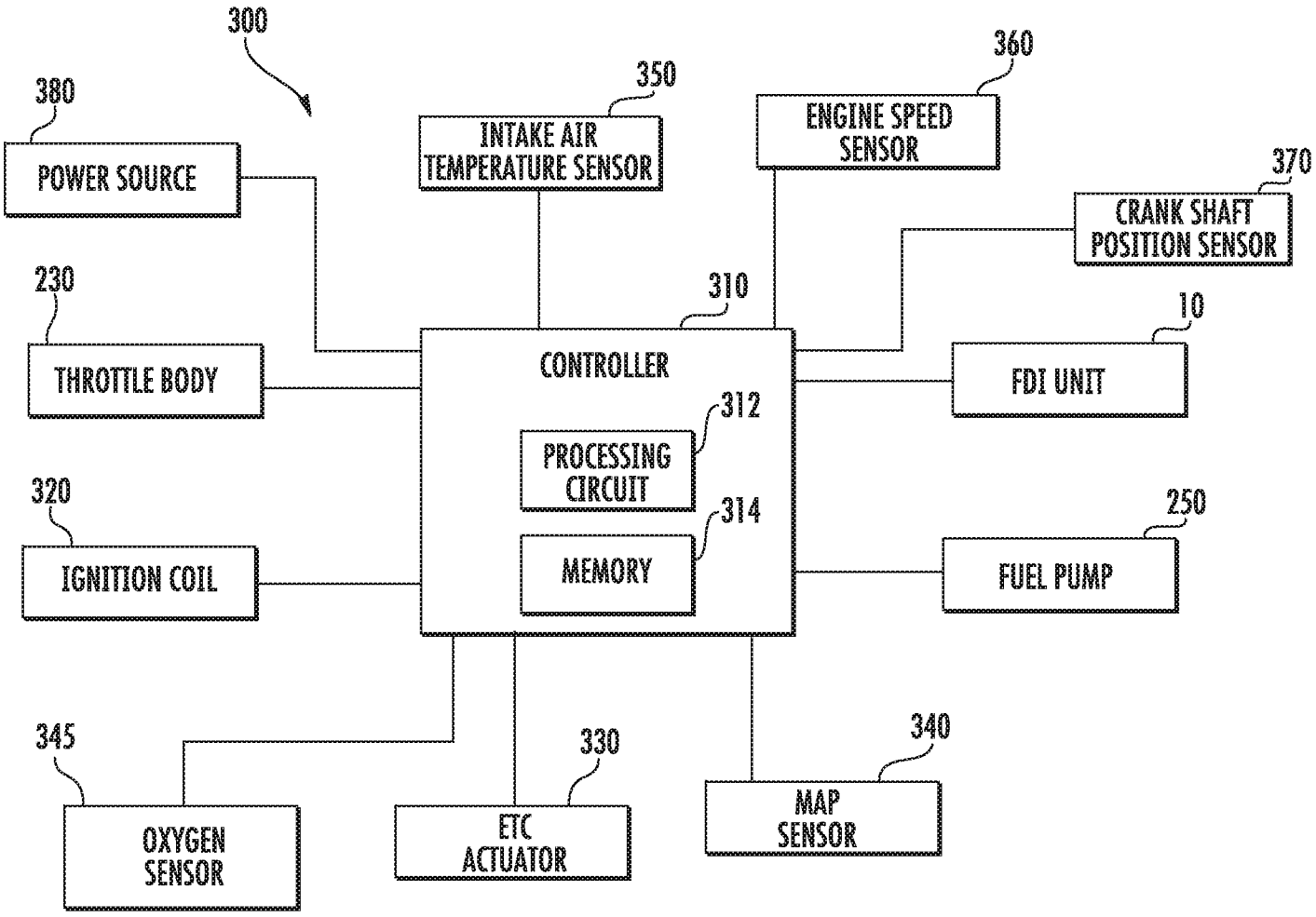
FIG. 57 is a schematic diagram of a control system for a fuel delivery system, according to an exemplary embodiment.

According to the exemplary embodiment shown in FIG. 57, a control system 300 for the engine system 200 includes a controller 310. In one embodiment, the controller 310 is configured to selectively engage, selectively disengage, control, and/or otherwise communicate with components of the engine system 200 and/or the FDI unit 10 (e.g., actively control the components thereof, etc.). As shown in FIG. 57, the controller 310 is coupled to the FDI unit 10 (e.g., the coil 66, etc.), the throttle body 230 (e.g., a throttle plate actuator, etc.), the fuel pump 250, an ignition coil 320, an engine throttle control (ETC) actuator 330, a manifold absolute pressure (MAP) sensor 340, an intake air temperature sensor 350, an engine speed sensor 360, a crankshaft position sensor 370, and a power source 380 (e.g., a battery, a capacitor, a generator, etc.). In other embodiments, the controller 310 is coupled to more or fewer components. In some embodiments, the controller 310 is coupled to a throttle position sensor configured to detect the position of the throttle valve or plate (e.g., the throttle angle). In some embodiments the controller 310 is coupled to an electronic governor to monitor and control the operation of the electronic governor and thereby control engine speed. In some embodiments, the controller 310 is coupled to an oxygen sensor 345. The oxygen sensor 345 may be used to enable closed loop air-fuel ratio control by monitoring oxygen levels (e.g., narrow band or wide band control). In some embodiments, the controller 310 includes one or more communication ports (e.g., for CAN, Wi-Fi, Bluetooth, cellular, K-line, or other communication protocols). By way of example, the controller 310 may send and/or receive signals with the FDI unit 10, the throttle body 230, the fuel pump 250, the ignition coil 320, the ETC actuator 330, the MAP sensor 340, the intake air temperature sensor 350, the engine speed sensor 360, the crankshaft position sensor 370, and/or the power source 380. In some embodiments, at least a portion of the controller 310 is disposed directly within the circuitry compartment 170 of the FDI unit 10 (e.g., a smart FDI unit, the circuit 500, the circuit 600, etc.) and/or the circuitry compartment 239 of the throttle body 230 (e.g., the circuit 400, etc.). In some embodiments, as shown in FIGS. 51-52, the circuitry compartment 170 is a component of the manifold 281. In embodiments, where the fuel pump 250 is mechanically driven (i.e., not electrically driven), the controller 310 may not need to be coupled to the fuel pump 250.

According to the exemplary embodiment shown in FIG. 57, the controller 310 includes a processing circuit 312 and a memory 314. The processing circuit 312 may include an ASIC, one or more FPGAs, a DSP, circuits containing one or more processing components, circuitry for supporting a microprocessor, a group of processing components, or other suitable electronic processing components. In some embodiments, the processing circuit 312 is configured to execute computer code stored in the memory 314 to facilitate the systems and processes described herein. The memory 314 may be any volatile or non-volatile computer-readable storage medium capable of storing data or computer code relating to the systems and processes described herein. According to an exemplary embodiment, the memory 314 includes computer code modules (e.g., executable code, object code, source code, script code, machine code, etc.) configured for execution by the processing circuit 312.

The ignition coil 320 may be configured to up-convert a low voltage input provided by the power source 380 to a high voltage output to facilitate creating an electric spark in a spark plug of the engine 210 to ignite the air-fuel mixture provided by the FDI unit 10 and the throttle body 230 within the combustion chamber of the engine 210. The controller 310 may be configured to control the voltage input received by the ignition coil 320 from the power source 380, the voltage output from the ignition coil 320 to the spark plug, and/or the timing at which the spark is generated.

The ETC actuator 330 may be configured to facilitate electronically controlling a throttle of the engine 210. By way of example, the ETC actuator 330 may operate as an electronic governor for the engine 210. In some embodiments, the ETC actuator 330 is and/or includes a piezoelectric actuator (e.g., a piezo disc motor, etc.). The ETC actuator 330 may be positioned to directly connect with a throttle shaft of the engine 210 and/or with a transmission (e.g., a gearing system, etc.), The controller 310 may be configured to control the ETC actuator 330 to thereby control the throttle of the engine 210. In other embodiments, the engine system 200 includes a mechanical throttle control/governor.

The MAP sensor 340 may be positioned to acquire pressure data indicative of a pressure within the intake manifold of the engine 210. The intake air temperature sensor 350 may be positioned to acquire temperature data indicative of a temperature of the air entering the engine system 200. The engine speed sensor 360 may be positioned to acquire speed data indicative of a speed of the engine 210. The controller 310 may be configured to receive the pressure data, the temperature data, and/or the engine speed data. According to an exemplary embodiment, the controller 310 is configured to interpret the pressure data, the temperature data, and/or the speed data to determine a density of the air, determine an air mass flow rate, approximate a load on the engine 210, and/or control operation of the TDI unit 10 (e.g., a current provided to the coil 66, etc.) to inject a proper amount of fuel for optimum combustion.

The crankshaft position sensor 370 may be positioned to acquire position data indicative of a position (e.g., an angular position, a crank angle, etc.) of a crankshaft to the engine 210. In some embodiments, the crankshaft position sensor 370 is configured to additionally acquire the speed data indicative of a speed of the engine 210 (e.g., the rotational speed of the crankshaft, etc.). In one embodiment, the crankshaft position sensor 370 is and/or includes a gear having a plurality of teeth and a hall effect sensor and/or a variable reluctance sensor. The controller 310 may be configured to receive and interpret the position data to determine how fast the engine 210 is spinning (e.g., revolutions-per-minute (RPMs), etc.) and/or where in the combustion cycle the engine 210 is currently operating (e.g., an intake stroke, a compression stroke, a power stroke, an exhaust stroke, the position of the piston 214 within the cylinder 212, etc.). The controller 310 may be configured to provide cycle synchronization as described herein in relation to FIGS. 61-62 using the position data.

The power source 380 may be configured to power various components of the engine system 200 and/or the control system 300. By way of example, the power source 380 may power the coil 66, the fuel pump 250, the ignition coil 320, ETC actuator 330, the MAP sensor 340, the intake air temperature sensor 350, the engine speed sensor 360, and/or the crankshaft position sensor 370. The power source 380 may additionally or alternatively be configured to be used to start the engine 210.

According to one embodiment, the FDI unit 10, the throttle body 230, controller 310, the ignition coil 320, and/or the ETC actuator 330 are integrated into a single assembly configured to couple to the intake manifold of the engine 210. According to another embodiment, the FDI unit 10, the throttle body 230, controller 310, and/or the ETC actuator 330 are integrated into a single assembly. In some embodiments, the MAP sensor 340 and/or the intake air temperature sensor 350 are integrated into the FDI unit 10 (e.g., a FDI unit that is directly coupled to the cylinder head 216, a FDI unit and throttle body combination that is directly coupled to the intake manifold, etc.). In some embodiments, the MAP sensor 340 and the temperature sensor 350 is integrated with the controller 310, which is integrated with the throttle body 230. Integrating the MAP sensor 340 and/or the intake air temperature sensor 350 into the FDI unit 10 may reduce wiring harness requirements and/or system costs.

Figure 58:
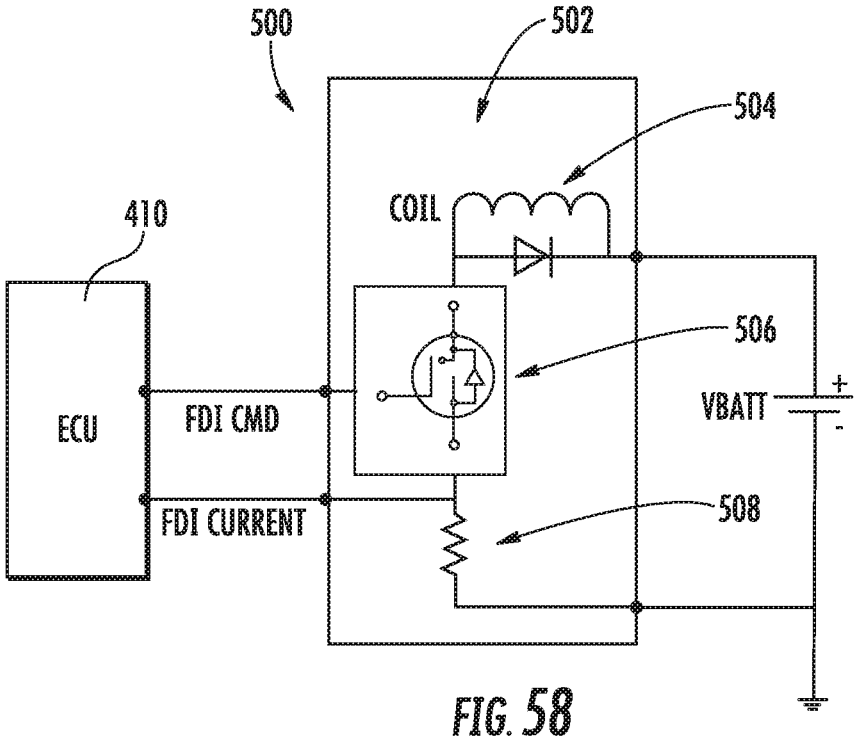
FIG. 58 is a schematic diagram of a control circuit for a fuel delivery injector unit, according to an exemplary embodiment.
Figure 59:
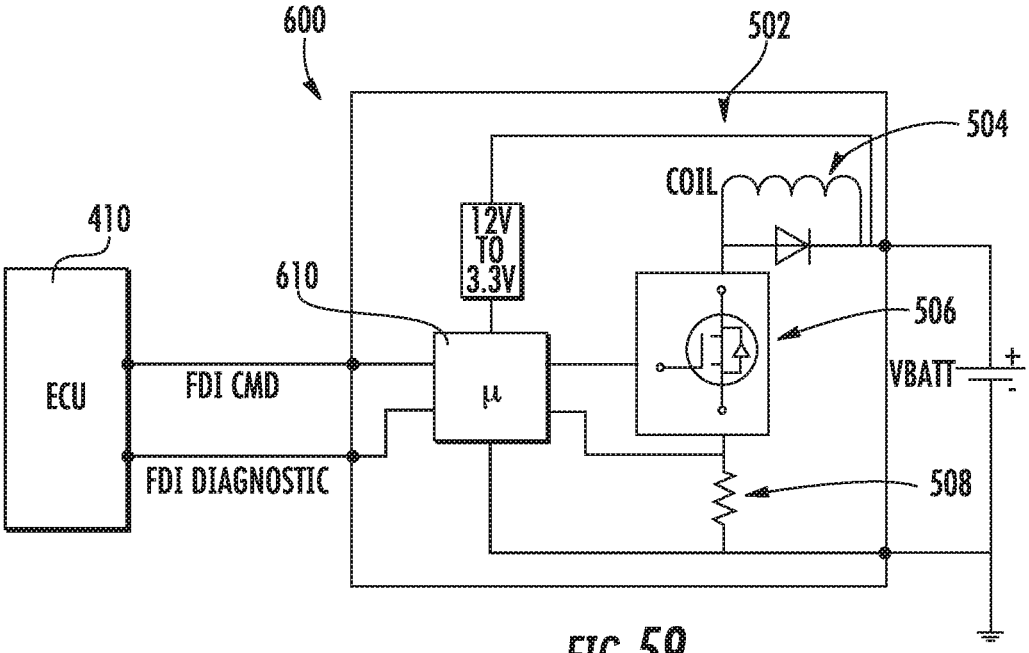
FIG. 59 is a schematic diagram of a control circuit for a fuel delivery injector unit, according to another exemplary embodiment.

Referring now to FIGS. 58-59, a first circuit, shown as circuit 500, and a second control circuit, shown as circuit 600, are shown according to various exemplary embodiments. According to an exemplary embodiment, the circuit 500 and/or the circuit 600 include and/or control operation of at least some of the components of the control system 300. The circuit 500 and/or the circuit 600 are configured to be received within the circuitry compartment 170 of the FDI unit 10, according to an exemplary embodiment. Such direct integration of the circuit 500 and/or the circuit 600 with the FDI unit 10 may configure the FDI unit 10 into a smart FDI unit (e.g., see FIGS. 40-43).

According to the exemplary embodiment shown in FIG. 58, the circuit 500 includes a driver module 502 that includes one or more components that may traditionally be included with the controller 310. As shown in FIG. 59, the driver module 502 of the circuit 500 includes a field effect transistor (FET) 504, a flyback diode 506, and a shunt resistor 508. In such an embodiment, the controller 310 may still send commands to the components of the driver module 502 to control operation thereof (e.g., control a level of current being sent to the coil 66, control an injection duration, etc.). Moving driver components from the controller 310 to the circuit 500 may advantageously (i) allow for a reduction in the current rating of the controller 310, (ii) allow for the size of the controller 310 to be reduced, and (iii) allow for increased heat dissipation of the controller 310.

According to the exemplary embodiment shown in FIG. 59, the circuit 600 includes a driver module 502 that includes one or more components that may traditionally be included with the controller 310. As shown in FIG. 59, the driver module 502 of the circuit 600 includes the field effect transistor (FET) 504, the flyback diode 506, and the shunt resistor 508. As shown in FIG. 59, the circuit 600 also includes a microcontroller 610. The microcontroller 610 may perform various operations that may originally be performed by the controller 310. The microcontroller 610 may be implemented as a general-purpose processor, an application specific integrated circuit (ASIC), one or more field programmable gate arrays (FPGAs), a digital-signal-processor (DSP), circuits containing one or more processing components, circuitry for supporting a microprocessor, a group of processing components, or other suitable electronic processing components. The microcontroller 610 may control the level of current being sent to the coil 66 and the injection duration based on a command signal from the controller 410. For example, the controller 410 may provide a signal indicating the volume of fuel to inject, and the microcontroller 610 may determine the current and injection duration required to inject the desired volume of fuel. The microcontroller 610 may include a flow adjustment algorithm that allows for calibration which may be flashed directly to the microcontroller 610 during manufacture. The microcontroller 610 may also be configured to provide diagnostics to the controller 310. The arrangement of circuit 600 may advantageously (i) allow for a reduction in the required capability of the controller 310 as the controller 310 would no longer need to perform the current control and (ii) reduce the cost of the FDI unit 10 because tolerances do not need to be as tight as the microcontroller 610 has calibration capabilities.

Figure 60:
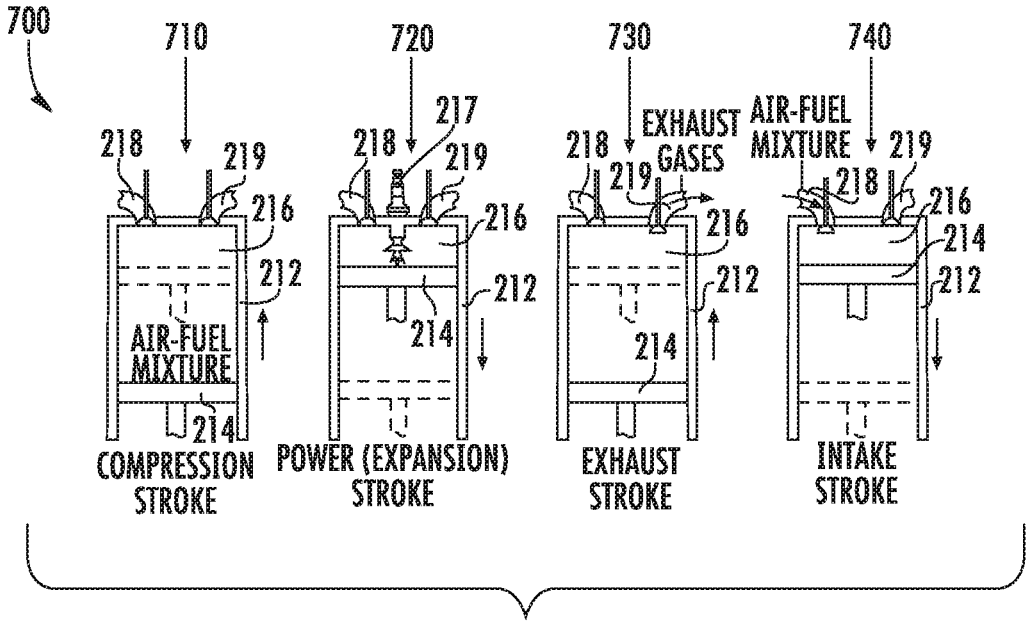
FIG. 60 is an illustration of a combustion cycle for a four-stroke internal combustion engine, according to an exemplary embodiment.
Figure 61:
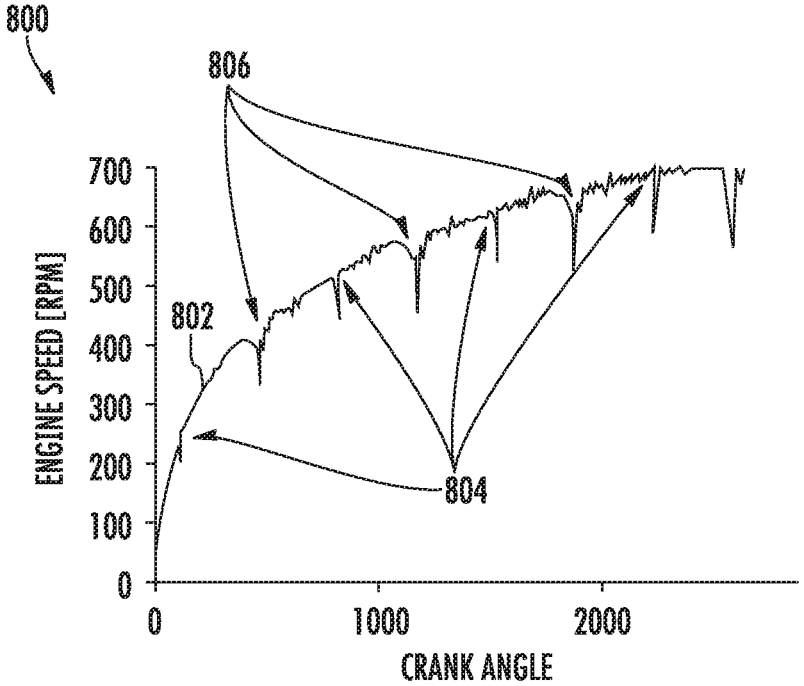
FIG. 61 is a graph of engine speed versus crank angle for an internal combustion engine, according to an exemplary embodiment.

Referring now to FIGS. 60-61, cycle synchronization may be provided by the controller 310 based solely on a signal received from the crankshaft position sensor 370. In large engine applications, engines may include both a crankshaft sensor and a camshaft sensor in four-stroke engine applications to provide information on instantaneous engine speed and synchronization. The camshaft sensor may be used to determine which portion of the combustion cycle an engine is on (e.g., a compression-power cycle or an exhaust-intake cycle). Small four-stroke engine applications do not traditionally include a camshaft sensor (e.g., due to packaging restrictions, cost restrictions, etc.), and therefore it is unknown whether a cylinder of the engine is operating in the compression-power cycle or the exhaust-intake cycle at any given time. Thus, a waste spark strategy is frequently used where a spark is fired each revolution during a power stroke and an intake stroke of the engine. Waste spark strategies may disadvantageously (i) waste electrical energy (e.g., the energy used to create the waste spark, etc.), (ii) increase emissions, and (iii) cause pre-fire resulting in suboptimal valve timing. In some implementations, a MAP signal (e.g., from a MAP sensor) may be used to provide synchronization, however the MAP signal leads to ineffective control at engine start-up due to an undesirable signal-to-noise ratio in the MAP signal.

As shown in FIG. 60, a four-stroke engine cycle 700 for the engine 210 includes a compression stroke 710, a power stroke 720, an exhaust stroke 730, and an intake stroke 740. During the intake stroke 740, the piston 214 begins at near top dead center (TDC) and ends at near bottom dead center (BDC) within the cylinder 212. During the intake stroke 740, an intake valve is opened while the piston 214 pulls an air-fuel mixture into the cylinder head 216 through the cylinder intake port 218. During the compression stroke 710, the piston 214 begins at BDC (or at the end of the intake stroke 740) and ends at TDC. During the compression stroke 710, the piston 214 compresses the air-fuel mixture in preparation for ignition. During the power stroke 720, the piston begins at TDC (or the end of the compression stroke 710) and the compressed air-fuel mixture is ignited by a spark plug 217 forcefully returning the piston 214 to BDC. During the exhaust stroke 730, the piston 214 begins at near BDC and ends at near TDC within the cylinder 212. During the exhaust stroke 730, an exhaust valve is opened while the piston 214 moves towards TDC, expelling the spent air-fuel mixture through a cylinder exhaust port 219.

In FIG. 61, a graph 800 including an engine speed versus crank angle curve 802 is depicted that corresponds with the four-stroke engine cycle 700 of FIG. 60. According to an exemplary embodiment, the data of the engine speed versus crank angle curve 802 is acquired solely with the crankshaft position sensor 370. The engine speed versus crank angle curve 802 includes a first plurality of indicators, shown as exhaust indicators 804, and a second plurality of indicators, shown as compression indicators 806. According to an exemplary embodiment, the exhaust indicators 804 indicate that the engine 210 is operating in the exhaust-intake cycle (e.g., the exhaust stroke 730) and the compression indicators 806 indicate the engine 210 is operating in the compression-power cycle (e.g., the compression stroke 710). By way of example, during the exhaust stroke 730, the engine speed may reduce for a period time as indicated by the exhaust indicators 804 since the piston 214 has to work against the spent-air fuel mixture to expel it from the cylinder 212. By way of another example, during the compression stroke 710, the engine speed may reduce for a greater period of time as indicated by the compression indicators 806 since the piston 214 has to work against the increasing pressure of the air-fuel mixture within the cylinder as the piston 214 moves from BDC to TDC, thereby slowing the piston 214 more than during the exhaust stroke 730.

According to an exemplary embodiment, the controller 310 is configured to interpret the data acquired by the crankshaft position sensor 370 to identify the exhaust indicators 804 and the compression indicators 806. Therefore, the controller 310 may be configured to determine, not only the location (i.e., crank angle) of the piston 214 based on the data acquired by the crankshaft position sensor 370, but also whether the cylinder 212 (or piston 214) is operating in the compression-power cycle or the exhaust-intake cycle (e.g., identified by the exhaust indicators 804 and the compression indicators 806, etc.). Thus, the controller 310 may provide four-stroke engine synchronization using only the crankshaft position sensor 370, as well as eliminate the need for a waste spark strategy. Alternatively, the controller 310 is configured to identify the exhaust indicators 804 and the compression indicators 806 based on the difference in engine speed between the intake and power strokes (e.g., rotational speed of the crankshaft) detected by the engine speed sensor 360.

The uncontrolled current level through the FDI coil 66 may be affected by the supply voltage, the coil temperature, and manufacturing tolerances. The pressure produced by the FDI unit 10 is directly proportional to the coil current and thus, it is necessary to control the coil current to ensure consistent fuel delivery and spray. Accordingly, an average current level is chosen to provide a margin for these changes. Two methods of controlling the coil current are described herein. One method includes a high-side current sensing circuit (shown in FIG. 62) and another method includes a low-side current sensing circuit (shown in FIG. 63).

Figure 63:
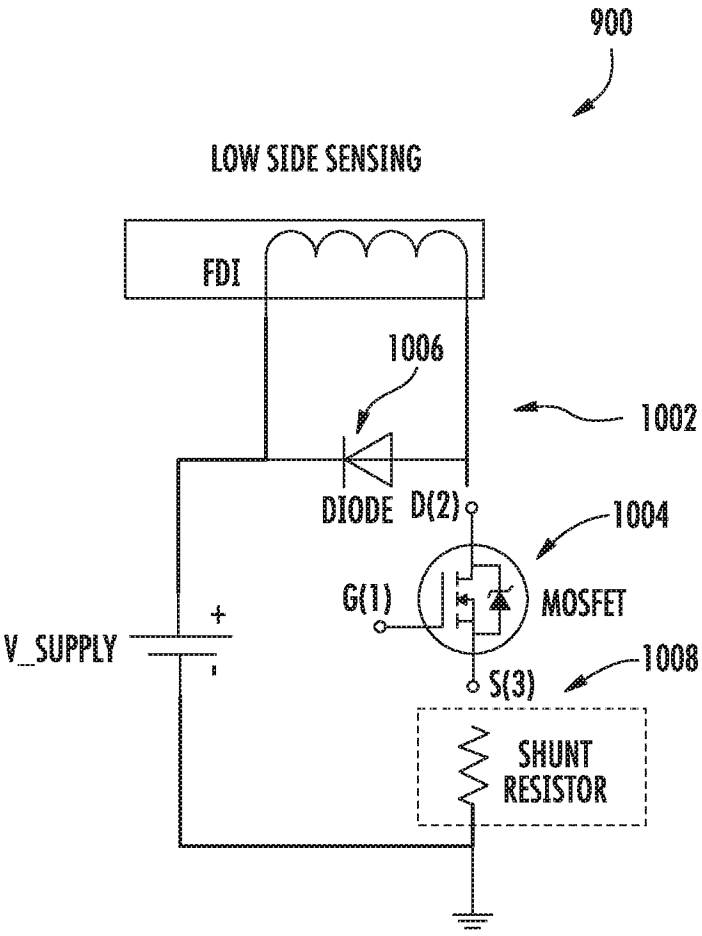
FIG. 63 is a schematic diagram of a control circuit for a fuel delivery injector unit, according to another exemplary embodiment.
Figure 62:
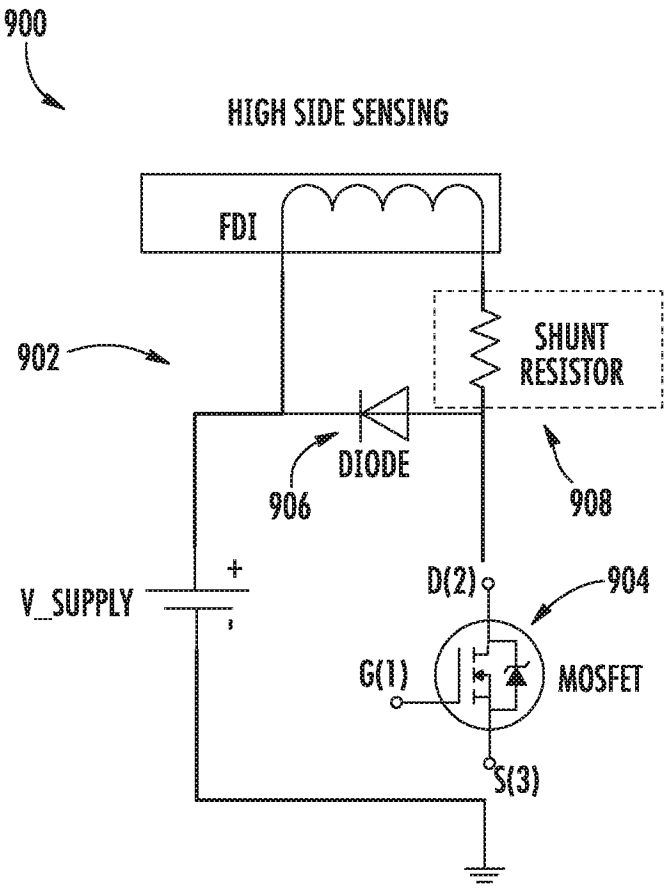
FIG. 62 is a schematic diagram of a control circuit for a fuel delivery injector unit, according to an exemplary embodiment.

Referring now to FIGS. 62-63, a high-side current sensing circuit, shown as circuit 900, and a low-side current sensing circuit, shown as circuit 1000, are shown according to various exemplary embodiments. According to an exemplary embodiment, the circuit 900 and/or the circuit 1000 include and/or control operation of at least some of the components of the control system 300. The circuit 900 and/or the circuit 1000 are configured to be received within the circuitry compartment 170 of the FDI unit 10 (shown in FIGS. 40-42), according to an exemplary embodiment. Such direct integration of the circuit 900 and/or the circuit 1000 with the FDI unit 10 may configure the FDI unit 10 into a smart FDI unit (e.g., see FIGS. 40-43). The circuit 900 and/or the circuit 100 can also be received within the circuitry compartment 239 shown in FIGS. 55-56. In some embodiments, the circuit 900 and circuit 1000 can be implemented as a separate piece from the FDI unit and/or throttle body.

Figure 64:
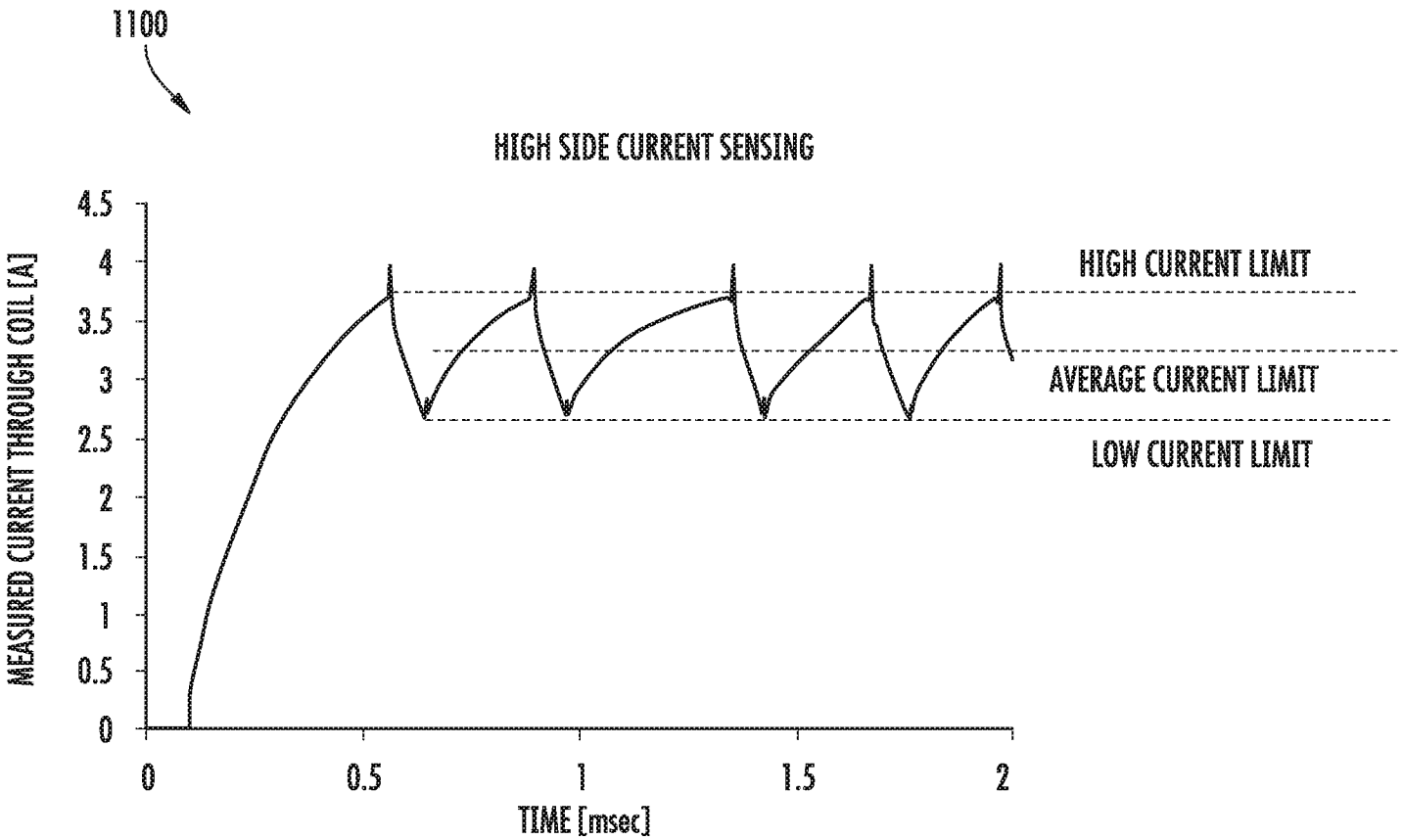
FIG. 64 is a graph of high side current sensing using the control circuit of FIG. 62, according to an exemplary embodiment.

According to the exemplary embodiment shown in FIG. 62, the circuit 900 includes a driver module 902 that includes one or more components that may traditionally be included with the controller 310. As shown in FIG. 62, the driver module 902 of the circuit 900 includes a metal-oxide semiconductor field effect transistor (MOSFET) 904, a flyback diode 906, and a shunt resistor 908. In such an embodiment, the controller 310 may still send commands to the components of the driver module 902 to control operation thereof (e.g., control a level of current being sent to the coil 66, control an injection duration, etc.). In this embodiment, as shown in FIG. 64, using the circuit 900 allows for the current through the coil to be continuously measured such that the average current can be controlled by switching between an upper and lower current limit.

According to the exemplary embodiment shown in FIG. 63, the circuit 1000 includes a driver module 1002 that includes one or more components that may traditionally be included with the controller 310. As shown in FIG. 63, the driver module 1002 of the circuit 1000 includes the MOSFET 1004, the flyback diode 1006, and the shunt resistor 1008. In this embodiment, using the circuit 1000 allows for the current through the coil to be measured when the MOSFET is on such that only the upper current limit is directly controlled.

Figure 65:
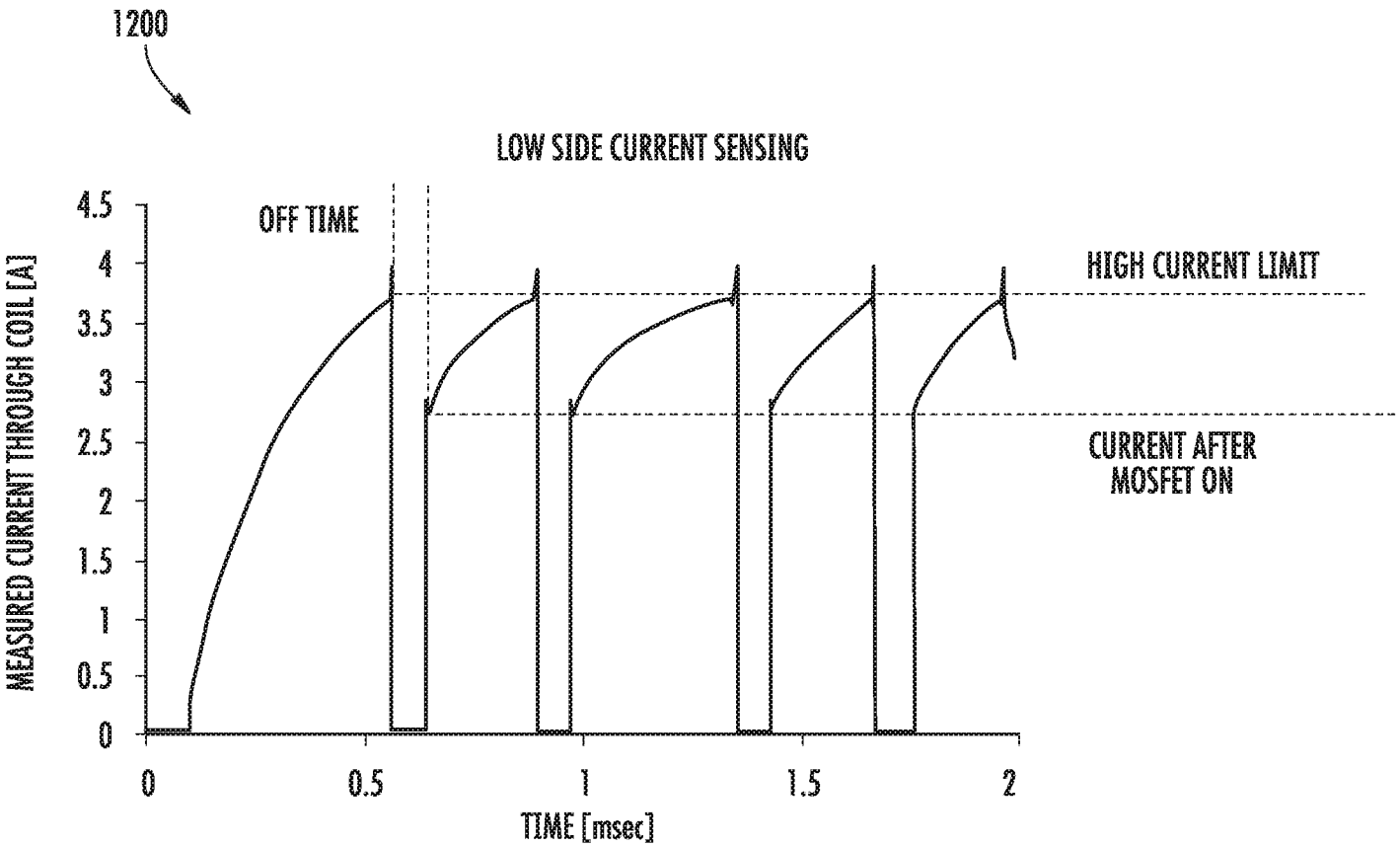
FIG. 65 is a graph of low side current sensing using the control circuit of FIG. 63, according to an exemplary embodiment.

As shown in FIG. 65, to control the lower current limit when using the low side sensing circuit 1000 (shown in FIG. 63), the MOSFET is switch off based on a time period. In this case, there are two methods for low side current control.

One method includes using a fixed off-time. Another method includes using a fixed off-time at the beginning of an injection and then modifying the subsequent off-times based on two possible methods. The first method includes measuring the current immediately subsequent to switching the MOSFET back on. In this case, if the current is lower than desired, the following off-time will be shortened and if the current is higher than desired, the following off-time will be lengthened. The second method includes monitoring the on-time and adjusting the off-time relative to the measured on-time. If the on-time is longer than expected (e.g., the inductance or resistance has increased), the off-time required to reach the specific current level is lengthened.

Figure 66:
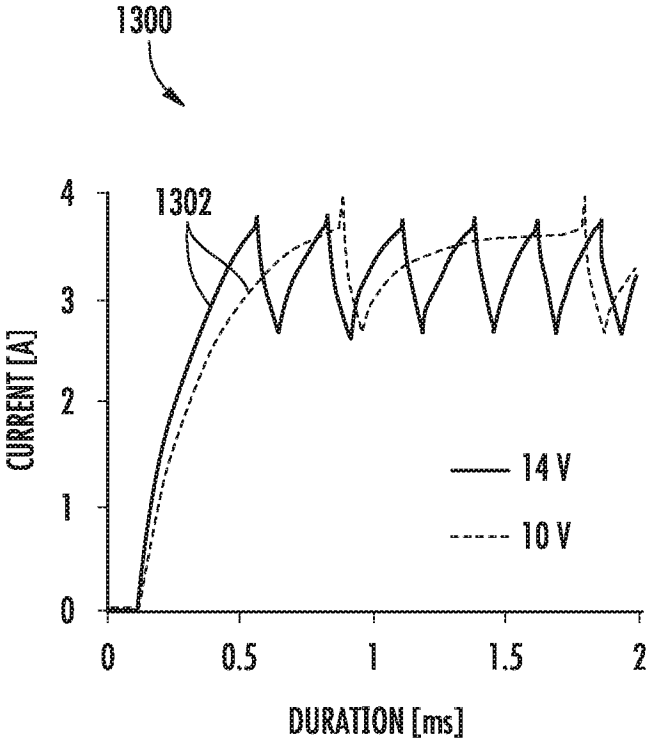
FIG. 66 is a graph of current versus time for a fuel delivery injector, according to an exemplary embodiment.
Figure 67:
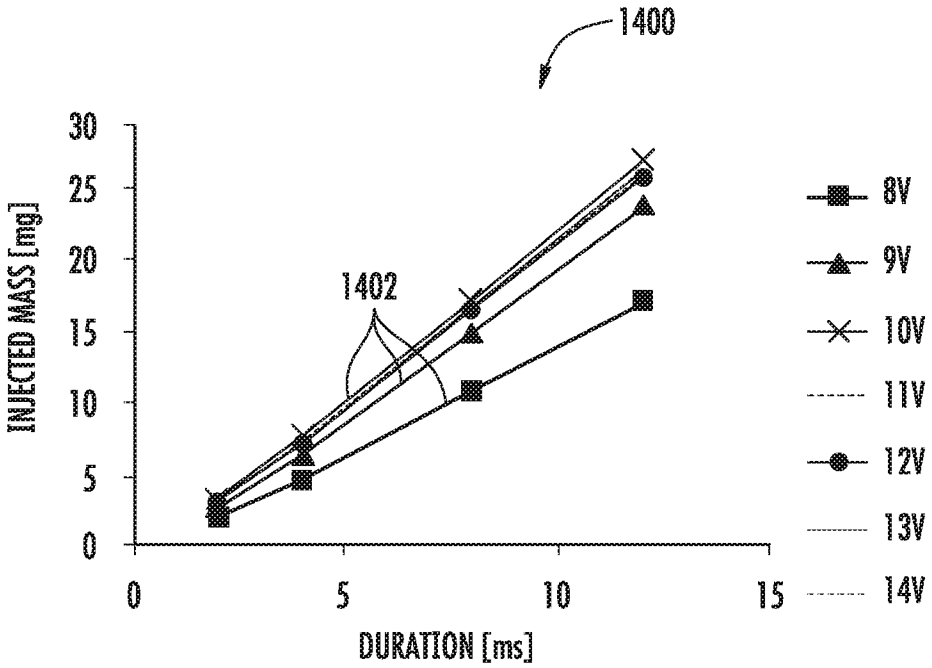
FIG. 67 is a graph of injected mass versus time for a fuel delivery injector, according to an exemplary embodiment.

Referring now to FIGS. 66-67, graphs 1300 and 1400 including current versus time curves 1302 and injected mass versus time curves 1402, respectively, are depicted that correspond with the current controls described above. During current control, variation in supply voltage may affect the current rise rate mainly during the initial part of injection, but also with low voltages that may be experienced during cranking. To compensate for the changes in the current rise rate, the flow rates are measured at different voltages, but with the same control current to produce a table of slopes. The slopes are used directly as a table of slope versus supply voltage. The table of slope multipliers versus supply voltage can be applied to the FDI slope at a nominal voltage to calculate a compensated FDI duration.

Figure 68:
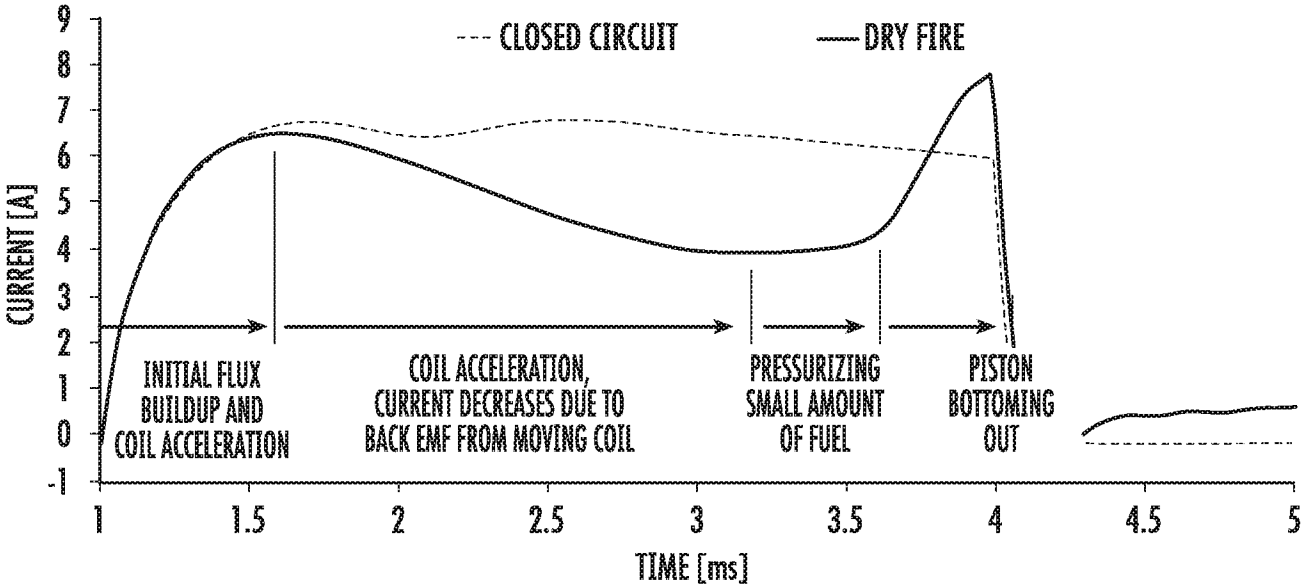
FIG. 68 is a diagnostic graph of current versus time for a fuel delivery injector, according to an exemplary embodiment.
Figure 69:
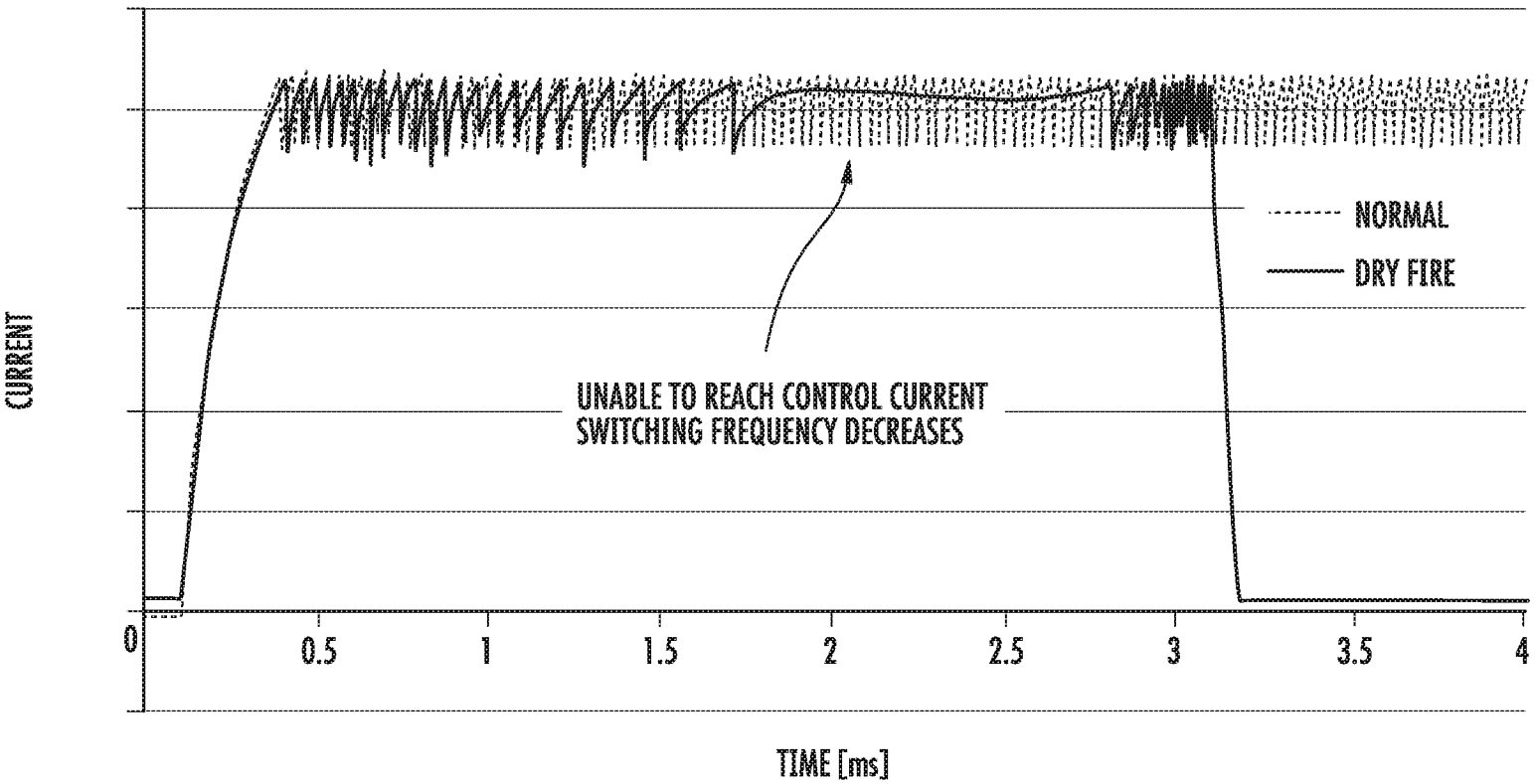
FIG. 69 is a diagnostic graph of current versus time for a fuel delivery injector, according to an exemplary embodiment.

Referring to FIGS. 68-71, the FDI unit 10 controls (shown in FIG. 57) also include various FDI diagnostics. As shown in FIGS. 68-69, a dry fire/vapor lock condition can be diagnosed. As shown in FIG. 68, the uncontrolled current profile for a dry injection is significantly different. Detecting the dry fire condition can lead to an action of limiting the injection duration to prevent impact or thermal damage and applying repeated short injections to clear the vapor. As shown in FIG. 69, a dry fire condition can be detected by monitoring the MOSFET switching frequency during the injection. If the frequency dips below a predetermined threshold, a dry fire condition is detected.

Figure 70:
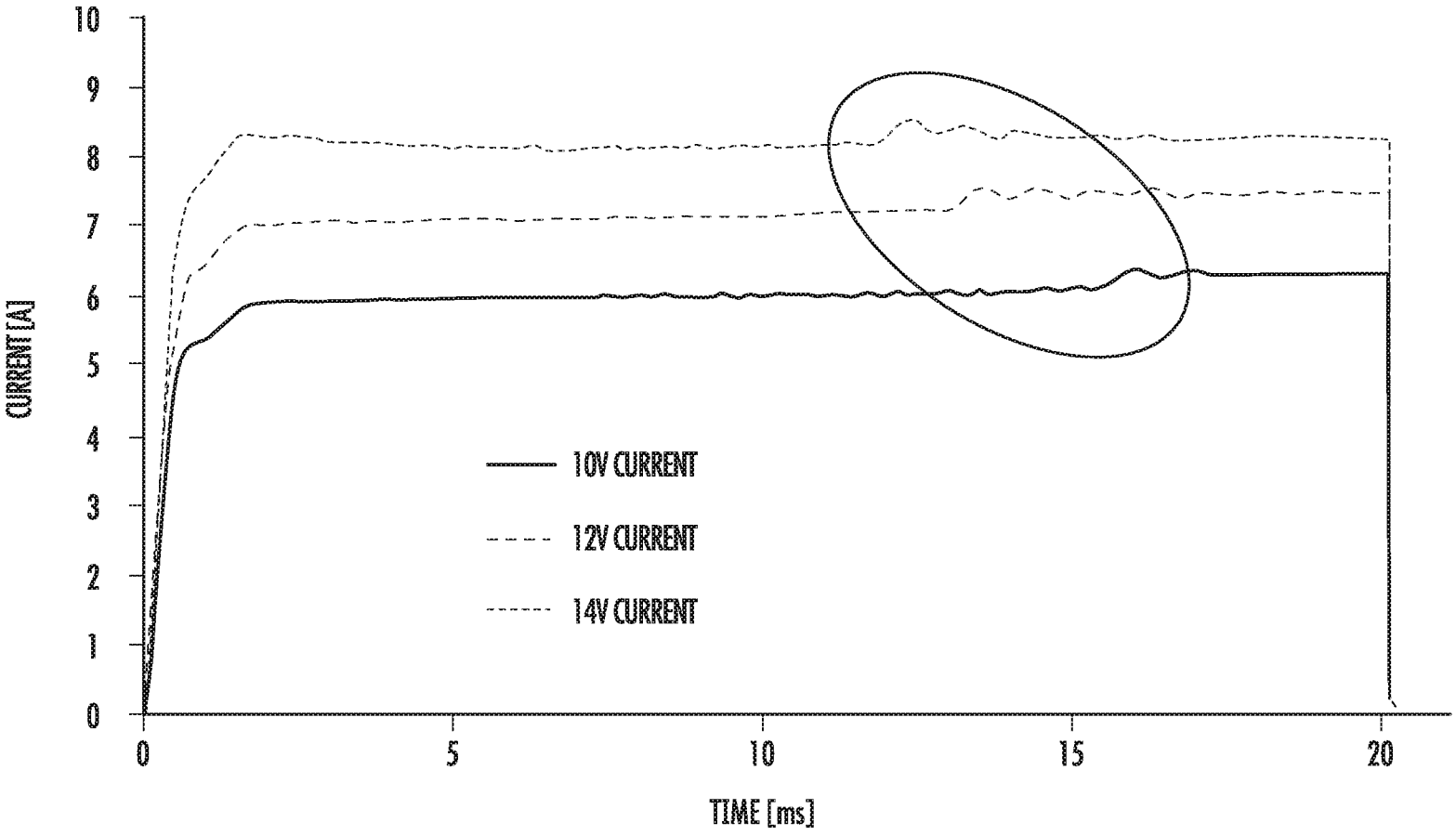
FIG. 70 is a diagnostic graph of current versus time for a fuel delivery injector, according to an exemplary embodiment.
Figure 77:
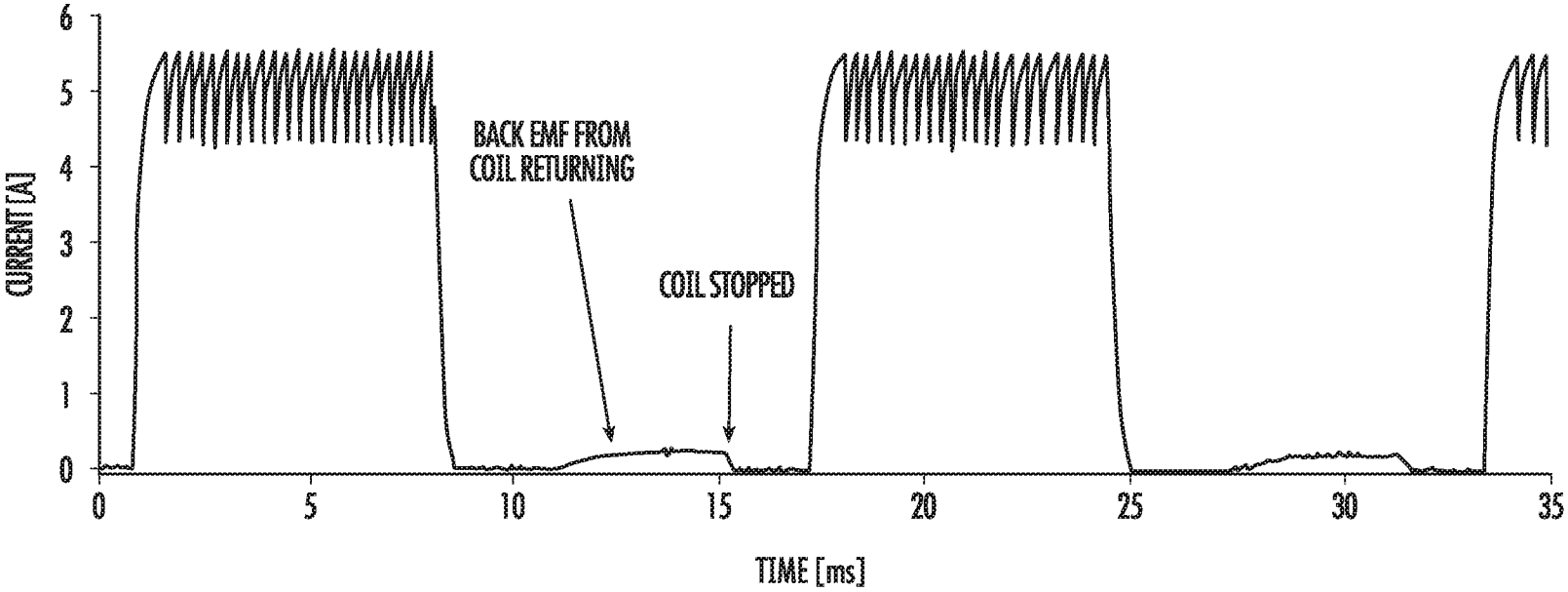

Another FDI diagnostic includes monitoring the maximum on-time. As shown in FIG. 70, the maximum on-time can be determined during an uncontrolled current injection by monitoring for a rise in the current. The rise in current may correspond to the piston impacting the seat of the FDI unit 10. As shown in FIG. 71, further diagnostics can also include monitoring of the coil return current. If high side current sensing is used, the back EMF from the coil returning after injection can be monitored. This measurement can be used to ensure proper return spring 76 operation and that the off-time is sufficient to fully fill the chamber 88 of the FDI unit 10.

The injector unit described herein is not limited in use with fuel and/or with internal combustion engines. The injector unit may be installed on and used with various equipment including, but not limited to, a fertilizer spreader, herbicide spreader, spray gun, etc. Accordingly, the injector unit may be used in conjunction with various types of fluid including, but not limited to, fertilizer, herbicide, soap, etc. For example, a fertilizer spreader, herbicide spreader, or spray gun including a fluid supply container (e.g., tank, reservoir, etc.) containing a liquid fertilizer, herbicide, soap, spot-free rinse solution, or other liquid is fluidly coupled to an injector unit so that the injector unit may supply the liquid in a manner similar to that done with fuel as described herein.

As utilized herein, the terms "approximately", "about", "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. A fuel delivery injector, comprising:

a housing defining a cavity and extending along a central longitudinal axis, wherein the housing includes an upper portion and a lower portion including a sleeve having an outlet;

an end cap coupled to the upper portion of the housing, the end cap including an inlet port fluidly coupled to the cavity to direct liquid fuel and fuel vapor into the cavity and an outlet port fluidly coupled to the cavity to direct liquid fuel and fuel vapor out of the cavity;

a magnetic assembly including a plurality of plates, wherein the plates are arranged to alternate between a non-magnetized plate and a magnetized plate, and wherein the magnetic assembly is fixedly positioned within the cavity;

a pumping assembly including a bobbin and a piston;

the bobbin including a coil configured to be coupled to an electrical power supply, wherein the bobbin is configured to move the pumping assembly within the cavity in response to interaction between a magnetic field created by the coil and the magnetic assembly, wherein the piston is coupled to the bobbin and configured to move within the sleeve;

a return spring coupled to the pumping assembly to bias the pumping assembly to a home position; and a valve assembly positioned within a piston portion between an inlet chamber and an outlet chamber, wherein the valve assembly includes a valve configured to move between an open position in which liquid fuel may flow between the inlet chamber and the outlet chamber and a closed position in which liquid fuel is restricted from flowing between the inlet chamber and the outlet chamber;

wherein the valve assembly includes a biasing spring configured to bias the valve toward the open position;

wherein the inlet port is configured so that the liquid fuel entering the housing through the inlet port flows from the inlet port to the cavity and fuel vapor entering the housing through the inlet port is directed through a conduit to the outlet port.

2. The fuel delivery injector of claim 1, wherein the end cap includes a protrusion extending therefrom and terminating at an end face, the protrusion configured to redirect fuel vapor toward the outlet port.

3. The fuel delivery injector of claim 1, wherein the conduit is substantially perpendicular to the inlet port.

4. The fuel delivery injector of claim 1, wherein the inlet port and the outlet port extend from the end cap perpendicular to the central longitudinal axis of the housing.

5. The fuel delivery injector of claim 1, wherein the end cap further includes an electrical connector configured to electrically couple the coil to the electrical power supply.

6. The fuel delivery injector of claim 5, wherein the electrical connector comprises a female connector formed integrally with the end cap.

7. The fuel delivery injector of claim 5, wherein the electrical connector comprises a connector sealed to the end cap by a sealing feature.

8. The fuel delivery injector of claim 5, wherein the electrical connector comprises insert molded electrical pins connected to the coil of the bobbin.

9. A fuel delivery injector, comprising:

a housing defining a cavity and extending along a central longitudinal axis, wherein the housing includes an upper portion and a lower portion including a sleeve having an outlet;

an end cap coupled to the upper portion of the housing, the end cap including an inlet port fluidly coupled to the cavity to direct liquid fuel and fuel vapor into the cavity and an outlet port fluidly coupled to the cavity to direct liquid fuel and fuel vapor out of the cavity, wherein the inlet port extends along an inlet port axis;

a magnetic assembly including a plurality of plates, wherein the plates are arranged to alternate between a non-magnetized plate and a magnetized plate, and wherein the magnetic assembly is fixedly positioned within the cavity;

a pumping assembly including a bobbin and a piston;

the bobbin including a coil configured to be coupled to an electrical power supply, wherein the bobbin is configured to move the pumping assembly within the cavity in response to interaction between a magnetic field created by the coil and the magnetic assembly, wherein the piston is coupled to the bobbin and configured to move within the sleeve;

a return spring coupled to the pumping assembly to bias the pumping assembly to a home position; and a valve assembly positioned within a piston portion between an inlet chamber and an outlet chamber, wherein the valve assembly includes a valve configured to move between an open position in which liquid fuel may flow between the inlet chamber and the outlet chamber and a closed position in which liquid fuel is restricted from flowing between the inlet chamber and the outlet chamber;

wherein the valve assembly includes a biasing spring configured to bias the valve toward the open position;

wherein the magnetic assembly is positioned offset from the piston.

10. The fuel delivery injector of claim 9, wherein the inlet port is positioned offset from the central longitudinal axis on the end cap between the outlet port and the central longitudinal axis of the housing.

11. The fuel delivery injector of claim 10, wherein the fuel vapor freely exits the housing through the outlet port having been separated from the liquid fuel.

12. The fuel delivery injector of claim 9, wherein the inlet port and the outlet port extend from the end cap perpendicular to the central longitudinal axis of the housing.

13. The fuel delivery injector of claim 9, wherein the end cap further includes an electrical connector configured to electrically couple the coil to the electrical power supply.

14. The fuel delivery injector of claim 13, wherein the electrical connector comprises a female connector formed integrally with the end cap.

15. The fuel delivery injector of claim 13, wherein the electrical connector comprises a connector sealed to the end cap by a sealing feature.

16. The fuel delivery injector of claim 13, wherein the electrical connector comprises insert molded electrical pins connected to the coil of the bobbin.

17. An internal combustion engine, comprising:

a cylinder;

a piston positioned within the cylinder and configured to reciprocate within the cylinder; and a fuel delivery injector, comprising:

a housing defining a cavity and extending along a central longitudinal axis, wherein the housing includes an upper portion and a lower portion including a sleeve having an outlet;

an end cap coupled to the upper portion of the housing, the end cap including an inlet port fluidly coupled to the cavity to direct liquid fuel and fuel vapor into the cavity and an outlet port fluidly coupled to the cavity to direct liquid fuel and fuel vapor out of the cavity, the fuel vapor exiting the fuel delivery injector directly through the cavity and through the outlet port without coming into contact with the liquid fuel within the cavity;

a magnetic assembly including a plurality of plates, wherein the plates are arranged to alternate between a non-magnetized plate and a magnetized plate, and wherein the magnetic assembly is fixedly positioned within the cavity;

a pumping assembly including a bobbin and a piston;

the bobbin including a coil configured to be coupled to an electrical power supply, wherein the bobbin is configured to move the pumping assembly within the cavity in response to interaction between a magnetic field created by the coil and the magnetic assembly, wherein the piston is coupled to the bobbin and configured to move within the sleeve;

a return spring coupled to the pumping assembly to bias the pumping assembly to a home position; and a valve assembly positioned within the piston portion between an inlet chamber and an outlet chamber, wherein the valve assembly includes a valve configured to move between an open position in which liquid fuel may flow between the inlet chamber and the outlet chamber and a closed position in which liquid fuel is restricted from flowing between the inlet chamber and the outlet chamber;

wherein the valve assembly includes a biasing spring configured to bias the valve toward the open position.

18. The engine of claim 17, further comprising:

a throttle body fluidly coupled to the cylinder;

wherein the fuel delivery injector is attached to the throttle body.

19. The engine of claim 17, further comprising:

a cylinder head attached to the cylinder;

wherein the fuel delivery injector is attached to the cylinder head.

20. The engine of claim 17, further comprising:

an intake manifold fluidly coupled to the cylinder;

wherein the fuel delivery injector is attached to the intake manifold.

* * * * *